US011078697B2

(12) United States Patent
Ham et al.

(10) Patent No.: US 11,078,697 B2
(45) Date of Patent: Aug. 3, 2021

(54) HOME APPLIANCE

(71) Applicant: Samsung Electronics Co., Ltd., Suwon-si (KR)

(72) Inventors: Hyung-kwen Ham, Seoul (KR); Hyeon-kyu Lim, Hwaseong-si (KR); Nam-soo Park, Suwon-si (KR); Sang-jin Jeong, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 216 days.

(21) Appl. No.: 16/058,320

(22) Filed: Aug. 8, 2018

(65) Prior Publication Data

US 2019/0063123 A1 Feb. 28, 2019

(30) Foreign Application Priority Data

Aug. 28, 2017 (KR) ..... 10-2017-0108602
May 21, 2018 (KR) ..... 10-2018-0057923

(51) Int. Cl.
*F24C 15/02* (2006.01)
*E05C 7/00* (2006.01)
(Continued)

(52) U.S. Cl.
CPC ..... *E05C 7/005* (2013.01); *E05C 19/12* (2013.01); *E06B 3/485* (2013.01); *E06B 5/00* (2013.01);
(Continued)

(58) Field of Classification Search
CPC ..... F24B 1/192; F24B 13/004; F24C 15/02; F24C 15/028; F24C 15/024; F24C 15/026;
(Continued)

(56) References Cited

U.S. PATENT DOCUMENTS 5,437,168 A 8/1995 Mason et al.
8,752,918 B2 * 6/2014 Kang ..... F25D 23/025 312/405.1
(Continued)

FOREIGN PATENT DOCUMENTS

CN 103477170 A 12/2013
CN 105008830 A 10/2015
(Continued)

OTHER PUBLICATIONS

Extended European Search Report dated Sep. 7, 2020, issued in European Patent Application No. 18852287.4.
(Continued)

*Primary Examiner* — Justin B Rephann
(74) *Attorney, Agent, or Firm* — Jefferson IP Law, LLP

(57) ABSTRACT

A home appliance is provided. The home appliance includes a main body having an accommodation space, a first door rotatably coupled to the main body to open and close the accommodation space and having an opening, a second door rotatably coupled to the first door to open and close the opening, and a locking device configured to fix or separate the first door to or from the main body or fix or separate the second door to or from the first door. The locking device includes a main ring unit, an operating lever configured to separate the second door from the first door by pressure, and a dual opening preventing member configured to maintain a fixed state of the second door with respect to the first door when the operating lever is pressed in a state in which the first door is open.

16 Claims, 43 Drawing Sheets

(51) Int. Cl.

| | |
|---|---|
| ***E05C 19/12*** | (2006.01) |
| ***E06B 3/48*** | (2006.01) |
| ***E06B 5/00*** | (2006.01) |
| *E05C 3/30* | (2006.01) |
| *E05D 15/48* | (2006.01) |

(52) U.S. Cl.
CPC ..... *F24C 15/02* (2013.01); *E05C 3/30* (2013.01); *E05D 15/48* (2013.01); *E05Y 2900/308* (2013.01); *F24C 15/026* (2013.01)

(58) Field of Classification Search
CPC . E05C 7/005; E05C 19/12; E05C 3/30; E06B 3/485; E06B 5/00; F25D 23/025
See application file for complete search history.

(56) References Cited

U.S. PATENT DOCUMENTS

| | | | | |
|---|---|---|---|---|
| 9,353,984 | B2 | 5/2016 | Kim et al. | |
| 9,441,872 | B2 | 9/2016 | Park et al. | |
| 9,448,004 | B2 * | 9/2016 | Kim | E05F 1/063 |
| 10,006,691 | B2 | 6/2018 | Jung | |
| 10,054,360 | B2 | 8/2018 | Kang | |
| 10,126,041 | B2 | 11/2018 | Park et al. | |
| 10,364,991 | B2 * | 7/2019 | Kang | F24C 15/02 |
| 10,502,433 | B2 * | 12/2019 | Park | F24C 15/04 |
| 10,648,725 | B2 | 5/2020 | Park et al. | |
| 2005/0127683 | A1 | 6/2005 | Nam | |
| 2010/0282237 | A1 * | 11/2010 | Atkinson | F24C 3/126 126/39 E |
| 2013/0033163 | A1 | 2/2013 | Kang | |
| 2013/0049562 | A1 * | 2/2013 | Jung | F25D 23/028 312/405 |
| 2014/0097172 | A1 * | 4/2014 | Kang | F24C 7/002 219/394 |
| 2014/0232250 | A1 * | 8/2014 | Kim | F25D 23/028 312/292 |
| 2014/0232251 | A1 | 8/2014 | Kim et al. | |
| 2016/0061511 | A1 | 3/2016 | Park et al. | |
| 2016/0356543 | A1 | 12/2016 | Park et al. | |
| 2017/0108228 | A1 | 4/2017 | Park et al. | |
| 2017/0176086 | A1 | 6/2017 | Kang | |
| 2017/0356685 | A1 * | 12/2017 | Jung | E05B 65/0042 |
| 2019/0041120 | A1 | 2/2019 | Park et al. | |

FOREIGN PATENT DOCUMENTS

| | | | |
|---|---|---|---|
| CN | 106662336 | A | 5/2017 |
| DE | 10 2009 002 276 | A1 | 10/2010 |
| EP | 2 565 565 | A2 | 3/2013 |
| GB | 765006 | A | 1/1957 |
| KR | 10-2011-0042929 | A | 4/2011 |
| KR | 10-2011-0097141 | A | 8/2011 |
| KR | 10-2012-0063307 | A | 6/2012 |
| KR | 10-2014-0120476 | A | 10/2014 |
| KR | 10-2014-0145718 | A | 12/2014 |
| KR | 10-2015-0141865 | A | 12/2015 |
| KR | 10-1595782 | B1 | 2/2016 |
| KR | 10-2016-0025232 | A | 3/2016 |
| KR | 10-1623983 | B1 | 5/2016 |
| KR | 10-2017-0138641 | A | 12/2017 |
| WO | 2015/072793 | A1 | 5/2015 |
| WO | 2015190713 | A1 | 12/2015 |
| WO | 2017/104974 | A1 | 6/2017 |

OTHER PUBLICATIONS

International Search Report and Written Opinion dated Nov. 29, 2018; International Appln. No. PCT/KR2018/009260.
Chinese Office Action dated Feb. 1, 2021, issued in Chinese Application No. 201880053935.2.

* cited by examiner

1000

HOME APPLIANCE

CROSS-REFERENCE TO RELATED APPLICATION(S)

This application is based on and claims priority under 35 U.S.C. § 119(a) of a Korean patent application number 10-2017-0108602, filed on Aug. 28, 2017, in the Korean Intellectual Property Office, and Korean patent application number 10-2018-0057923, filed on May 21, 2018, in the Korean Intellectual Property Office, the disclosure of which is incorporated by reference herein in its entirety.

BACKGROUND

Field

The disclosure relates to a home appliance. More particularly, the disclosure relates to a main body having an accommodation space opened to one side.

Description of the Related Art

Home appliances such as ovens, dishwashers, refrigerators, washing machines, and the like, may have an accommodation space (or a receiving space) and perform a corresponding function in the accommodation space.

For example, an oven has a cooking chamber for cooking food, a dishwasher has a washing chamber for cleaning dishes, a refrigerator has a storage chamber for storing food, and a washing machine has a washing chamber for washing the laundry.

Furthermore, the above-mentioned home appliances have a door for opening and closing the accommodation space.

Recently, home electric appliances include double doors for selectively opening and closing the entirety or a portion of an accommodation space in order to improve availability and efficiency of the accommodation space.

A home appliance having double doors includes a main door (first door) for opening and closing the entirety of an accommodation space and an auxiliary door (second door) for opening and closing a portion of the accommodation space by opening and closing an opening of the main door.

Accordingly, in the home appliance having the double doors, the entirety and a portion of the accommodation space may be selectively open and closed and the accommodation space may be used more efficiently.

For example, an oven having double doors includes a main door for opening and closing the entire cooking chamber and an auxiliary door for opening and closing an opening of the main door. Through the main door and the auxiliary door, the entirety or a portion of the cooking chamber may be selectively open and closed, and a cooking state in a process of cooking may be checked by opening and closing the auxiliary door or only a portion of the cooking chamber may be used without heat loss.

However, the related art home appliances having double doors are disadvantageous in that the auxiliary door may be open unnecessarily in a state in which the main door is open, causing user inconvenience.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an apparatus and method for a home appliance comprising a dual opening preventing member configured to maintain a state in which the second door is coupled to the first door, when the operating lever is pressed in a state in which the first door is open.

Additional aspects will be set forth in part in the description which follows and, in part, will be apparent from the description, or may be learned by practice of the presented embodiments.

In accordance with an aspect of the disclosure, a home appliance is provided. The home appliance includes a main body having an accommodation space opened to one side, a first door rotatably coupled to the main body to open and close the accommodation space and having an opening connected to the accommodation space, a second door rotatably coupled to the first door to open and close the opening, and a locking device configured to fix or separate the first door to or from the main body, or fix or separate the second door to or from the first door to allow the first door and the second door to be selectively rotated. The locking device includes a main ring unit provided in the main body, an operating lever configured to separate the second door from the first door by pressure, and a dual opening preventing member configured to maintain a fixed state of the second door with respect to the first door when the operating lever is pressed in a state in which the first door is open.

The locking device may further include a first locking unit provided in the first door and selectively coupled to the main ring unit, and a second locking unit provided in the second door and selectively coupled to the first locking unit. The operating lever is installed in the second door and is configured to press the second locking unit to separate the second locking unit from the first locking unit.

The main ring unit may include a body provided in the main body, a main ring selectively coupled with the first locking unit, and a pair of pressing members installed below the main ring and installed to be movable up and down with respect to the main body.

The pair of pressing members may be configured as torsion springs, one end of each of the torsion springs may be fixed to the body and the other end of each of the torsion spring in contact with the first locking unit may have a sloped portion.

The first locking unit may include a first holder installed in the first door, a first hook member rotatably installed in the first holder, and a first elastic member configured to apply an elastic force to the first hook member to cause the first hook member to rotate in a first rotation direction to be coupled with the main ring unit. The second locking unit may include a second holder installed in the second door, a second hook member rotatably installed in the second holder, and a second elastic member configured to apply an elastic force to the second hook member to cause the second hook member to rotate in the first rotation direction. The second hook member elastically supports the first hook member to be separated from the main ring unit in a state in which the first and second doors are closed.

The dual opening preventing member may include a rotary ring member rotatably installed in the first holder, and a third elastic member configured to apply an elastic force to the rotary ring member to cause the rotary ring member to rotate in the first rotation direction to be coupled with the second hook member.

When the first and second doors are closed, the rotary ring member may be pressed by the main ring unit in a state in which the rotary ring member is coupled with the second hook member, and when the first door is opened, the rotary ring member may be separated from the main ring unit and elastically supported by the second hook member.

The second hook member may be pressed by the operating lever to rotate in a second rotation direction to be separated from the rotary ring member.

When the operating lever is pressed in a state in which the first and second doors are closed, the second hook member may rotate in the second rotation direction to be separated from the rotation ring member and the first hook member may rotate in the first rotation direction to be coupled with the main ring unit.

When the operating lever is pressed in a state in which the first door is open and the second door is closed, the rotary ring member may rotate in the first rotation direction in a state in which the rotary ring member is coupled with the second hook member which rotates in the second rotation direction.

The elastic force of the second elastic member may be greater than a sum of the elastic force of the first elastic member and the elastic force of the third elastic member.

The operating lever may include a lever body having a grip portion and a pressing portion extending from one end of the grip portion, and a lever case in which the lever body is rotatably installed. When the grip portion is pressed, the lever body rotates to allow the pressing portion to press the second hook member.

The home appliance may further include a door handle installed in the second door. The operating lever may be installed in the door handle.

The first locking unit may include a first holder installed in the first door and having first and second coupling holes formed on an inner side and first and second engagement protrusions respectively disposed in the first and second coupling holes. The main ring unit may include a body installed in the main body, and a first ring member rotatably installed in the body and rotating in the first rotation direction to be coupled with the first engagement protrusion and rotating in the second rotation direction to be separated from the first engagement protrusion. The second locking unit may include a second holder installed in the second door, and a second ring member rotatably installed in the second holder and rotating in a third rotation direction to be coupled with the second engagement protrusion and rotating in a fourth rotation direction to be separated from the second engagement protrusion. The dual opening preventing member may be interfered with the second ring member to block rotation of the second ring member in the fourth rotation direction in a state in which the first and second doors are closed.

When the dual opening preventing member is pressed by the operating lever in a state in which the first and second doors are closed, the dual opening preventing member is released from interference with the second ring member and is interfered with the first ring member to block rotation of the first ring member in the second rotation direction.

When the first door is opened, the dual opening preventing member may block an operation of the operating lever.

In accordance with another aspect of the disclosure, a locking device for a home appliance, the locking device being installed in the home appliance that includes a main body, a first door rotatably installed in the main body and including an opening, and a second door rotatably installed in the first door to open and close the opening, the second door being configured to fix or separate the first door to or from the main body or fix or separate the second door to or from the first door, is provided. The locking device includes a first locking unit installed in the first door and configured to selectively fix the first door to the main body, a second locking unit installed in the second door and selectively coupled to the first locking unit, an operating lever installed in the second door and configured to press the second locking unit to cause the second locking unit to be separated from the first door, and a dual opening preventing member configured to maintain a state in which the second door is coupled to the first door, when the operating lever is pressed in a state in which the first door is open.

In accordance with another aspect of the disclosure, a locking device for a home appliance, the locking device being installed in the home appliance that includes a main body, a first door rotatably installed in the main body and including an opening, and a second door rotatably installed in the first door to open and close the opening, the second door being configured to fix or separate the first door to or from the main body or fix or separate the second door to or from the first door is provided. The locking device includes a main ring unit installed in the main body and allowing the first door to be selectively coupled to the main ring unit, wherein the main ring unit includes a body provided in the main body, a main ring selectively coupled with the first locking unit provided in the first door, and a pair of pressing members installed below the main ring and installed to be movable up and down with respect to the body.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWING(S)

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
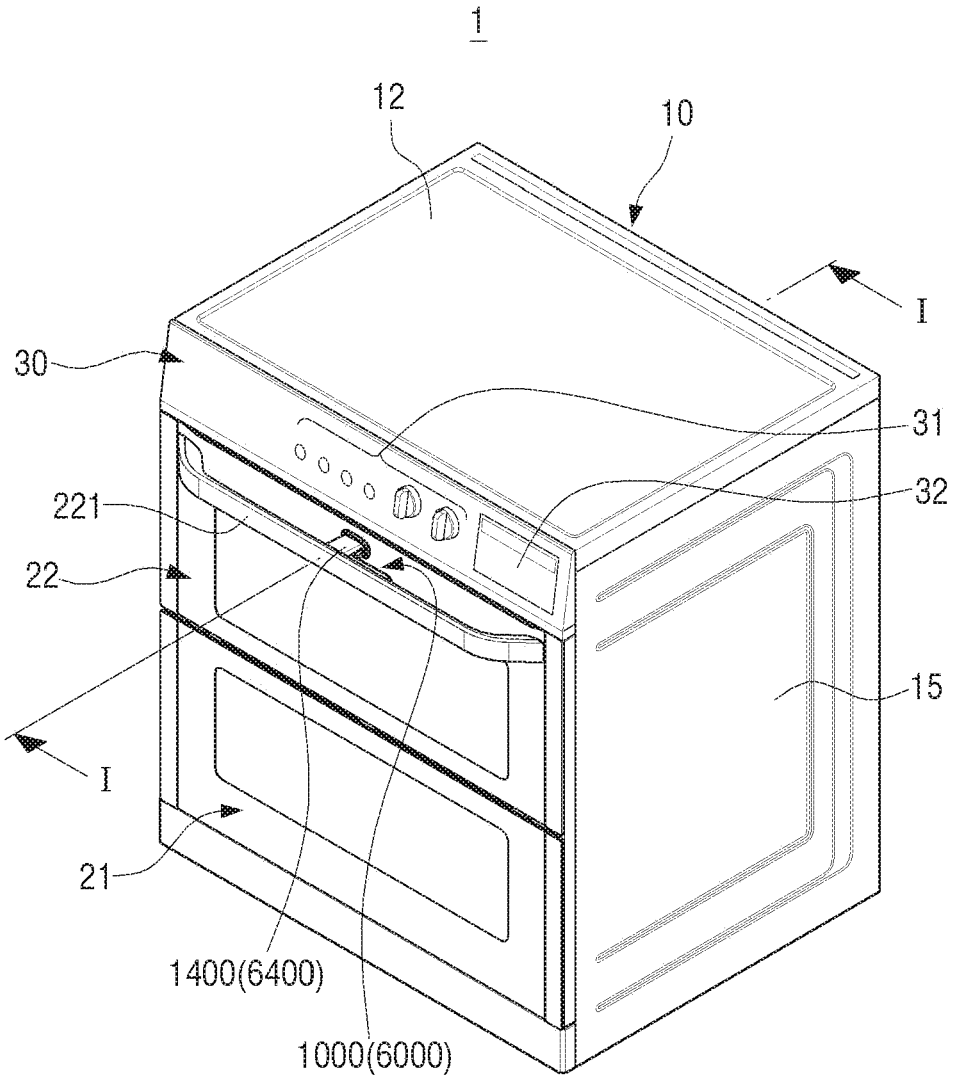
FIG. 1 is a perspective view illustrating an oven as an example of a home appliance according to an embodiment of the disclosure.
Figure 2:
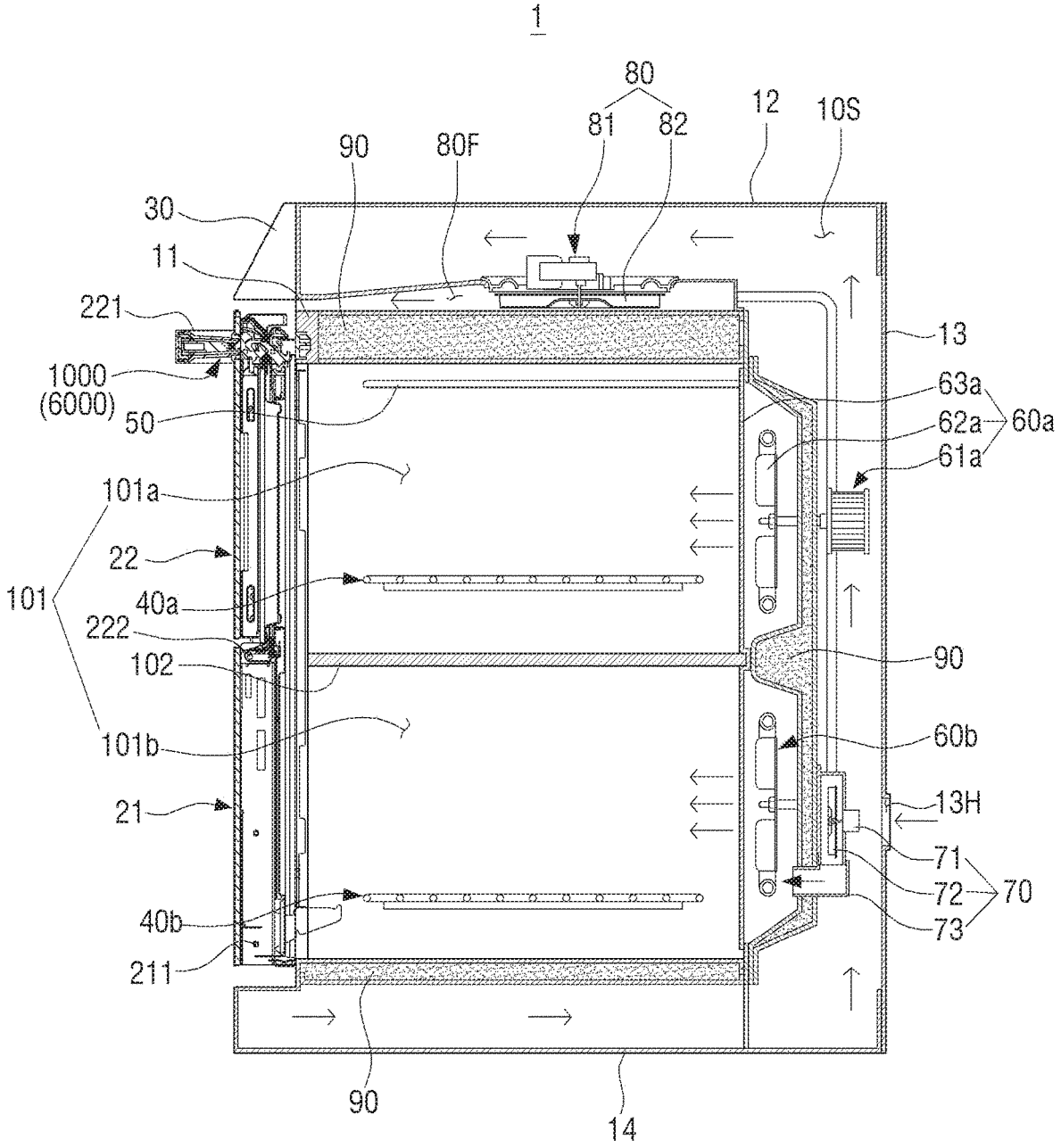
FIG. 2 is a cross-sectional view of the oven illustrated in FIG. 1, taken along line "I-I" according to an embodiment of the disclosure.

FIG. 1 is a perspective view illustrating an oven 1 as an example of a home appliance according to an embodiment of the disclosure and FIG. 2 is a cross-sectional view illustrating the oven 1 of FIG. 1, taken along line "I-I".

The oven 1 to which the disclosure is applicable is illustrated as an example of the home appliance illustrated in FIG. 1. However, the disclosure described below may be applied to various home appliances such as a dishwasher, a refrigerator, a washing machine, and the like, having double doors.

Hereinafter, a structure of the oven 1 will be described as an example of the home appliance according to the embodiment of the disclosure.

Referring to FIGS. 1 and 2, the oven 1 includes a main body 10 forming an appearance and a first door 21 and a second door 22 coupled to the main body 10.

A control panel 30 is disposed in an upper portion of the main body 10.

The control panel 30 includes an operating part 31 for operating the oven 1 and a display unit 32 displaying operation information of the oven 1.

In addition, a controller (not shown) controlling the oven 1 may be disposed inside the control panel 30.

The oven 1 has an accommodation space open toward one side. The accommodation space of the main body 10 may be a cooking chamber 101 in which food is cooked and the cooking chamber 101 may be open toward the front of the oven 1.

The main body 10 includes a front panel 11 forming a front appearance, a top panel 12 forming an upper appearance, a rear panel 13 forming a rear appearance, a bottom panel 14 forming a bottom surface, and a side panel 15 forming a side appearance.

The main body 10 may be configured by combining the front panel 11, the top panel 12, the rear panel 13, the bottom panel 14, and the side panel 15 described above, and the front panel, the top panel 12, the rear panel 13, the bottom panel 14, and the side panel 15 may integrally configure the main body 10.

The cooking chamber 101 has a box shape and a front surface thereof is open to allow food to be taken in and out. To this end, the front panel 11 has an opening connected to the cooking chamber 101.

The open front surface of the cooking chamber 101 may be opened and closed by the first door 21 rotatably connected to the main body 10.

The first door 21 has a size corresponding to a shape of the front surface of the cooking chamber 101 to open and close the entirety of the cooking chamber 101.

A lower end of the first door 21 may be rotatably connected to a lower end of the front panel 11, and here, the lower end of the first door 21 may be rotatably connected to a first hinge shaft 211 disposed on the lower end of the front panel 11.

The first hinge shaft 211 may be disposed in parallel with the bottom surface of the main body 10, through which the first door 21 may rotate about the first hinge shaft 211 in a vertical direction to open and close first and second cooking chambers 101*a* and 101*b*.

The first door 21 has an opening 21S (See FIG. 3B) connected to the cooking chamber 101 and the second door 22 is rotatably coupled to the first door 21 to open and close the opening 21S of the first door 21.

At least one divider 102 may be disposed inside the cooking chamber 101.

The at least one divider 102 may be in the form of a plate disposed to be horizontal with the bottom surface of the cooking chamber 101, and the cooking chamber 101 may be divided into a plurality of cooking chambers by the divider 102.

As illustrated in FIG. 2, the at least one divider 102 is mounted to be horizontal with the bottom surface of the cooking chamber 101, and divides the cooking chamber 101 into the first cooking chamber 101*a* and the second cooking chamber 101*b*.

The first cooking chamber 101*a* may be positioned above the at least one divider 102 and the second cooking chamber 101*b* may be positioned below the divider 102.

The first and second cooking chambers 101*a* and 101*b* may be the same or different in size depending on the position of the divider 102. A plurality of dividers, similar to the at least one divider 102, may be disposed in the cooking chamber to divide the cooking chamber 101 into three or more cooking chambers.

In addition, the cooking chamber 101 may be formed as a single cooking chamber 101 without the divider 102.

As described above, the first door 21 includes the opening 21S connected to the cooking chamber 101.

The opening 21S may be connected to a cooking chamber having a higher frequency of use among the first cooking chamber 101*a* and the second cooking chamber 101*b*.

Specifically, the opening 21S of the first door 21 may be open to be connected to the first cooking chamber 101*a* and the second door 22 may be rotatably coupled to the first door 21 to open and close the opening 21S of the first door 21.

Specifically, the lower end of the second door 22 may be coupled to rotate about a second hinge shaft 222 disposed at the lower end of the opening 21S.

The second hinge shaft 222 may be disposed parallel to the first hinge shaft 211, whereby the second door 22 rotates about the second hinge shaft 222 in the vertical direction to open or close the opening 21S. That is, the second door 22 may be rotatably coupled to the first door 21 to open or close the first cooking chamber 101*a*.

Further, a door handle 221 is coupled to an upper side of the second door 22.

The door handle 221 may be coupled to the front of the second door 22 and a grip space may be formed between the door handle 221 and the second door 22 to allow a user to easily grip the door handle 221.

Accordingly, the user puts his hand into the grip space to grip the door handle 221, and in this state, the user may pull the door handle 221 forwards to open the first door 21 and the second door 22.

In addition to the shapes illustrated in FIGS. 1 and 2, the door handle 221 may be modified to various structures capable of transferring a force to the second door 22 in a direction in which the second door 22 is opened or closed.

In FIG. 2, a structure in which the first hinge shaft 211 and the second hinge shaft 222 are disposed in parallel to the bottom surface of the main body 10, that is, the bottom panel 14 of the main body 10, whereby the first and second doors 21 and 22 rotate in the vertical direction to be open or closed is illustrated as an example, but a structure in which the first and second hinge shafts 211 and 222 are disposed in the vertical direction with respect to the bottom panel 14, whereby the first and second doors 21 and 22 rotate in a horizontal direction to be opened or closed may also be possible.

Also, the oven 1 includes a locking device 1000 for fixing or separating the second door 22 to or from the first door 21 to allow the first door 21 and the second door 22 to selectively rotate.

A structure of the locking device 1000 and a dual opening preventing structure of the first and second doors 21 and 22 through the locking device 1000 will be described later.

At least a portion of the first and second doors 21 and 22 may be formed of a transparent material such as glass, and thus, a cooking process inside the cooking chamber 101 may be checked from the outside.

At least one rack for supporting food is disposed inside the cooking chamber 101.

Specifically, a first rack 40*a* is disposed in the first cooking chamber 101*a*, and a second rack 40*b* is disposed in the second cooking chamber 101*b*.

The first and second racks 40*a* and 40*b* may have a grill structure and may be disposed horizontal with the bottom surface of the cooking chamber 101 so that food may be placed thereon.

A heater 50 for heating air inside the cooking chamber 101 is disposed in the cooking chamber 101.

The heater 50 may be configured as an electric heater or a gas heater according to heating methods.

As illustrated in FIG. 2, the heater 50 may be provided on an upper side of the first cooking chamber 101*a*. However, the disclosure is not limited thereto, and a plurality of heaters 50 may be provided in each of the first and second cooking chambers 101*a* and 101*b*.

First and second circulation units 60*a* and 60*b* for circulating air in the first and second cooking chambers 101*a* and 101*b* are disposed on the rear surfaces of the first and second cooking chambers 101*a* and 101*b*, respectively.

The first circulation unit 60*a* includes a first circulation fan 61*a*, a first circulation motor 62*a* coupled to the first circulation fan 61*a* and rotating the first circulation fan 61*a*, and a first circulation fan cover 63*a* disposed between a rear surface of the first cooking chamber 101*a* and the first circulation fan 61*a*.

The first circulating fan cover 63*a* includes a plurality of through holes allowing air to pass therethrough.

As the first circulation motor 62*a* rotates, the first circulation fan 61*a* rotates, and air in the first cooking chamber 101*a* is convected according to rotation of the first circulation fan 61*a*. Accordingly, air in the first cooking chamber 101*a* may be uniformly heated.

The second circulation unit 60*b* may be disposed on the rear of the second cooking chamber 101*b* to circulate the air inside the second cooking chamber 101*b*. The second circulation unit 60*b* also includes a second circulation fan, a second circulation motor, and a second circulation fan cover. A structure of the second circulation unit 60*b* is the same as that of the first circulation unit 60*a*, and thus, a description of the same components will be omitted.

At least one inlet hole 13H allowing air outside the main body 10 to be introduced to the cooking chamber 101 is provided on the rear panel 13.

As illustrated in FIG. 2, the at least one inlet hole 13H may be formed in the vicinity of the second cooking chamber 101*b* to allow ambient air to flow into the second cooking chamber 101*b*.

An intake unit 70 may be disposed adjacent to the at least one inlet hole 13H in the main body 10.

The intake unit 70 includes a suction motor 71, a suction fan 72 coupled to the suction motor 71, and a guide bracket 73.

The suction motor 71 having the suction fan 72 coupled thereto is disposed in the vicinity of the at least one inlet hole 13H and a guide bracket 73 forms a flow path connecting the suction fan 72 and the second cooking chamber 101*b*.

Ambient air is introduced to the at least one inlet hole 13H as the suction fan 72 rotates according to the operation of the suction motor 71, and the air introduced to the at least one inlet hole 13H may be easily introduced to the second cooking chamber 101*b* through the guide bracket 73.

Thus, a temperature inside the second cooking chamber 101*b* may be lowered.

Also, the guide bracket 73 is connected to the second circulation unit 60*b* to introduce ambient air to the inside of the second cooking chamber 101*b* through the second circulation fan cover of the second circulation unit 60*b*.

In addition, the intake unit 70 may be connected to the first cooking chamber 101*a* and allow ambient air to be introduced to the first cooking chamber 101*a* therethrough to lower a temperature inside the first cooking chamber 101*a*.

A discharge pipe (not shown) and a discharge hole (not shown) may be provided in the rear panel 13 and air corresponding to the amount of the ambient air introduced to the cooking chamber 101 may be discharged from the cooking chamber 101 through the discharge pipe and the discharge hole.

An electric part compartment 10S in which various electric component (not shown) such as a circuit board, and the like, are disposed is provided above the first cooking chamber 101*a*.

The electric part compartment 10S may be formed as a space surrounding the upper portion, the rear portion, and the lower portion of the cooking chamber 101. The control panel 30 described above may be coupled to the front of the electric part compartment 10S.

In addition, a cooling unit 80 for cooling the inside of the electric part compartment 10S is disposed in the electric part compartment 10S.

The cooling unit 80 includes a cooling motor 81 and a cooling fan 82 rotatably coupled to the cooling motor 81.

Specifically, a front flow path 80F open to the front side of the main body 10 may be provided between the electric part compartment 10S and the first cooking chamber 101*a*, and the cooling unit 80 may be disposed between the electric part compartment 10S and the front flow path 80F to discharge air inside the electric part compartment 10S to the front flow path 80F.

Thus, high temperature air inside the electric part compartment 10S may be discharged to the outside through the front flow path 80F, and the temperature of the electric part compartment 10S may be lowered through the front flow path 80F.

At least one heat insulating member 90 is disposed between the cooking chamber 101 and the electric part compartment 10S.

As illustrated in FIG. 2, the at least one heat insulating member 90 may be provided in plurality, and the plurality of heat insulating members may be disposed on an upper side of the first cooking chamber 101*a*, a rear side of the first and second cooking chambers 101*a* and 101*b*, and a lower side of the second cooking chamber 101*b*, respectively.

The structure of the oven 1 having the control panel 30, the first and second racks 40*a* and 40*b*, the heater 50, the first and second circulation units 60*a* and 60*b*, the intake unit 70, the cooling unit 80, and the at least one heat insulating member 90 is similar to or the same as those of the related art oven, and thus, a detailed description thereof will be omitted.

Figure 3A:
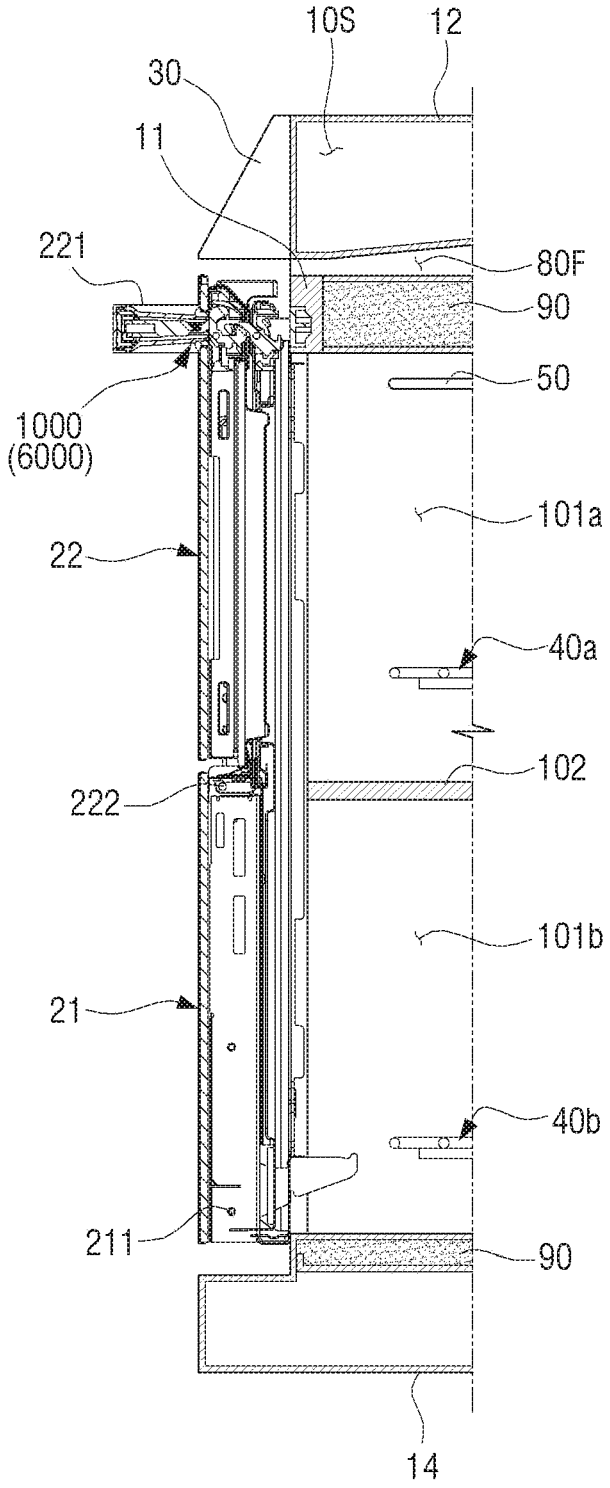
FIG. 3A is an enlarged view of a state in which first and second doors of the oven illustrated in FIG. 2 are closed according to an embodiment of the disclosure.

FIG. 3A is an enlarged view of a state in which the first and second doors 21 and 22 of the oven 1 illustrated in FIG. 2 are closed.

Referring to FIG. 3A, when the first and second doors 21 and 22 are closed, the first and second cooking chambers 101*a* and 101*b* are closed.

By operating the heater 50 in a state in which the first and second cooking chambers 101*a* and 101*b* are closed, food placed on the first and second racks 40*a* and 40*b* may be heated.

During the operation of the oven 1, the first and second doors 21 and 22 may be fixed through a separate fixing device (not shown), and thus, the first and second doors 21 and 22 may not be open.

A first sealing member may be provided between the front panel 11 and the first door 21 to seal a gap between the first door 21 and the cooking chamber 101 in a state in which the first door 21 is closed, and a second sealing member (not shown) may be disposed between the first door 21 and the second door 22 to seal a gap between the second door 22 and the opening 21S in a state in which the second door 22 is closed.

Figure 3B:
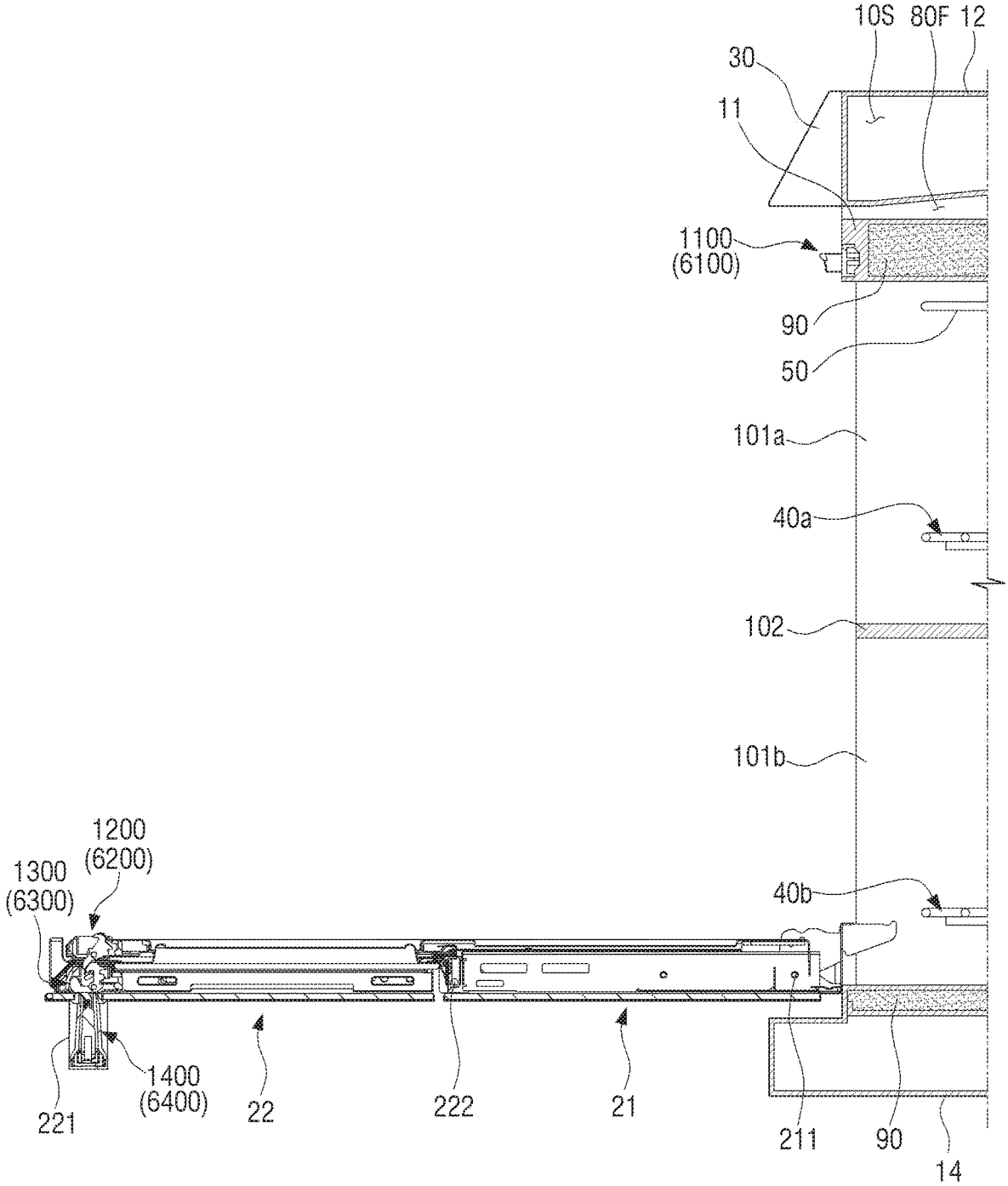
FIG. 3B is a view illustrating a state in which the first door of the oven illustrated in FIG. 3A is open according to an embodiment of the disclosure.

FIG. 3B is a view illustrating a state in which the first door 21 of the oven 1 illustrated in FIG. 3A is open.

The user may open the first door 21 by pulling the door handle 221 coupled to the second door 22 toward the front of the main body 10.

The first door 21 is open as it rotates about the first hinge shaft 211 from top to bottom.

Accordingly, the first and second cooking chambers 101*a* and 101*b* may be open and food may be introduced to the inside of the first and second cooking chambers 101*a* and 101*b* and cooked, or cooling-finished food may be taken out from the first and second cooking chambers 101*a* and 101*b*.

Referring to FIG. 3B, as the first door 21 is open, a main ring unit 1100 (See FIG. 4) of the locking device 1000 and a first locking unit 1200 (See FIG. 4) are separated, and the locking device 1000 connect the first door 21 and the second door 22 to prevent the second door 22 from being separated from the first door 21 when the first door 21 is open.

The locking device 1000 includes a dual opening preventing member for maintaining a fixed state of the second door 22 so that the second door 22 may not be opened although an operating lever 1400 is pressed in a state in which the first door 21 is open.

Figure 3C:
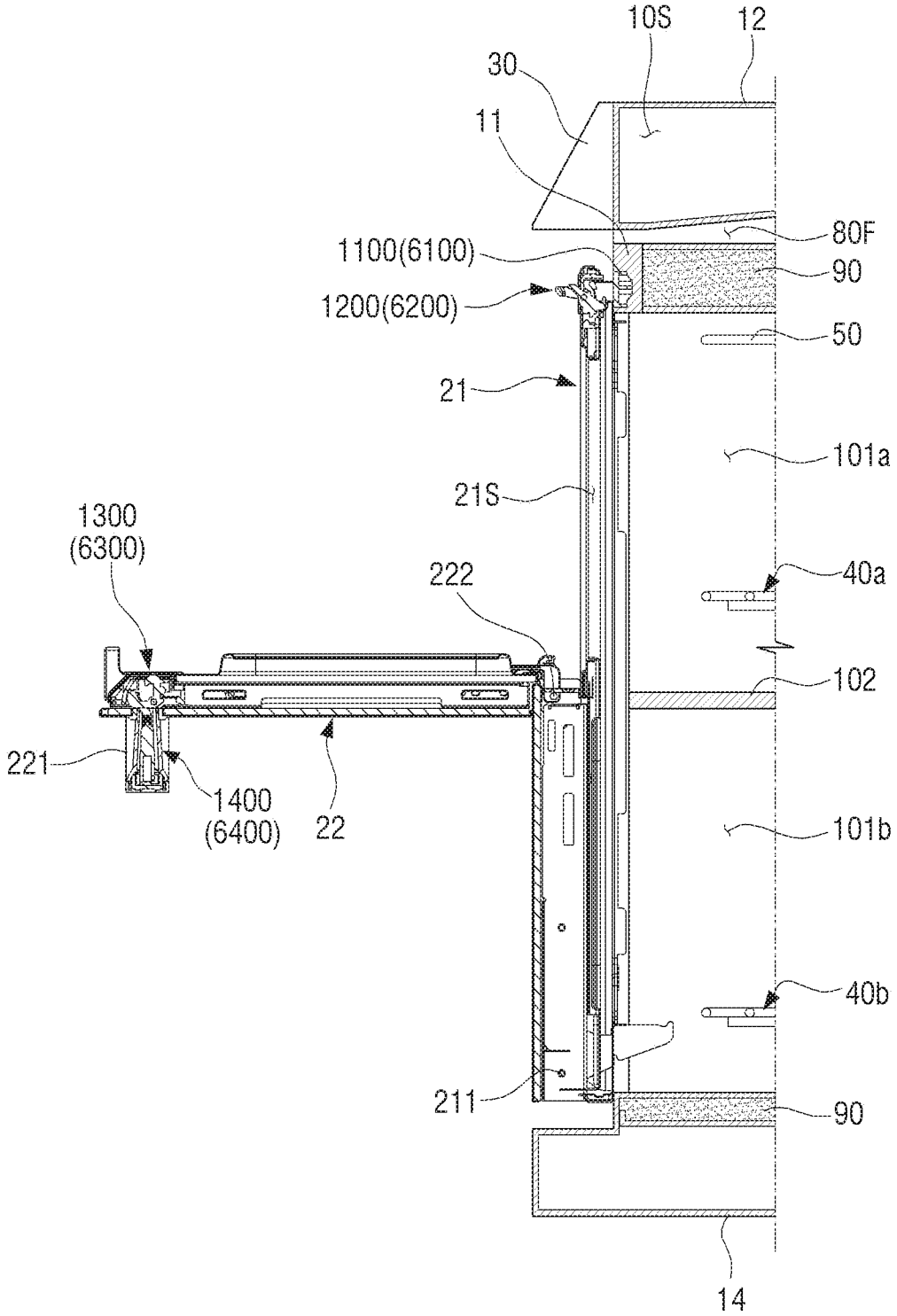
FIG. 3C is a view illustrating a state in which the second door of the oven illustrated in FIG. 3A is open according to an embodiment of the disclosure.

FIG. 3C is a view illustrating a state in which the second door 22 of the oven 1 illustrated in FIG. 3A is open.

Referring to FIG. 3C, the user may open the second door 22 by pulling the door handle 221 forwards in a state in which the operating lever 1400 is pressed.

The operating lever 1400 may be coupled to the door handle 221, whereby the user may pull the door handle 221 forwards, in a state of pressing the operating lever 1400.

When the operating lever 1400 is pressed, the second door 22 is separated from the first door 21 and is rotatable about the second hinge shaft 222. In this state, the door handle 221 may be pulled forwards and the second door 22 may be opened.

When the operating lever 1400 is pressed, the locking device 1000 couples the first door 21 to the main ring unit 1100 coupled to the main body 10, thereby preventing the first door 21 from being opened together when the second door 22 is opened.

A specific structure of the locking device 1000 and a structure in which the first and second doors 21 and 22 are opened and closed through the locking device 1000 will be described in detail below.

Figure 4:
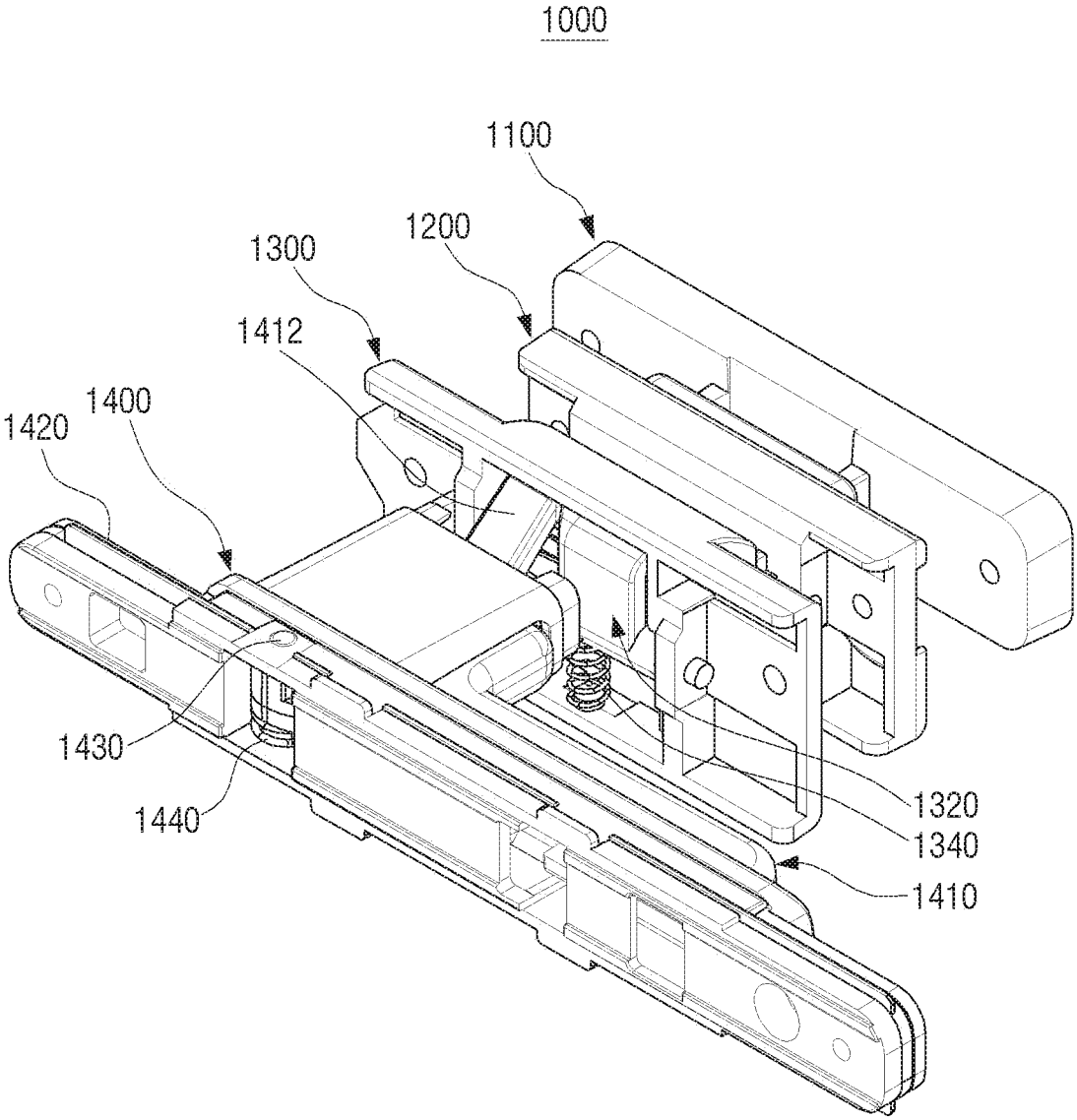
FIG. 4 is a perspective view of a locking device illustrated in FIG. 1 according to an embodiment of the disclosure.
Figure 5:
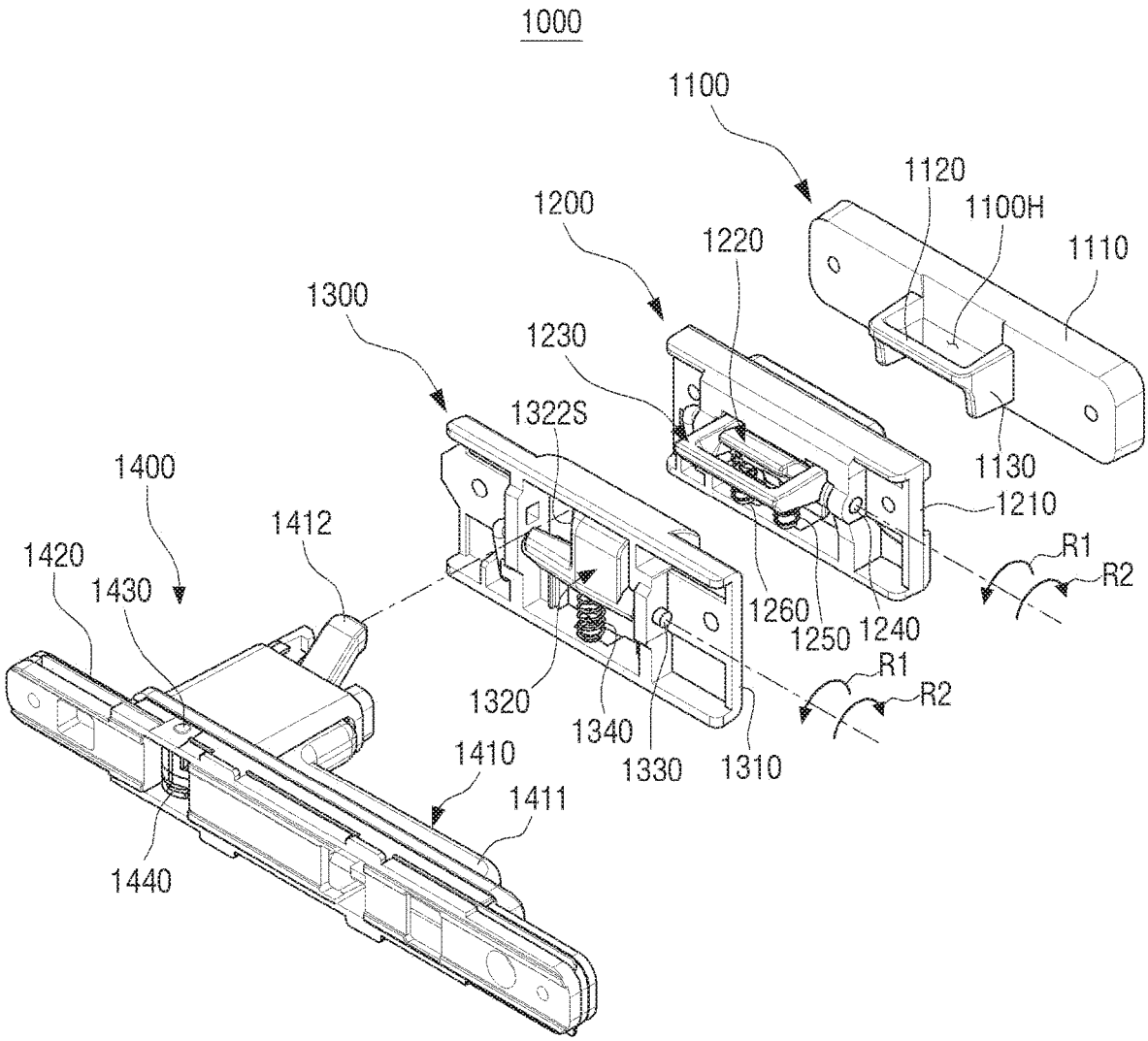
FIGS. 5 and 6 are exploded perspective views of the locking device illustrated in FIG. 4 according to an embodiment of the disclosure.
Figure 6:
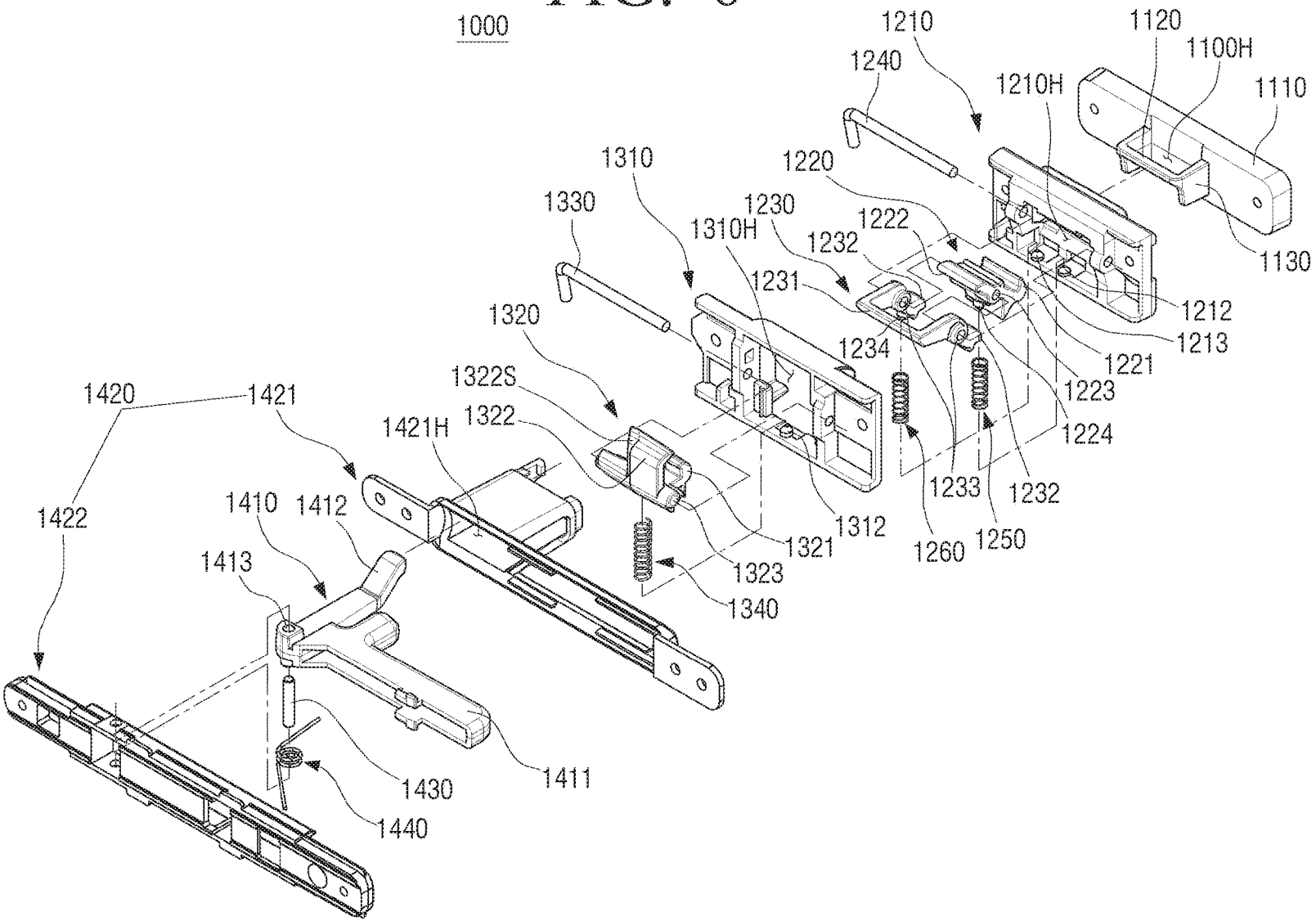

FIG. 4 is a perspective view of the locking device 1000 illustrated in FIG. 1, and FIGS. 5 and 6 are exploded perspective views of the locking device 1000 illustrated in FIG. 4.

Hereinafter, a structure of the locking device 1000 will be described in detail with reference to FIGS. 4, 5 and 6.

Referring to FIGS. 4, 5, and 6, locking device 1000 includes the main ring unit 1100 coupled to the main body 10, the first locking unit 1200 coupled to the first door 21 and selectively coupled to the main ring unit 1100, a second locking unit 1300 coupled to the second door 22 and selectively coupled to the first locking unit 1200, and the operating lever 1400 separating the second door 22 from the first door 21 when pressed.

The operating lever 1400 may be coupled to the door handle 221 and, when pressed, the operating lever separates the first locking unit 1200 and the second locking unit 1300 to separate the first door 21 and the second door 22.

The main ring unit 1100 is coupled to the front panel 11.

The main ring unit 1100 includes a body 1110 coupled to the front panel 11 and a main ring 1120 coupled to the body 1110 and protruding forwards.

A coupling hole 1100H may be formed between the body 1110 and the main ring 1120.

In addition, a pair of support members 1130 protruding forwards from the body 1110 may be disposed on both sides of the main ring 1120.

The first locking unit 1200 includes a first holder 1210 coupled to the first door 21, a first hook member 1220 rotatably coupled to the first holder 1210, a first rotary shaft 1240 coupled to the first holder 1210 and having the first hook member 1220 rotatably coupled thereto, and a first elastic member 1250 applying an elastic force to the first hook member 1220 to allow the first hook member 1220 to rotate in a first rotation direction R1 in which the first hook member 1220 and the main ring unit 1100 are coupled.

The first elastic member 1250 may be a compression spring.

The first holder 1210 includes a first opening 1210H, and the first hook member 1220 is rotatably coupled to the first opening 1210H.

The first rotary shaft 1240 is coupled to the first holder 1210 and inserted into the first hook member 1220 in a horizontal direction through the first opening 1210H. Accordingly, the first hook member 1220 is rotatable in the first opening 1210H.

The first hook member 1220 includes a hook-shaped first hook portion 1221 formed at one end and coupled to the main ring 1120 of the main ring unit 1100 and a first to-be-pressed portion 1222 formed at the other end opposing the first hook portion 1221. A first through hole 1223, into which the first rotary shaft 1240 is inserted is formed between the first hook portion 1221 and the first to-be-pressed portion 1222.

In addition, a first coupling protrusion 1224, to which one end of the first elastic member 1250 is coupled, is formed in a lower portion of the first hook portion 1221.

Also, a second coupling protrusion 1212, to which the other end of the first elastic member 1250 is coupled, is formed on an inner side of the first holder 1210.

The first hook member 1220 may rotate in the first rotation direction R1 upon receiving an elastic force from the first elastic member 1250, and as the first hook portion 1221 is inserted into the coupling hole 1100H of the main ring unit 1100 and engaged with the main ring 1120, the first hook member 1220 and the main ring unit 1100 may be coupled.

The second locking unit 1300 includes a second holder 1310 coupled to the second door 22, a second hook member 1320 rotatably coupled to the second holder 1310, and a second elastic member 1340 applying an elastic force to the second hook member 1320 so that the second hook member 1320 rotates in the first rotation direction R1.

The second elastic member 1340 may be a compression spring.

The second holder 1310 includes a second opening 1310H, and the second hook member 1320 is rotatably coupled to the second opening 1310H.

A second rotary shaft 1330 is coupled to the second holder 1310 and inserted into the second hook member 1320 in a horizontal direction through the second opening 1310H. Accordingly, the second hook member 1320 is rotatable on the second opening 1310H.

The second hook member 1320 includes a hook-shaped second hook portion 1321 formed at one end to support the first to-be-pressed portion 1222 of the first hook member 1220 and a second to-be-pressed portion 1322 formed the other end opposing the second hook portion 1321, and a second through hole 1323, into which the second rotary shaft 1330 is inserted, is formed between the second hook portion 1321 and the second to-be-pressed portion 1322.

Also, a third coupling protrusion 1324 (See FIG. 7), to which one end of the second elastic member 1340 is coupled, is formed on a lower side of the second hook portion 1321.

In addition, a fourth coupling protrusion 1312, to which the other end of the second elastic member 1340 is coupled, is formed on an inner side of the second holder 1310.

Accordingly, the second hook member 1320 may rotate in the first direction R1 upon receiving an elastic force from the second elastic member 1340, and may elastically support the first hook member 1220 so that the first hook member 1220 is separated from the main ring unit 1100 in a state in which the first and second doors 21 and 22 are closed.

To this end, the elastic force from the second elastic member 1340 is preferably greater than the elastic force from the first elastic member 1250.

Specifically, the second hook member 1320 may rotate in the first rotation direction R1 upon receiving the elastic force from the second elastic member 1340, and the second hook member 1321 presses the first to-be-pressed portion 1222 in the first rotation direction R1.

Accordingly, since the second hook portion 1321 presses the first hook member 1220 in a direction opposite to the elastic force from the first elastic member 1250, and thus, the first hook member 1220 does not rotate in the first rotation direction R1.

The first hook member 1220 may be elastically supported by the second hook member 1320, whereby the first hook member 1220 may be fixed in position in a state of having rotated at a predetermined angle in a second rotation direction R2 opposite to the first rotation direction R1.

As the first hook member 1220 is pressed by the second hook portion 1321, the first hook member 1220 may further include a separate stopper (not shown) interfered by the first holder 1210 so that the first hook member 1220 may be prevented from rotating at a predetermined angle or greater in the second rotation direction R2 opposite to the first rotation direction R1.

Elastically supporting the first hook member 1220 by the second hook member 1320 means that the second hook member 1320 supports the first hook member 1220 through the elastic force from the second elastic member 1340 so that the first hook member 1220, which is to rotate in the first rotation direction R1 by the first elastic member 1250, does not rotate in the first rotation direction R1 but maintained in position.

The second hook member 1320 which rotates in the first rotation direction R1 by the second elastic member 1340 to elastically support the first hook member 1220 also may further include a separate stopper (not shown) interfered by the second holder 1310 so as not to rotate in the first rotation direction R1 by a predetermined angle or greater.

In addition, the above-described dual opening preventing members may include a rotary ring member 1230 rotatably coupled to the first holder 1210 and a third elastic member 1260 applying an elastic force to the rotary ring member 1230 so that the rotary ring member 1230 may rotate in the first rotation direction R1 to be coupled with the rotary ring member 1230.

The third elastic member 1260 may be a compression spring.

When the operating lever 1400 is pressed in a state in which the first door 21 is open, the dual opening preventing members maintain the state in which the second door 22 is fixed to the first door 21, thereby preventing the second door 22 from being opened in the state in which the first door 21 is open.

The rotary ring member 1230 may be coupled to the first rotary shaft 1240 and may rotate coaxially with the first hook member 1220.

The rotary ring member 1230 includes a rotary ring portion 1231 formed at one end near the second hook portion 1321 and a pair of support protrusions 1232 formed at the other end opposite to the rotary ring portion 1231.

The pair of support protrusions 1232 protrude from both ends of the rotary ring portion 1231 and a pair of third through holes 1233 into which the first rotary shaft 1240 is inserted are formed between the pair of support protrusions 1232 and the rotary ring portion 1231.

The first hook member 1220 may be disposed between the pair of support protrusions 1232.

The rotary ring member 1230 includes a fifth coupling protrusion 1234 formed on at least one of the pair of support protrusions 1232.

The fifth coupling protrusion 1234 may protrude from a lower end of one of the pair of support protrusions 1232.

One end of the third elastic member 1260 is coupled to the fifth coupling protrusion 1234.

A sixth coupling protrusion 1213, to which the other end of the third elastic member 1260 is coupled, is formed on an inner side of the first holder 1210.

Therefore, the rotary ring member 1230 may rotate in the first rotation direction R1 upon receiving an elastic force from the third elastic member 1260, whereby as the rotary ring portion 1231 is engaged with the second hook portion 1321, the rotary ring member 1230 and the second hook member 1320 may be coupled.

In addition, in a state in which the first door 21 is closed, the pair of support protrusions 1232 of the rotary ring member 1230 are supported by the pair of support members 1130 of the main ring unit 1100 so that the rotary ring member 1230 is prevented from rotating in the first rotation direction R1.

When supporting by the pair of support members 1130 is released as the first door 21 is opened, the rotary ring member 1230 is elastically supported by the second hook member 1320.

Here, elastically supporting the rotary ring member 1230 by the second hook member 1320 means that the second hook member 1320 supports the rotary ring member 1230 through an elastic force from the second elastic member 1340 so that the rotary ring member 1230, which is to rotate in the first rotation direction R1 by the third elastic member 1260, does not rotate in the first rotation direction R1 and maintained in position.

To this end, the elastic force from the second elastic member 1340 is preferably greater than the elastic force from the third elastic member 1260.

The elastic force from the second elastic member 1340 may be set to be greater than the sum of the elastic force from the first elastic member 1250 and the elastic force from the third elastic member 1260 so that the second hook member 1320 elastically supports the first hook member 1220 and the rotary ring member 1230 together.

The operating lever 1400 is coupled to the door handle 221 and is operable by pressure to separate the second door 22 from the first door 21.

When pressed by the operating lever 1400, the second hook member 1320 may rotate in the second rotation direction R2 in which the second hook member 1320 is separated from the rotary ring member 1230.

The operating lever 1400 includes a lever body 1410, a lever case 1420 to which a lever body 1410 is rotatably coupled, a lever shaft 1430 inserted into the lever body 1410, and a lever elastic member 1440 applying an elastic force to the lever body 1410.

The lever body 1410 includes a grip portion 1411 the user may grip and a pressing portion 1412 coupled to one end of the grip portion 1411.

The pressing portion 1412 protrudes toward the second hook member 1320 and is in contact with the second to-be-pressed portion 1322 of the second hook member 1320.

A lever shaft hole 1413 through which the lever shaft 1430 is inserted is formed between the grip portion 1411 and the pressing portion 1412.

The lever shaft hole 1413 penetrates through the lever body 1410 in a vertical direction, whereby the lever body 1410 may rotate in a horizontal direction with respect to the lever shaft 1430.

Thus, when the grip portion 1411 is pressed, the lever body 1410 rotates about the lever shaft 1430 so that the pressing portion 1412 presses the second to-be-pressed portion 1322.

The lever case 1420 includes a first case 1421 and a second case 1422.

The first case 1421 includes a through portion 1421H through which the pressing portion 1412 passes, and the lever shaft 1430 is coupled to the second case 1422.

The lever elastic member 1440 applies an elastic force to the lever body 1410 so that the lever body 1410 may rotate in a direction opposite to the direction in which the second to-be-pressed portion 1322 is pressed.

The lever elastic member 1440 may be a torsion spring.

Thus, the user may rotate the lever body 1410 such that the pressing portion 1412 presses the second hook member 1320 by pressing the grip portion 1411 with a force greater than the elastic force from the lever elastic member 1440.

The second to-be-pressed portion 1322 pressed by the pressing portion 1412 includes a sliding surface 1322S in contact with the pressing portion 1412.

When the lever body 1410 rotates as the grip portion 1411 is pressed, the sliding surface 1322S is pressed by the pressing portion 1412 and the second hook member 1320 rotates in the second rotation direction R2.

When the grip portion 1411 of the operating lever 1400 is pressed in a state in which the first and second doors 21 and 22 are closed, the second hook member 1320 rotates in the second rotation direction R2 and may be separated from the rotary ring member 1230.

However, the structure in which the second hook member 1320 rotates in the second rotation direction R2 through an operation of the operating lever 1400 may be modified into various structures in addition to the above-described structure.

As illustrated in FIG. 1, the operating lever 1400 may be coupled to the door handle 221.

The user may open the second door 22 by pulling the door handle 221 in a state in which the user presses the grip portion 1411.

The operating lever 1400 may be coupled to one side of the door handle 221 facing the front surface of the second door 22 to face the front surface of the second door 22.

Accordingly, the user may pull the first and second doors 21 and 22 in an opening direction through the door handle, simultaneously when the user presses the grip portion 1411 of the operating lever 1400.

The operating lever 1400 may be disposed on the control panel 30, or the like, rather than being coupled to the door handle 221. In this case, the user may open the second door 22 by pulling the door handle 221 in a state of pressing the grip portion 1411 of the operating lever 1400.

Figure 7:
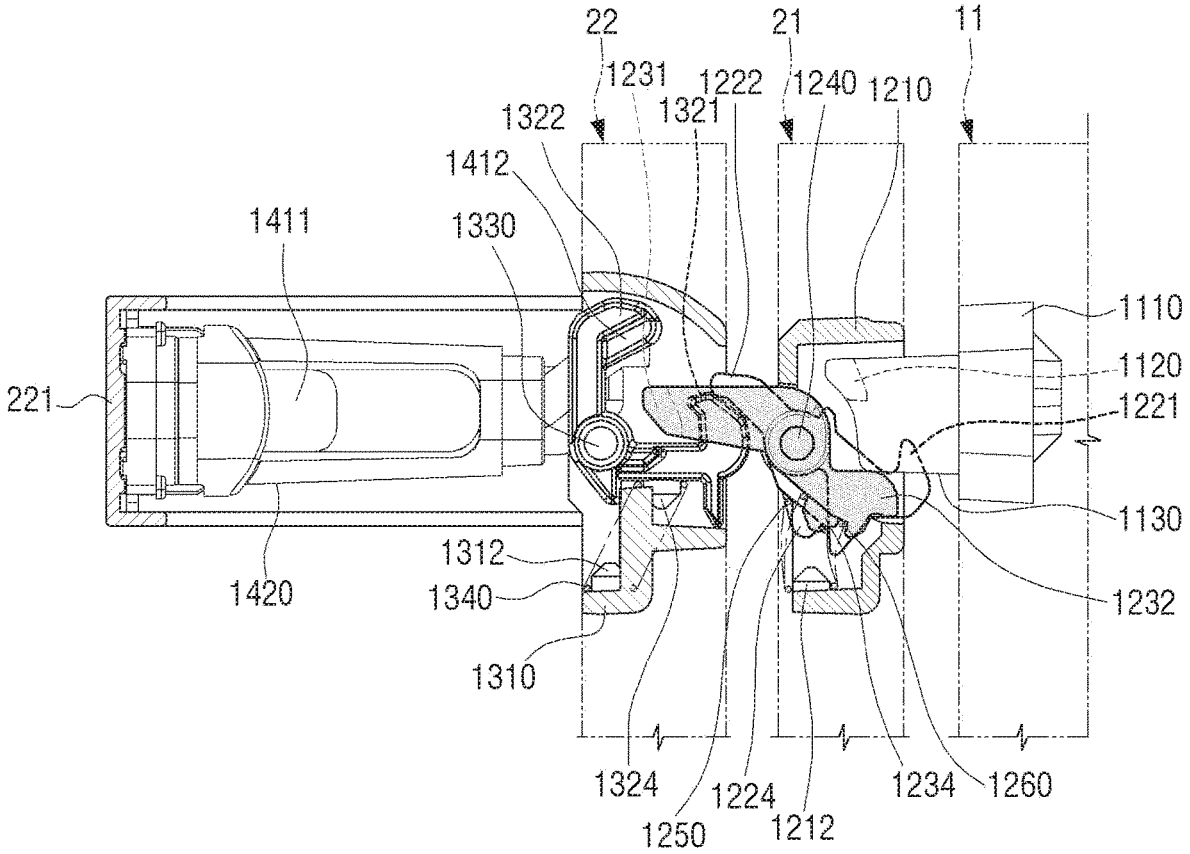
FIG. 7 is a view illustrating a locking device in a state in which first and second doors are closed according to an embodiment of the disclosure.

FIG. 7 is a view illustrating the locking device 1000 in a state in which the first and second doors 21 and 22 are closed.

Referring to FIG. 7, in a state in which the first and second doors 21 and 22 are closed, the rotary ring member 1230 is maintained in position as the pair of support members 1130 are supported by the pair of support members 1130 of the main ring unit 1100.

The second hook member 1320 presses the first to-be-pressed portion 1222 through the second hook portion 1321 so that the first hook member 1220 is not coupled to the main ring 1120, thereby elastically supporting the first hook member 1220.

Also, the second hook member 1320 maintains a state of being coupled to the rotary ring portion 1231 of the rotary ring member 1230.

Accordingly, in a state in which the first and second doors 21 and 22 are closed, the first door 21 and the second door 22 are coupled to each other to prevent the second door 22 from rotating, and the first door 21 is rotatable from the main body 10.

Figure 8A:
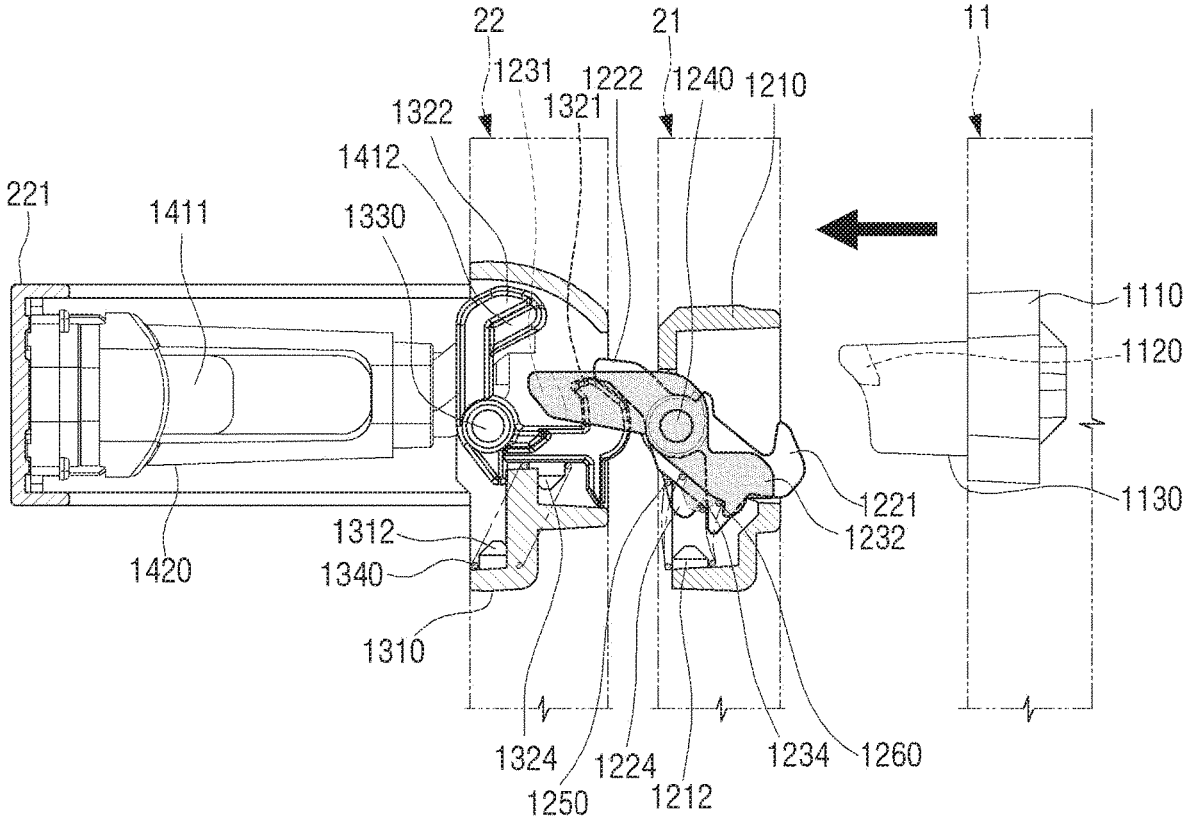
FIG. 8A is a view illustrating a locking device in a state in which a first door is open according to an embodiment of the disclosure.

FIG. 8A is a view illustrating the locking device 1000 in a state in which the first door 21 is open.

As described above, in a state in which the first and second doors 21 and 22 are closed, the first hook member 1220 is not coupled with the main ring unit 1100 and the second hook member 1320 and the rotary ring member 1230 are coupled.

Thus, when the user pulls the door handle 221, in a state in which the second door 22 is closed, the first door 21 rotates about the first hinge shaft 211 and is opened.

Referring to FIG. 8A, when the first door 21 is open, the pair of support protrusions 1232 of the rotary ring member 1230 are released from the pair of support members 1130 of the main ring unit 1100. Accordingly, the rotary ring member 1230 is elastically supported by the second hook member 1320 in a state of being coupled with the second hook member 1320.

Figure 8B:
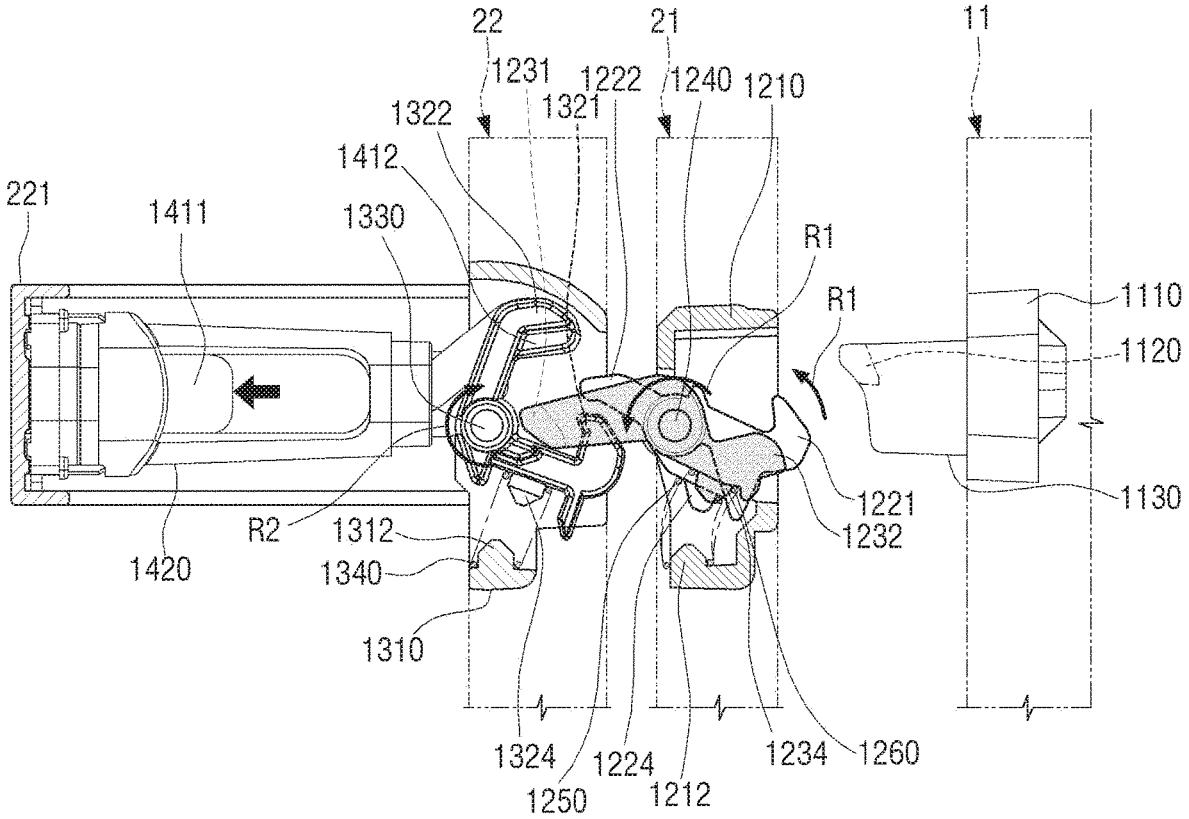
FIG. 8B is a view illustrating an operation of a locking device when an operating lever is pressed in a state in which a first door is open according to an embodiment of the disclosure.

FIG. 8B is a view illustrating an operation of the locking device 1000 when the operating lever 1400 is pressed in a state in which the first door 21 is open.

Referring to FIG. 8B, when the grip portion 1411 is pressed in a state in which the first door 21 is open, the lever body 1410 rotates and the pressing portion 1412 presses the second to-be-pressed portion 1322 of the second hook member 1320.

As the sliding surface 1322S of the second to-be-pressed portion 1322 is pressed by the pressing portion 1412, the second hook member 1320 rotates in the second rotating direction R2.

As described above, in a state in which the first door 21 is open and the rotary ring member 130 is coupled with the second hook member 1320, the rotary ring member 130 is elastically supported by the second hook member 1320. Thus, when the second hook member 1320 rotates in the second rotation direction R2, the rotary ring member 1230 coupled with the second hook member 1320 rotates in the first rotation direction R1 by the third elastic member 1260.

Accordingly, the rotary ring member 1230 and the second hook member 1320 may be maintained in the coupled state.

Therefore, although the operating lever 1400 is pressed in a state in which the first door 21 is open, the second door 22 may be prevented from being opened, thus preventing the first and second doors 21 and 22 from being opened dually.

Figure 9A:
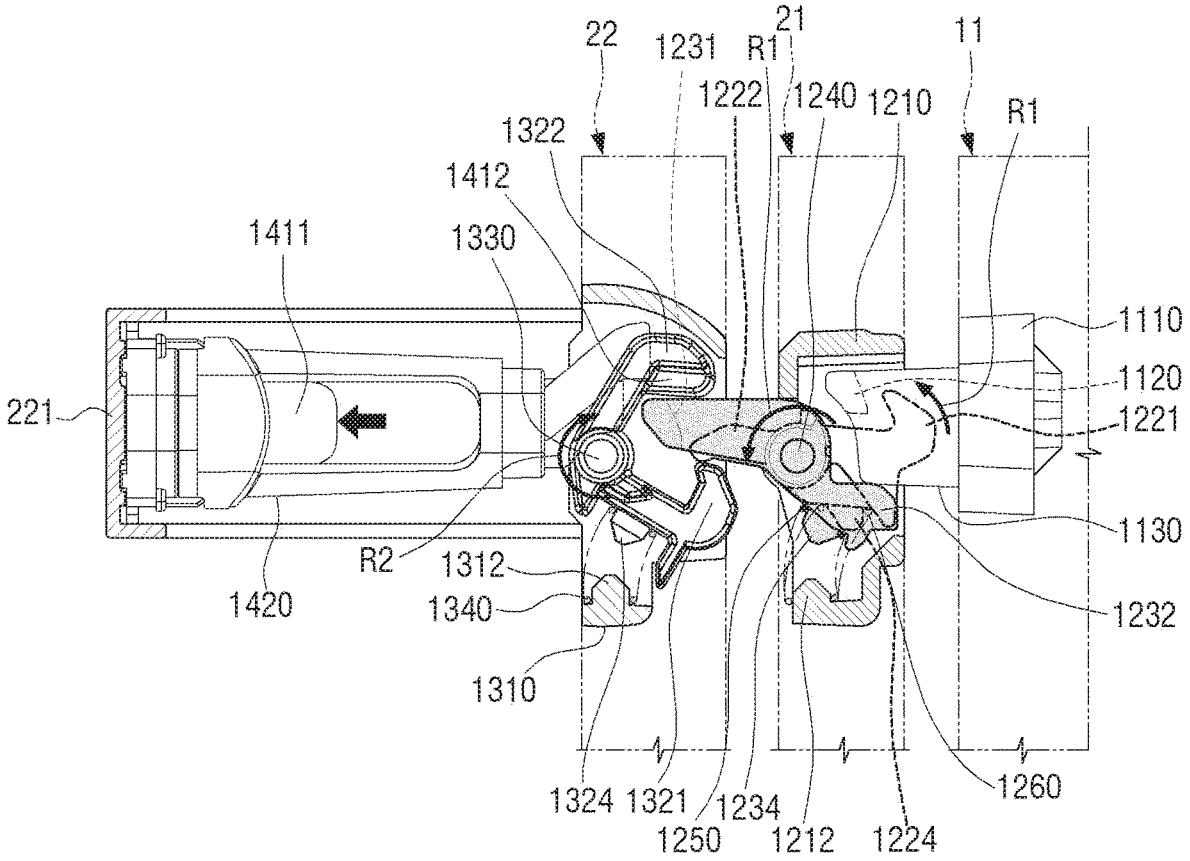
FIGS. 9A and 9B illustrate an operation of a locking device in the process of opening a second door according to various embodiment of the disclosure.
Figure 9B:
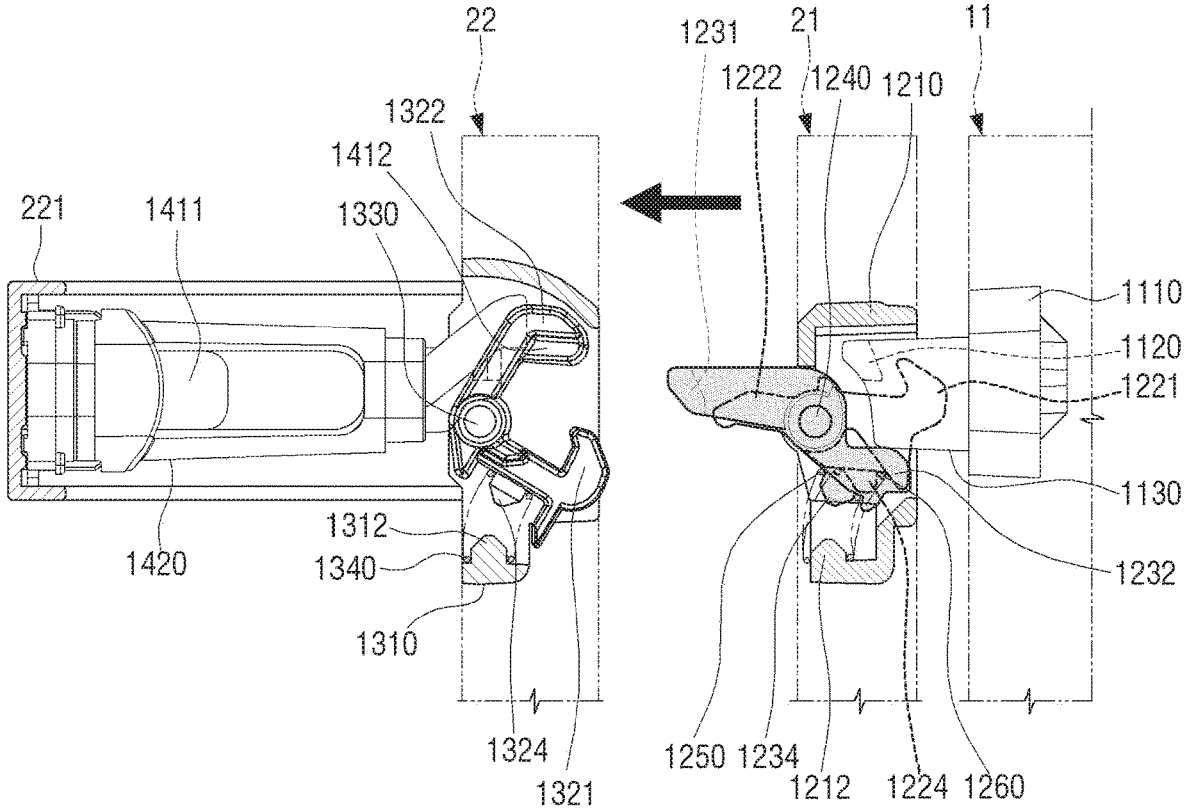

FIGS. 9A and 9B are views illustrating an operation of the locking device 1000 when the second door 22 is opened.

Referring to FIGS. 9A and 9B, when the grip portion 1411 of the operating lever 1400 is pressed in a state in which the first and second doors 21 and 22 are closed, the lever body 1410 rotates and the pressing portion 1412 presses the second to-be-pressed portion 1322 of the second hook member 1320.

As the sliding surface 1322S of the second to-be-pressed portion 1322 is pressed by the pressing portion 1412, the second hook member 1320 rotates in the second rotation direction R2.

In a state in which the first door 21 is closed, the rotary ring member 1230 is maintained in position as the pair of support protrusions 1232 are supported by the pair of support members 1130 of the main ring unit 1100.

Therefore, the second hook member 1320 may rotate in the second rotation direction R2 to be separated from the rotary ring member 1230.

As the second hook member 1320 rotates in the second rotation direction R2, the first hook member 1220, which is elastically supported by the second hook member 1320, rotates by the first elastic member 1250 in the first rotation direction R1.

Therefore, the first hook member 1220 is engaged with the main ring 1120 of the main ring unit 1100, thus being coupled to the main ring unit 1100.

Thereafter, as illustrated in FIG. 9B, when the door handle 221 is pulled in a state in which the grip portion 1411 is pressed, the second door 22 is separated from the first door 21 and rotate about the second hinge shaft 222 to be opened.

In addition, since the first door 21 is fixed to the main body 10 as the first hook member 1220 is coupled to the main ring unit 1100, the first door 21 is prevented from being opened when the second door 22 is opened.

The operating lever 1400 may selectively separate the second hook member 1320 from the rotary ring member 1230 according to the degree to which the grip portion 1411 is pressed.

For example, the second hook member 1320 may be set to maintain a state of being coupled with the rotary ring member 1230 although the second hook member 1320 rotates in the second rotation direction R, in case where the grip portion 1411 is pressed by 0 mm to 2.5 mm with respect to a distance over which the front end of the grip portion 1411 moves toward the lever case 1420 by pressing. In this state, when the door handle 221 is pulled, the first door 21 is opened.

Also, when the grip portion 1411 is pressed by 2.5 mm to 4.0 mm, the second hook member 1320 and the rotary ring member 1230 maintain the coupled state and the first hook member 1220 is coupled to the main ring unit 1100, whereby the first and second doors 21 and 22 may be maintained in the closed state. In this state, the first door 21 is fixed to the main body 10 and the second door 22 may be fixed to the first door 21, whereby the first and second doors 21 and 22 are not opened although the door handle 221 is pulled.

Also, it may be set such that when the grip portion 1411 is pressed by 4.0 mm to 8.0 mm, the second hook member 1320 is separated from the rotary ring member 1230 to open the second door 22.

Figure 10:
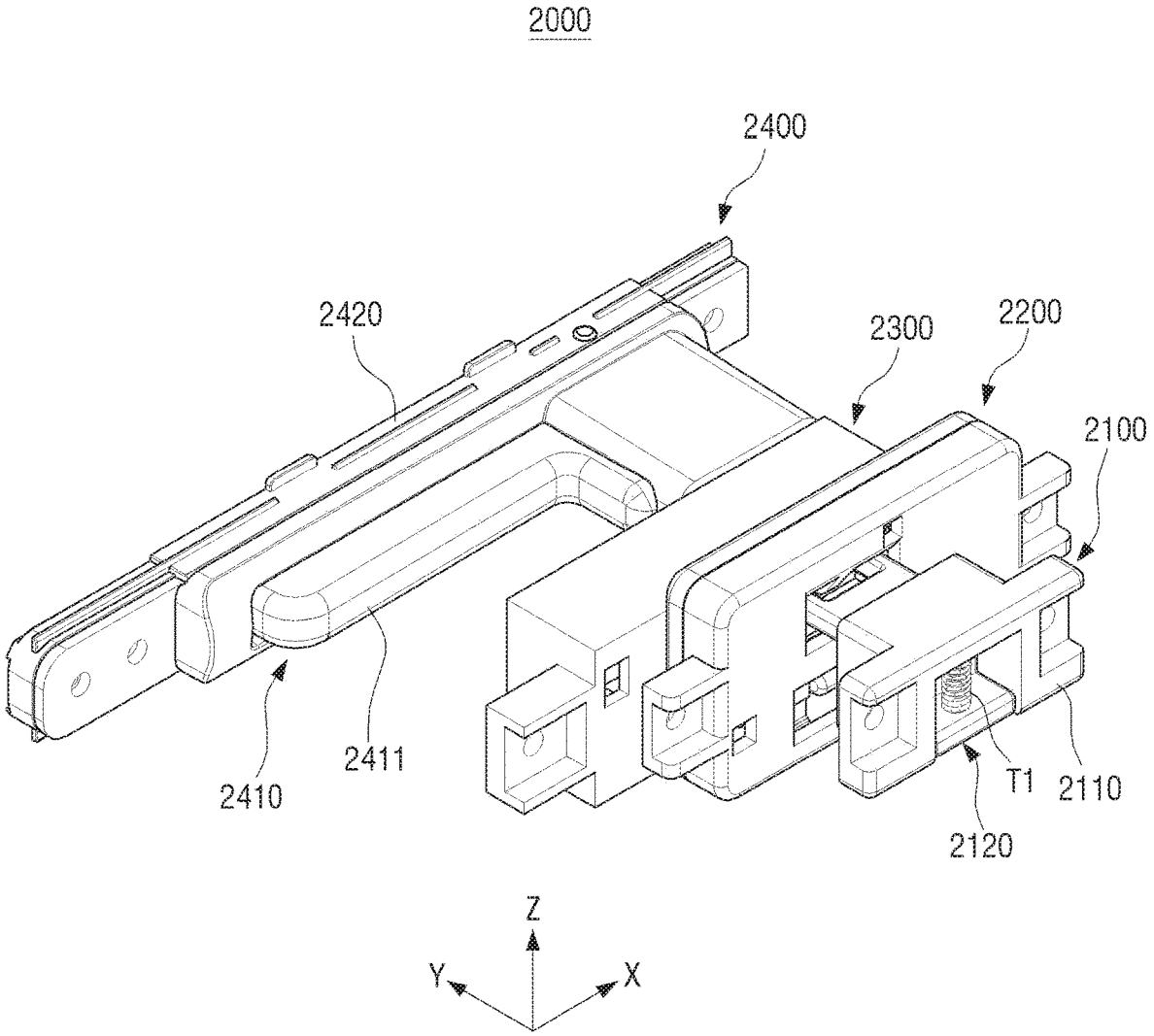
FIG. 10 is a perspective view of a locking device according to another embodiment of the disclosure.

FIG. 10 is a perspective view of a locking device 2000 according to another embodiment of the disclosure.

Referring to FIG. 10, the locking device 2000 according to another embodiment of the disclosure includes a main ring unit 2100 coupled to the main body 10 (See FIG. 3B), a first locking unit 2200 coupled to the first door 21 (See FIG. 3B) and selectively coupled to the main ring unit 2100, a second locking unit 2300 coupled to the second door 22 (See FIG. 3C) and selectively coupled to the first locking unit 2200, and an operating lever 2400 separating the second door 22 from the first door 21 when pressed.

The main ring unit 2100, the first locking unit 2200, the second locking unit, and the operating lever 2400 of the locking device 2000 are sequentially disposed in a direction from the main body 10 to a front side of the main body 10.

The operating lever 2400 may be coupled to the door handle 221 (See FIG. 3C) and, when pressed, the operating lever 2400 may separate the first locking unit 2200 and the second locking unit 2300 to separate the first door 21 and the second door 22.

The locking device 2000 includes a dual opening preventing member for maintaining a fixed state of the second door 22 so that the second door 22 is not opened although the operating lever 2400 is pressed in a state in which the first door 21 is open.

The locking device 2000 according to another embodiment of the disclosure is similar in basic configuration to the locking device 1000 according to an embodiment of the disclosure described above with reference to FIGS. 3A, 3B, 3C, 4-7, 8A, 8B, 9A, and 9B in that the locking device 2000 includes the main ring unit 2100 coupled to the main body 10, the first locking unit 2200 coupled to the first door 21, the second locking unit 2300 coupled to the second door 22, and the operating lever 2400 coupled to the door handle 221, but a detailed configuration of the main ring unit 2100, the first locking unit 2200, the second locking unit 2300, and the operating lever 2400 of the locking device 2000 is different from the locking device 1000 according to an embodiment of the disclosure.

Figure 11:
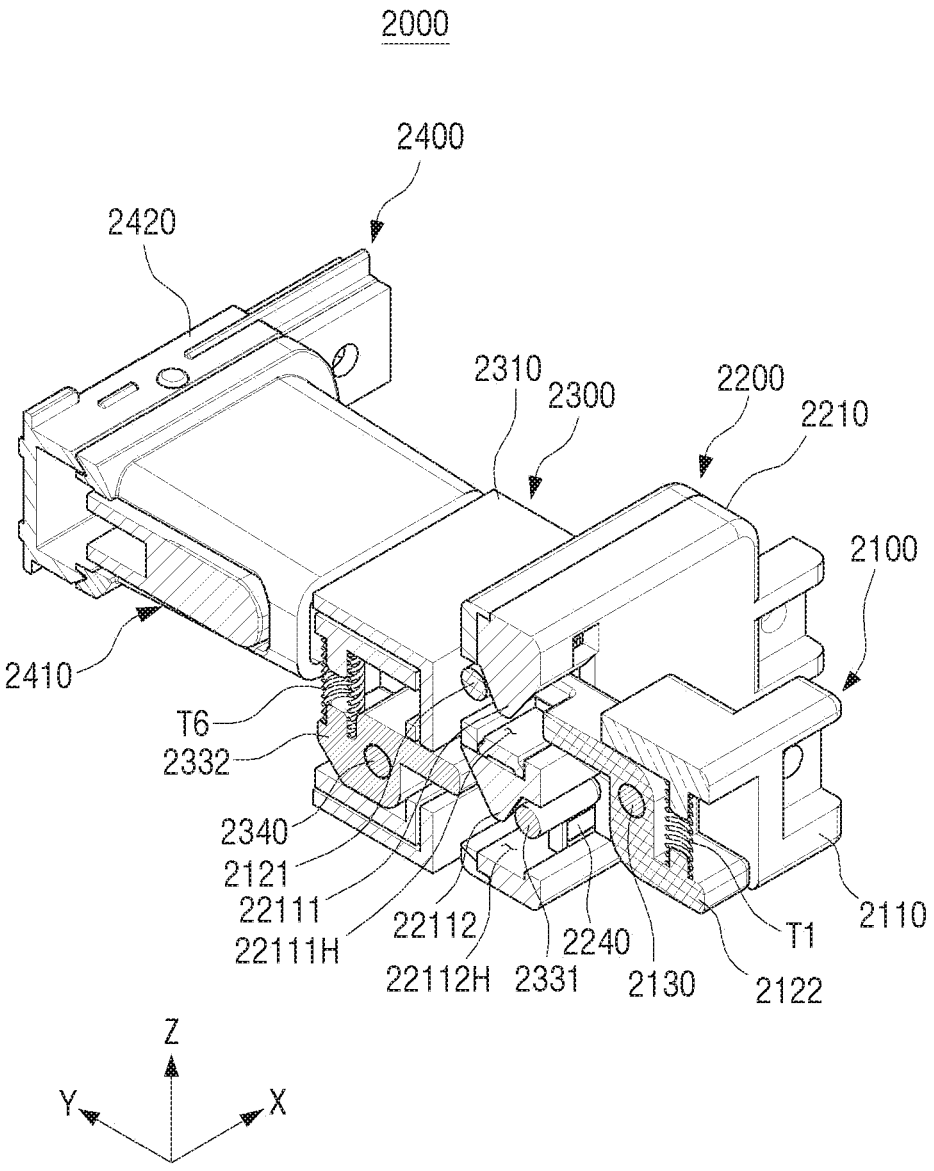
FIG. 11 is a cross-sectional view of the locking device illustrated in FIG. 10 according to an embodiment of the disclosure.
Figure 12:
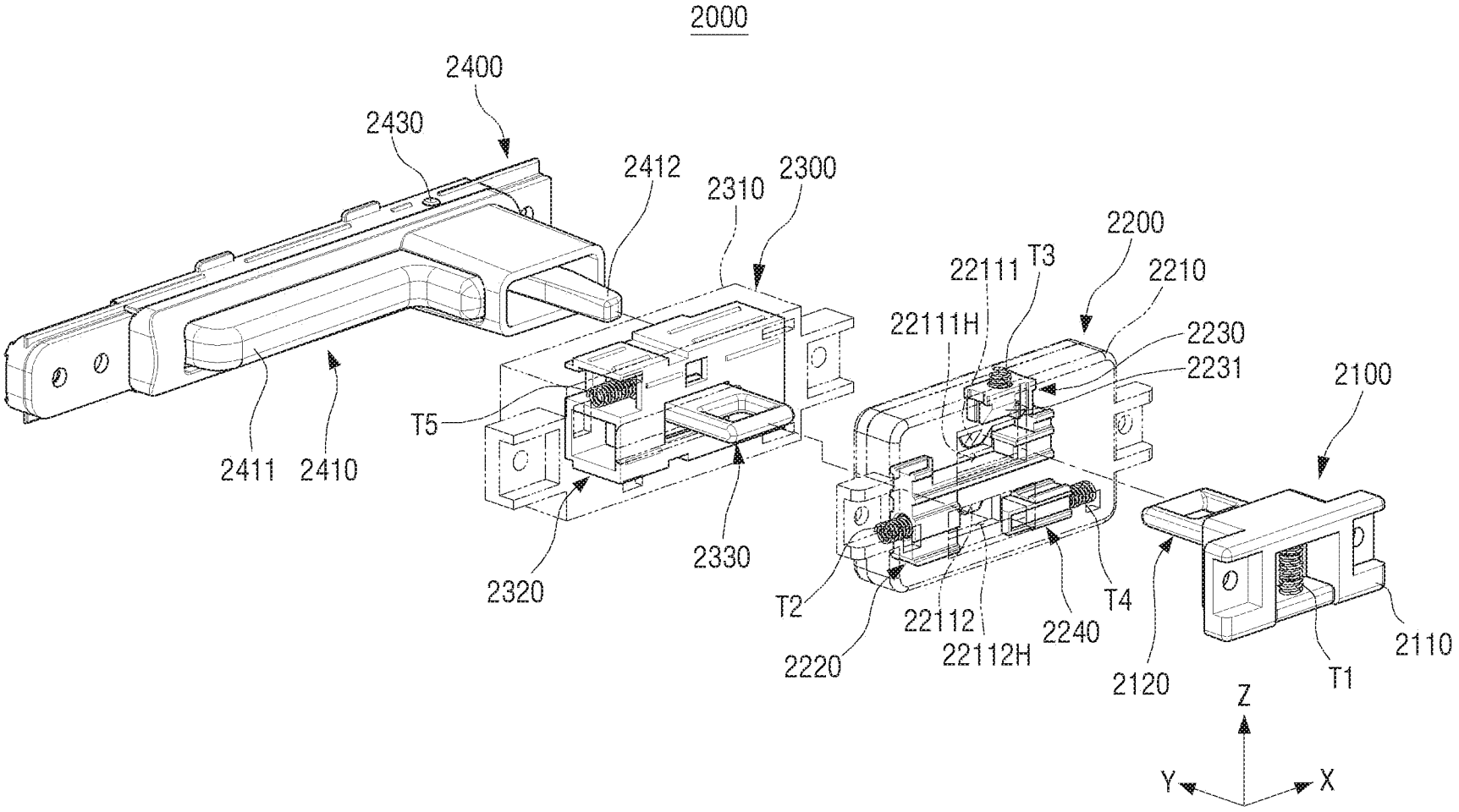
FIGS. 12 and 13 are exploded perspective views of the locking device illustrated in FIG. 10 according to an embodiment of the disclosure.
Figure 13:
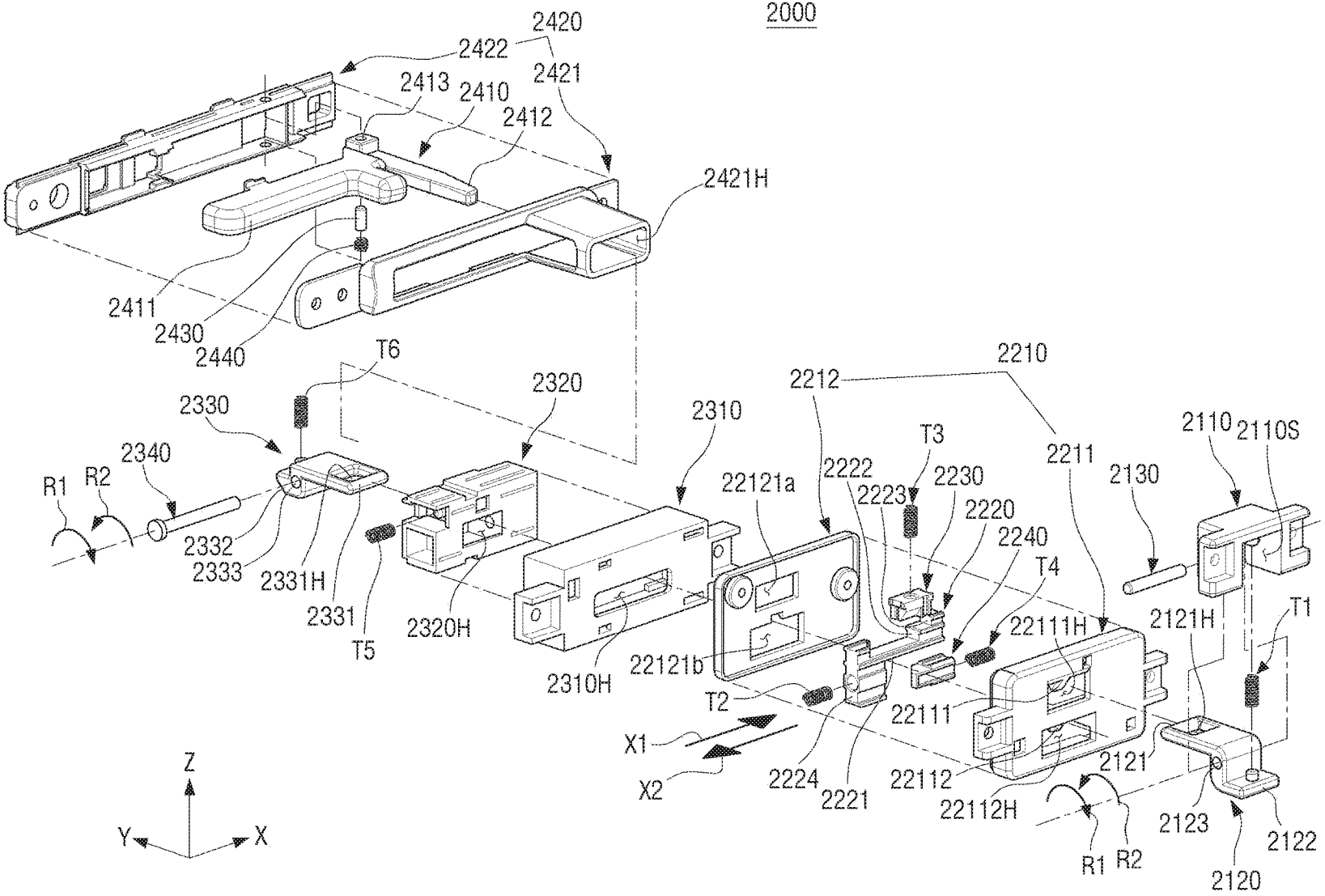

FIG. 11 is a cross-sectional view of the locking device 2000 illustrated in FIG. 10, and FIGS. 12 and 13 are exploded perspective views of the locking device 2000 illustrated in FIG. 10.

Hereinafter, a detailed structure of the locking device 2000 according to another embodiment of the disclosure will be described with reference to FIGS. 10 11, 12 and 13, and descriptions of the same components as those of the locking device 1000 according to the embodiment of the disclosure will be omitted.

The main ring unit 2100 is coupled to the front panel 11 of the main body 10.

Referring to FIGS. 11, 12, and 13, the main ring unit 2100 includes a body 2110 coupled to the front panel 11, a first ring member 2120 rotatably coupled to the body 2110, a first rotary shaft 2130 coupled to the body 2110 and allowing the first ring member 2120 to be rotatably coupled thereto, and a first elastic member T1 applying an elastic force to the first ring member 2120 to allow the first ring member 2120 to rotate in the first rotation direction R1 and coupled to a first engagement protrusion 22111 of the first locking unit 2200.

Specifically, the body 2110 includes an accommodation portion 2110S formed on an inner side thereof.

The first rotary shaft 2130 is coupled to the body 2110 through the accommodation portion 2110S of the body 2110 in the horizontal direction (X-axis direction) and is inserted into the first ring member 2120 in the horizontal direction (X-axis direction). Accordingly, the first ring member 2120 may rotate in the vertical direction (Z-axis direction) inside the accommodation portion 2110S of the body 2110.

The first ring member 2120 includes a ring-shaped first ring portion 2121 formed at one end thereof to be coupled with the first engagement protrusion 22111 of the first locking unit 2200, and an end 2122 opposing the first ring portion 2121 is coupled to one end of the first elastic member T1.

The first ring portion 2121 may protrude from the accommodation portion 2110S toward the first engagement protrusion 22111 and may be selectively coupled with the first engagement protrusion 22111.

The first ring member 2120 includes a through hole 2123 formed between the first ring portion 2121 and the end 2122 of the first ring member 2120, and the first rotary shaft 2130 is inserted into the through hole 2123 of the first ring member 2120.

The other end of the first elastic member T1 is coupled to the body 2110 on the accommodation portion 2110S of the body 2110. Accordingly, the first ring member 2120 is subjected to an elastic force from the first elastic member T1 and rotates in the first rotation direction R1 in which the first ring member 2120 is coupled with the first engagement protrusion 22111.

The first elastic member T1 may be a compression spring.

In order to prevent the first ring member 2120 from rotating by a predetermined angle or greater in the first rotation direction R1 by the elastic force from the first elastic member T1, the first ring member 2120 may include a separate stopper (not shown) interfered by the body 2110. Through this, the first ring member 2120 may be easily coupled to the first engagement protrusion 22111.

The first locking unit 2200 includes a first holder 2210 coupled to the first door 21 and a plurality of dual opening preventing members disposed inside the first holder 2210.

Specifically, the first holder 2210 includes a first cover 2211 and a second cover 2212 coupled to the first cover 2211.

The first cover 2211 includes a first coupling hole 22111H and a second coupling hole 22112H penetrating through the inside thereof and includes first and second engagement protrusions 22111 and 22112 protruding from the first and second coupling holes 22111H and 22112H, respectively.

The second cover 2212 includes first and second connection holes 22121*a* and 22121*b* penetrating through the inside of the second cover 2212 and connected to the first and second coupling holes 22111H and 22112H of the first cover 2211, respectively.

As illustrated in FIGS. 12 and 13, the first coupling hole 22111H may be disposed above the second coupling hole 22112H.

The first ring member 2120 may be coupled with the first engagement protrusion 22111 as the first ring portion 2121 is inserted into the first coupling hole 22111H.

Specifically, when the first engagement protrusion 22111 is inserted into the first ring hole 2121H of the first ring portion 2121, the main ring unit 2100 and the first locking unit 2200 may be coupled with each other.

When the first ring portion 2121 moves toward the first engagement protrusion 22111 to be coupled with the first engagement protrusion 22111, the first ring portion 2121 is pressed by the first engagement protrusion 22111 and rotates in the second rotation direction R2 opposite to the first rotation direction R1, and thereafter, when the first engagement protrusion 22111 is inserted into the first ring hole 2121H, the first ring portion 2121 is released from a pressed state, and thus, the first ring portion 2121 rotates in the first rotation direction R1 by an elastic force from the first elastic member T1. Accordingly, the first ring portion 2121 may be coupled with the first engagement protrusion 22111.

The process of separating the first ring portion 2121 from the first engagement protrusion 22111 is the reverse of the process in which the first ring portion 2121 is coupled to the first engagement protrusion 22111.

The second coupling hole 22112H is disposed below the first coupling hole 22111H and a second engagement protrusion 22112 is disposed at the second coupling hole 22112H.

The second engagement protrusion 22112 has a structure similar to that of the first engagement protrusion 22111 and may be coupled to the second ring member 2330 when the second ring member 2330 of the second locking unit 2300 (to be described later) is inserted into the second coupling hole 22112H.

The structure in which the second ring member 2330 is coupled with the second engagement protrusion 22112 will be described later.

The dual opening preventing members are disposed in the first holder 2210. The dual opening preventing members include a first sliding member 2220, a first stopper 2230, and a second stopper 2240.

The first sliding member 2220 is disposed to be slidable in the horizontal direction (X-axis direction) inside the first holder 2210.

In addition, a second elastic member T2 is coupled to one side of the first sliding member 2220.

The second elastic member T2 applies an elastic force to the first sliding member 2220 so that the first sliding member 2220 moves in the first horizontal direction X1. The second elastic member T2 may be a compression spring.

The first sliding member 2220 includes a seating portion 2221 disposed on a lower side of the first coupling hole 22111H and extending in the horizontal direction (X-axis direction), a first engagement portion 2222 protruding upwards from one end of the seating portion 2221, a second engagement portion 2223 protruding upwards from an upper surface of the first engagement portion 2222, and a third engagement portion 2224 protruding downwards from the other end of the seating portion 2221.

The second elastic member T2 described above is coupled to one side of the third engagement portion 2224 and applies an elastic force to move the second sliding member 2320 in the first horizontal direction X1. Here, the first horizontal direction X1 may be defined as a direction from the other end of the seating portion 2221 in which the third engagement portion 2224 is disposed toward one end of the seating portion 2221 in which the first engagement portion 2222 is disposed.

The first sliding member 2220 may slide in the first horizontal direction X1 by the second elastic member T2 or slide in the second horizontal direction X2 opposite to the first horizontal direction X1.

Hereinafter, for the purposes of description, a position to which the first sliding member 2220 has moved in the first horizontal direction X1 is defined as a first position and a position to which the first sliding member 2220 has moved in the second horizontal direction X2 is defined as a second position.

As the first sliding member 2220 reciprocates, the first ring portion 2121 of the first ring member 2120 rotating in the second rotation direction R2 may be seated on the seating portion 2221.

Specifically, when the first sliding member 2220 is disposed at the first position by the elastic force from the second elastic member T2, the first ring member 2120 may rotate in the second rotation direction R2 and the first ring portion 2121 may be seated on the seating portion 2221. Here, the first ring portion 2121 and the first engagement protrusion 22111 are separated.

When the first sliding member 2220 moves in the second horizontal direction X2 and is disposed at the second position in a state in which the first ring member 2120 and the first engagement protrusion 22111 are coupled, the first engagement portion 2222 is disposed on a lower side of the first ring portion 2121.

Accordingly, the first engagement portion 2222 may be interfered with the first ring member 2120 rotating in the second rotation direction R2 and prevent rotation of the first ring member 2120 in the second rotation direction R2.

The first stopper 2230 is disposed above the first engagement portion 2222.

A third elastic member T3 is coupled to an upper end of the first stopper 2230.

The third elastic member T3 applies an elastic force to the third elastic member T3 so that the first stopper 2230 moves downwards. The third elastic member T3 may be a compression spring.

As the first stopper 2230 may move downwards by means of the elastic force from the third elastic member T3, the first stopper 2230 may protrude from the first coupling hole 22111H.

Since the first stopper 2230 is supported by the first ring member 2120, the first stopper 2230 may be disposed inside the first holder 2210 without protruding from the first coupling hole 22111H.

The first stopper 2230 includes a sloped surface 2231 which is pressed by the first ring member 2120 so that it may be moved upwards when the first ring member 2120 is coupled to the first engagement protrusion 22111.

As the first ring member 2120 is separated from the first engagement protrusion 22111, the first stopper 2230 in a supported state is released from the first ring member 2120. Therefore, the first stopper 2230 moves downwards by the elastic force from the third elastic member T3 and protrudes from the first coupling hole 2211H.

As the first stopper 2230 protrudes from the first coupling hole 22111H, the first stopper 2230 is seated on the first engagement portion 2222.

Accordingly, the second engagement portion 2223 is interfered by the first stopper 2230, preventing the first sliding member 2220 from moving in the second horizontal direction X2.

Also, when the first ring member 2120 is inserted into the first coupling hole 22111H, the sloped surface 2231 of the first stopper 2230 is pressed by the first ring portion 2121 and is easily moved upwards.

The second stopper 2240 is disposed below the seating portion 2221.

Specifically, the second stopper 2240 may be disposed on a lower side of one end of the seating portion 2221 to which the first engagement portion 2222 is coupled, and may face the third engagement portion 2224.

A fourth elastic member T4 is coupled to one side of the second stopper 2240 to apply an elastic force to move the second stopper 2240 in the second horizontal direction X2. The fourth elastic member T4 may be a compression spring.

In a state in which the second ring member 2330 is coupled with the second engagement protrusion 22112, the second stopper 2240 protrudes from the second coupling hole 22112H and is disposed below the second ring member 2330 and interfered with the second ring member 2330 rotating in the first rotation direction R1. Accordingly, the second stopper 2240 may prevent the second ring member 2330 from rotating in the first rotation direction R1 in which the second ring member 2330 is separated from the second engagement protrusion 22112.

Through the first sliding member 2220, the first stopper 2230, and the second stopper 2240, the second door 22 may be prevented from opening in a state in which the first door 21 is open. A dual opening preventing structure of the second door 22 through the first sliding member 2220, the first stopper 2230, and the second stopper 2240 will be described later.

The second locking unit 2300 includes a second holder 2310 coupled to the second door 22, a second sliding member 2320 slidably coupled to the inside of the second holder 2310, a fifth elastic member T5 applying an elastic force to the second sliding member 2320 so that the second sliding member 2320 moves in the first horizontal direction X1, the second ring member 2330 rotatably coupled to the inside of the second sliding member 2320, a second rotary shaft 2340 coupled to the second sliding member 2320 and allowing the second ring member 2330 to be rotatably coupled thereto, and a sixth elastic member T6 applying an elastic force to the second ring member 2330 so that the second ring member 2330 rotates in the second rotation direction R2 in which the second ring member 2330 is coupled with the second engagement protrusion 22112.

The second holder 2310 includes an accommodation portion 2310S (See FIG. 15A) formed on an inner side thereof, and the second sliding member 2320 may be inserted into the accommodation portion 2310S of the second holder 2310 and reciprocate in the first and second horizontal directions X1 and X2.

In addition, the second holder 2310 includes an opening 2310H formed on an inner side thereof and allowing a second ring portion 2331 of the second ring member 2330 (to be described later) to pass therethrough.

The second sliding member 2320 may be slidably coupled to the accommodation portion 2310S of the second holder 2310 and may slide on the accommodation portion 2310S of the second holder 2310 in the first and second horizontal directions X1 and X2.

The fifth elastic member T5 has one end coupled to one side of the second sliding member 2320 so that the second sliding member 2320 moves in the first horizontal direction X1, and the other end thereof opposite to one end of the fifth elastic member T5 is coupled to the inside of the second holder 2310. The fifth elastic member T5 may be a compression spring.

The second ring member 2330 is disposed to be rotatable in the first and second rotation directions R1 and R2 inside the second sliding member 2320.

The second ring member 2330 may rotate in the first and second rotation directions R1 and R2, like the first ring member 2120.

Here, the first and second rotation directions R1 and R2 in which the second ring member 2330 rotates may be referred to as third and fourth rotation directions, respectively.

Specifically, as the second rotary shaft 2340 disposed in the horizontal direction (X-axis direction) is inserted to penetrate through a first accommodation portion 2320S1 (See FIG. 15A) of the second sliding member 2320, the second ring member 2330 may rotate in the vertical direction (Z-axis direction) inside the first accommodation portion 2320S1.

The second ring member 2330 includes a ring-shaped second ring portion 2331 formed at one end thereof so as to be coupled with the second engagement protrusion 22112 of the first locking unit 2200, and one end of the sixth elastic member T6 is coupled to an end 2332 opposite to the second ring portion 2331.

The second ring portion 2331 protrudes toward the second engagement protrusion 22112 and may be selectively coupled with the second engagement protrusion 22112.

To this end, the second sliding member 2320 includes an opening 2320H formed inside thereof to allow the second ring portion 2331 to pass therethrough.

Thus, the second ring portion 2331 of the second ring member 2330 sequentially passes through the opening 2320H of the second sliding member 2320 and the opening 2310H of the second holder 2310 and may be coupled with the second engagement protrusion 22112.

When the second ring portion 2331 of the second ring member 2330 is inserted into the second coupling hole 22112H, one side of the second ring portion 2331 is disposed adjacent to the third engagement portion 2224.

A width of the opening 2320H of the second sliding member 2320 and a width of the opening 2310H of the second holder 2310 may correspond to a width of the second ring portion 2331, and a height of the opening 2320H of the second sliding member 2320 and a height of the opening 2310H of the second holder 2310 may correspond to a rotation radius of the second ring member 2330 in the first and second rotating directions R1 and R2.

The second ring member 2330 includes a through hole 2333 formed between the second ring portion 2331 and the end 2332 of the second ring member 2330, and the second rotary shaft 2140 is inserted into the through hole 2333 of the second ring member 2330.

The other end of the sixth elastic member T6 is coupled to the second sliding member 2320 on the first accommodation portion 2320S1 of the second sliding member 2320. As a result, the second ring member 2330 is subjected to elastic force from the sixth elastic member T6 so as to rotate in the second rotation direction R2 in which the second ring member 2330 is coupled with the second engagement protrusion 22112. The sixth elastic member T6 may be a compression spring.

However, the second ring member 2330 may include a separate stopper (not shown) interfered by the second sliding member 2320 or the second holder 2310 to prevent rotation thereof at a predetermined angle or greater in the second rotation direction R2 by an elastic force from the sixth elastic member T6. Accordingly, the first ring member 2120 may be easily coupled to the first engagement protrusion 22111.

The second ring member 2330 may be interfered by the opening 2320H of the second sliding member 2320 or the opening 2310H of the second holder 2310, thus being regulated in rotation radius thereof.

As the second ring portion 2331 of the second ring member 2330 is inserted into the second coupling hole 22112H, the second engagement protrusion 22112 may be inserted into a second ring hole 2331H of the second ring portion 2331, whereby the second locking unit 2300 and the first locking unit 2200 may be coupled.

While the second ring portion 2331 is moving toward the second engagement protrusion 22112 to be coupled to the second engagement protrusion 22112, the second ring portion 2331 is pressed by the second engagement protrusion 22112 and rotates in the first rotation direction R1. Thereafter, when the second engagement protrusion 22112 is inserted into the second ring hole 2331H, the second ring portion 2331 is released from a pressed state and rotates in the second rotation direction R2 by an elastic force from the sixth elastic member T6. Accordingly, the second ring portion 2331 may be coupled with the second engagement protrusion 22112.

The process of separating the second ring portion 2331 from the second engagement protrusion 22112 is performed in reverse order of the process of coupling the second ring portion 2331 to the second engagement protrusion 22112.

As described above, in a state in which the second door 22 is closed, the second stopper 2240 is disposed on a lower side of the second ring portion 2331.

In a state in which the second door 22 is closed, the second ring portion 2331 is interfered by the second stopper 2240 and prevented from rotating in the first rotation direction R1 in which the second ring portion 2331 is separated from the second engagement protrusion 22112.

The operating lever 2400 may be coupled to the door handle 221 and may be operated, when pressed, to separate the second door 22 from the first door 21.

The second sliding member 2320 may be pressed by the operating lever 2400 and move in the second horizontal direction X2.

As the second sliding member 2320 moves in the second horizontal direction X2, the second ring member 2330 coupled to the second sliding member 2320 is also moved in the second horizontal direction X2.

Specifically, the operating lever 2400 includes a lever body 2410, a lever case 2420 to which the lever body 2410 is rotatably coupled, a lever shaft 2430 inserted into the lever body 2410, and a lever elastic member 2440 applying an elastic force to the lever body 2410.

The lever body 2410 includes a grip portion 2411 that the user may grip and a pressing portion 2412 coupled to one end of the grip portion 2411.

The pressing portion 2412 may protrude toward the second sliding member 2320 and is inserted into a second accommodation portion 2320S2 (See FIG. 15B) of the second sliding member 2320 to press the inside of the second accommodation portion 2320S2 to allow the second sliding member 2320 to move in the second horizontal direction X2.

A lever shaft hole 2413 through which the lever shaft 2430 is inserted is formed between the grip portion 2411 and the pressing portion 2412.

The lever shaft hole 2413 penetrates through the lever body 2410 in a vertical direction, whereby the lever body 2410 may rotate in the horizontal direction with respect to the lever shaft 2430.

Therefore, when the grip portion 2411 is pressed, the lever body 2410 rotates about the lever shaft 2430 and the pressing portion 2412 presses the second sliding member 2320.

The lever case 2420 includes a first case 2421 and a second case 2422.

The first case 2421 has a through portion 2421H through which the pressing portion 2412 penetrates and the lever shaft 2430 is coupled to the second case 2422.

The lever elastic member 2440 applies an elastic force to the lever body 2410 so that the lever body 2410 may rotate in a direction opposite to the direction in which the lever body 2410 presses the second sliding member 2320. The lever elastic member 2440 may be a torsion spring.

Accordingly, by pressing the grip portion 2411 with a force greater than the elastic force from the lever elastic member 2440, the user may rotate the lever body 2410 so that the pressing portion 2412 may press the second sliding member 2320.

Furthermore, the user may move the second sliding member 2320 in the second horizontal direction X2 by pressing the grip portion 2411.

When the grip portion 2411 is pressed and the lever body 2410 rotates, an inner wall of the second accommodation portion 2320S2 of the second sliding member 2320, into which the pressing portion 2412 is inserted, is pressed by the pressing portion 2412 and the second sliding member 2320 slides in the second horizontal direction X2.

When the grip portion 2411 of the operating lever 2400 is pressed in a state in which the first and second doors 21 and 22 are closed, the second sliding member 2320 and the second ring member 2330 coupled to the second sliding member 2320 move in the second horizontal direction X2.

As the second ring member 2330 moves in the second horizontal direction X2, the second ring portion 2331 may press the third engagement portion 2224 in the second horizontal direction X2, whereby the first sliding member 2220 may move in the second horizontal direction X2.

As the third engagement portion 2224 moves in the second horizontal direction X2, the second ring portion 2331 of the second ring member 2330 is released from the interference of the second stopper 2240.

A space in which the second ring portion 2331 may rotate in the first rotation direction R1 is formed between the third engagement portion 2224 and the second stopper 2240, whereby the second ring member 2330 may rotate in the first rotation direction R1 in which the second ring member 2330 is separated from the second engagement protrusion 22112.

As described above, the operating lever 2400 may be coupled to the door handle 221.

The user may open the second door 22 by pulling the door handle 221 in a state in which the user presses the grip portion 2411.

The operating lever 2400 may be coupled to one side of the door handle 221 facing the front surface of the second door 22, to face the front surface of the second door 22.

Thus, the user may pull the first and second doors 21 and 22 in an opening direction through the door handle 221 by simultaneously pressing the grip portion 2411 of the operating lever 2400.

In this case, the operating lever 2400 may also be disposed in the control panel 30, rather than being coupled to the door handle 221, and in this case, the user may open the second door 22 by pulling the door handle 221 in a state of pressing the grip portion 2411 of the operating lever 2400.

The process of opening the first and second doors 21 and 22 will be described in more detail below.

Figure 14A:
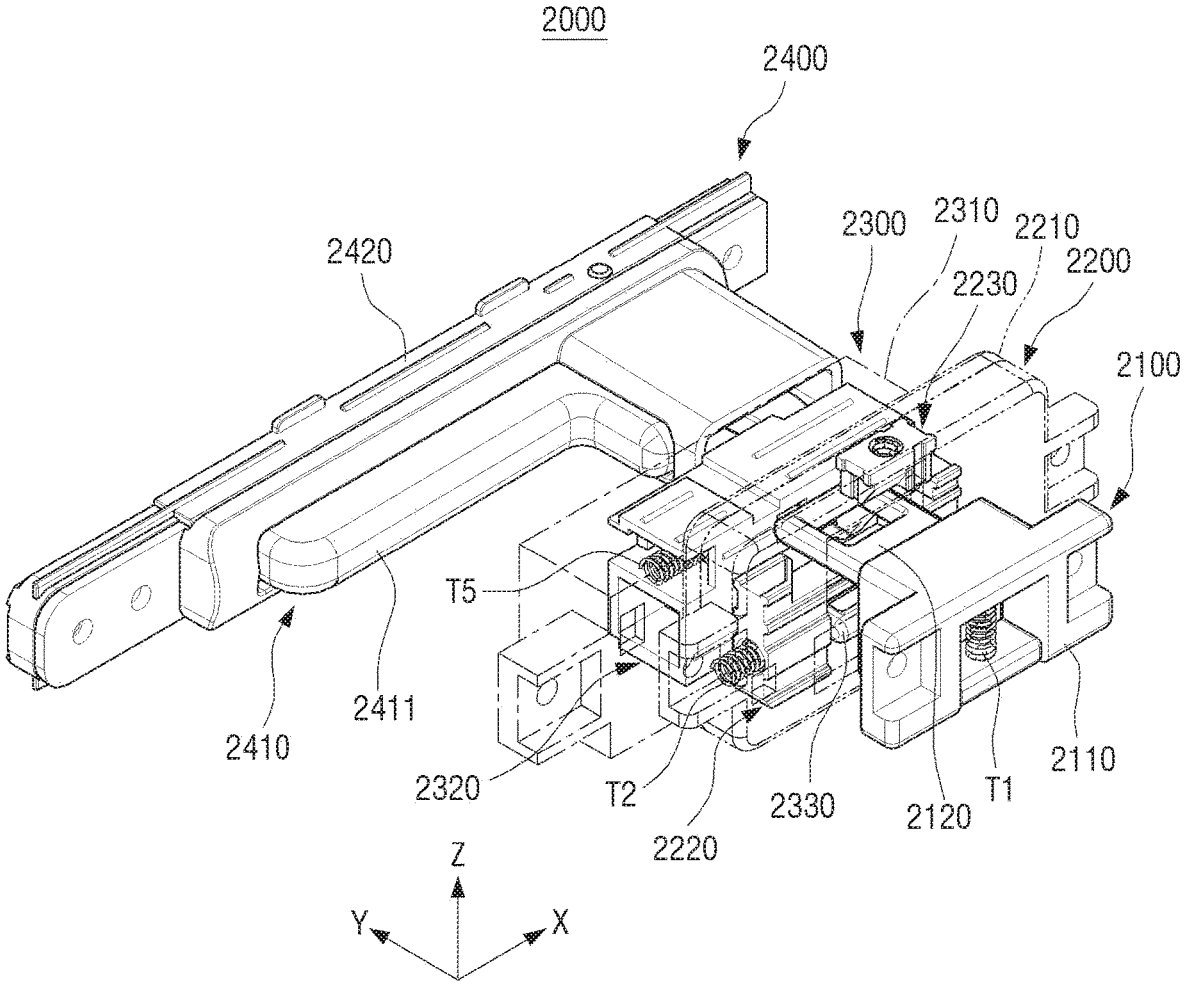
FIGS. 14A, 14B and 14C are views illustrating an operation of a locking device in the process of opening a first door according to various embodiments of the disclosure.
Figure 14B:
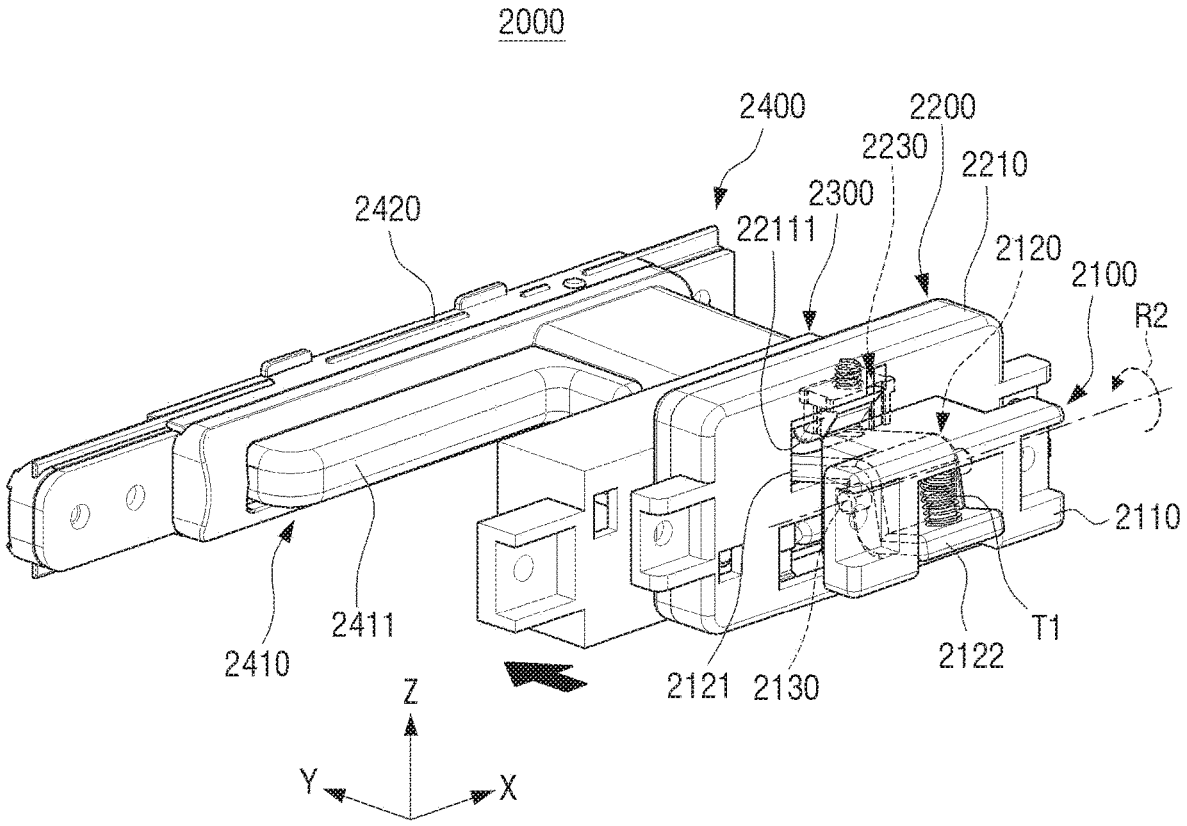
Figure 14C:
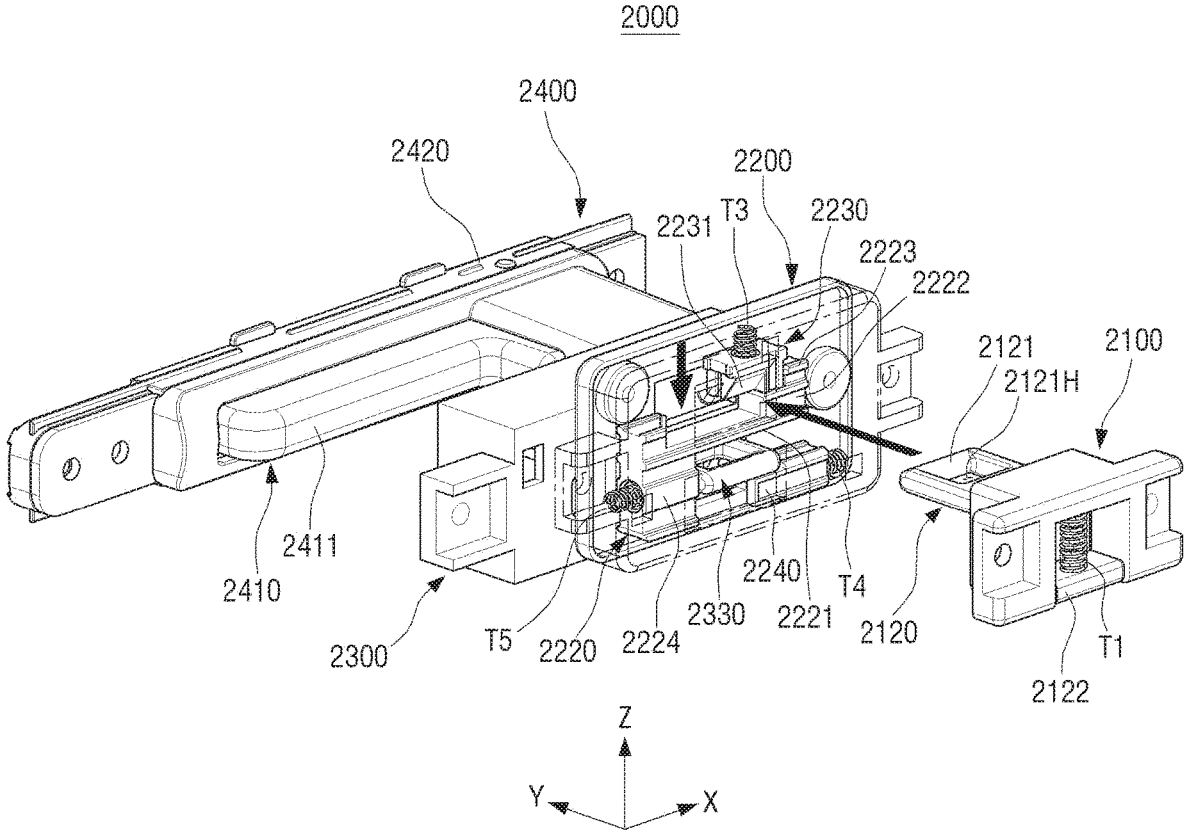

FIGS. 14A, 14B, and 14C are diagrams illustrating an operation of the locking device 2000 in the process of opening the first door 21.

Hereinafter, a structure in which the first door 21 is open and a dual opening preventing structure in which the second door 22 is not open in a state in which the first door 21 is open will be described with reference to FIGS. 14A, 14B, and 14C.

FIG. 14A is a view illustrating the locking device 2000 in a state in which the first and second doors 21 and 22 are closed.

As described above, in a state in which the first and second doors 21 and 22 are closed, the first ring member 2120 is inserted into the first coupling hole 22111H and coupled with the first engagement protrusion 22111.

Referring to FIG. 14A, the second ring member 2330 may be inserted into the second coupling hole 22112H and coupled with the second engagement protrusion 22112, and is interfered by the second stopper 2240 so as to be prevented from rotating in the first rotation direction R1 in which the second ring member 2330 is separated from the second engagement protrusion 22112. Thus, the second door 22 may be maintained in a state of being coupled with the first door 21.

FIG. 14B is a view illustrating the locking device 2000 in a state in which the first door 21 starts to be open, and FIG. 14C is a view illustrating the locking device 2000 in a state in which the first door 21 is open.

When the door handle 221 coupled to the second door 22 starts to be pulled toward the front of the main body 10, the first door 21 to which the second door 22 is coupled starts to open.

Referring to FIG. 14B, when the first door 21 starts to be open, the first ring member 2120 is pressed by the first engagement protrusion 22111 and rotates in the second rotation direction R2.

As the first ring member 2120 rotates in the second rotation direction R2, the first ring hole 2121H of the first ring member 2120 and the first engagement protrusion 22111 are separated.

Thereafter, as illustrated in FIG. 14C, when the door handle 221 is further pulled toward the front of the main body 10, the first ring member 2120 and the first engagement protrusion 22111 are separated and the first ring member 2120 rotates in the first rotation direction R1 by an elastic force from the first elastic member T1.

Accordingly, the main ring unit 2100 and the first locking unit 2200 are separated, whereby the first door 21 is opened.

Referring to FIG. 14C, when the first door 21 is open and the first ring member 2120 is separated from the first engagement protrusion 22111, the first stopper 2230 supported by the first ring portion 2121 is released.

Therefore, the first stopper 2230 is moved downward by the elastic force from the third elastic member T3 and protrudes from the first coupling hole 22111H.

As the first stopper 2230 protrudes from the first coupling hole 22111H, the first stopper 2230 is seated on the first engagement portion 2222.

Accordingly, the second engagement portion 2223 is interfered by the first stopper 2230, whereby the first sliding member 2220 is prevented from moving in the second horizontal direction X2.

As movement of the first sliding member 2220 in the second horizontal direction X2 is blocked by the first stopper 2230, movement of the second ring member 2330 facing the third engagement portion 2224 in the second horizontal direction X2 is also blocked and movement of the second sliding member 2320, to which the second ring member 2330 is coupled, in the second horizontal direction X2 is also blocked.

Therefore, although the grip portion 2411 is pressed, the lever body 2410 does not rotate and is maintained in position.

Accordingly, although the operating lever 2400 is pressed in a state in which the first door 21 is open, the second door 22 is prevented from opening, and the second door 22 is prevented from opening dually in a state in which the first door 21 is open.

FIGS. 15A, 15B, 15C, and 15E are views illustrating an operation of the locking device 2000 in the process of opening the second door 22.

Figure 15A:
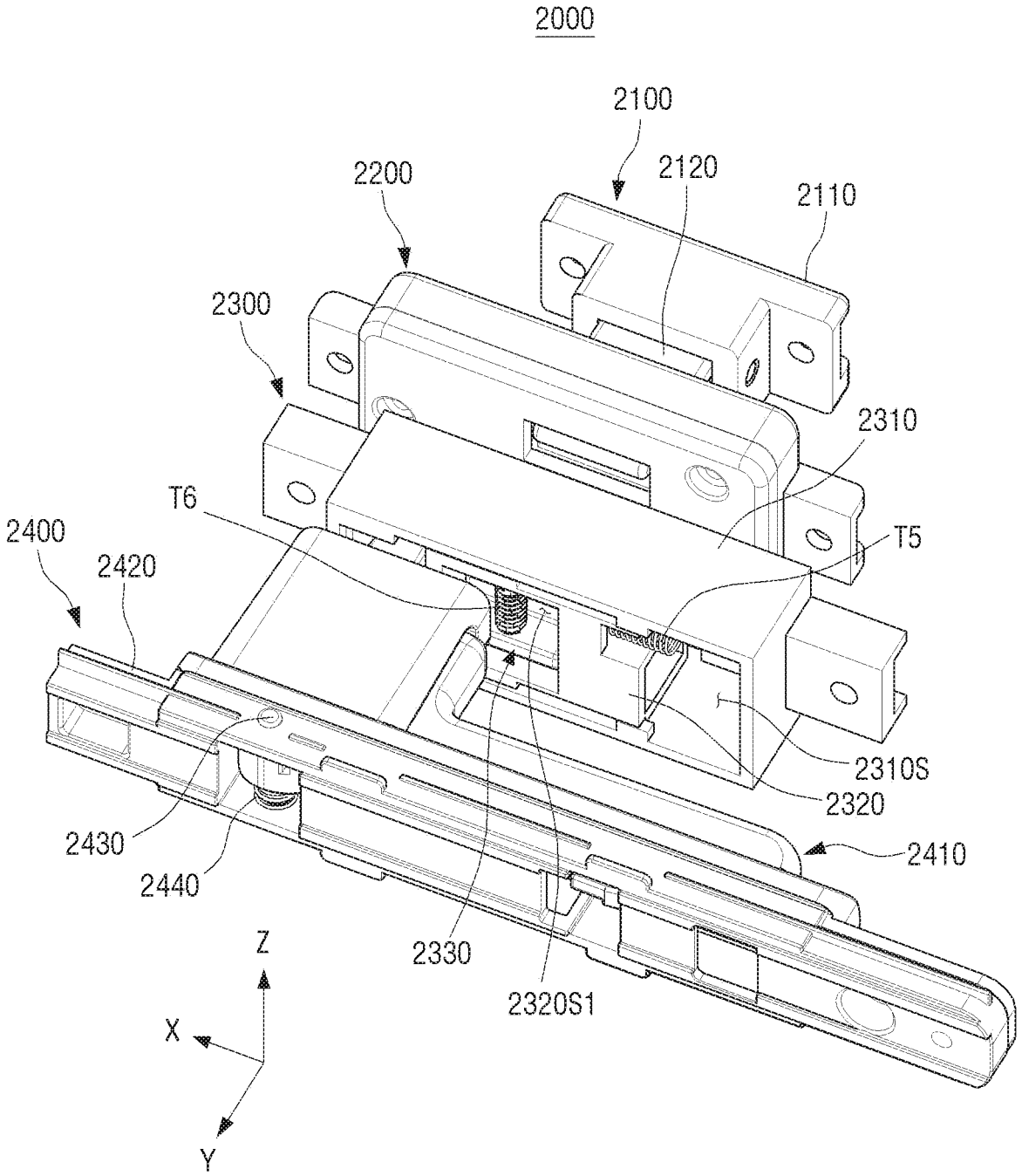
FIGS. 15A, 15B, 15C, 15D and 15E are views illustrating an operation of a locking device in the process of opening a second door according to various embodiments of the disclosure.

FIG. 15A is a view illustrating the locking device 2000 in a state in which the first and second doors 21 and 22 are closed, which illustrates the locking device 2000 viewed in a direction different from that illustrated in FIG. 14A.

Figure 15B:
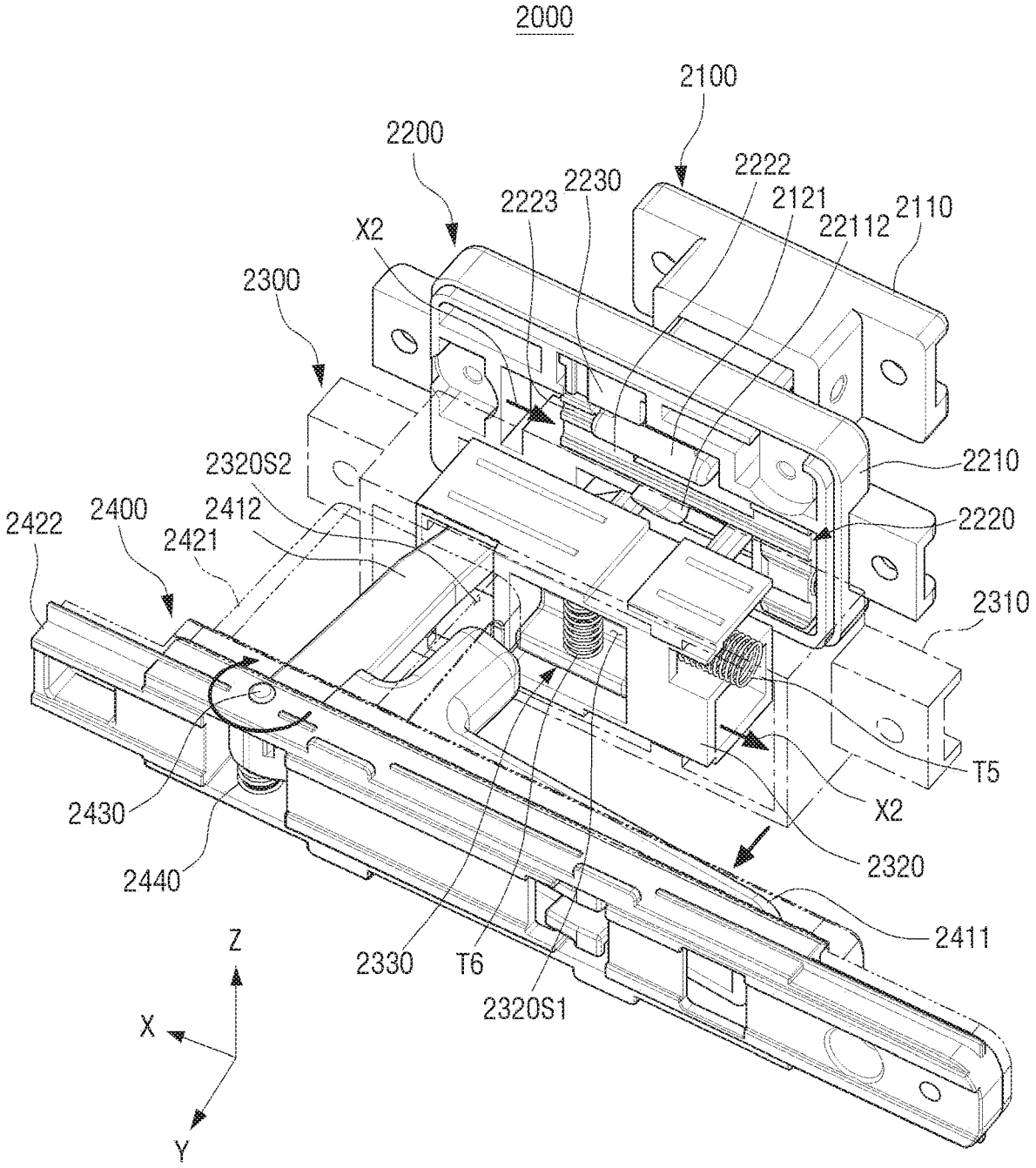
Figure 15C:
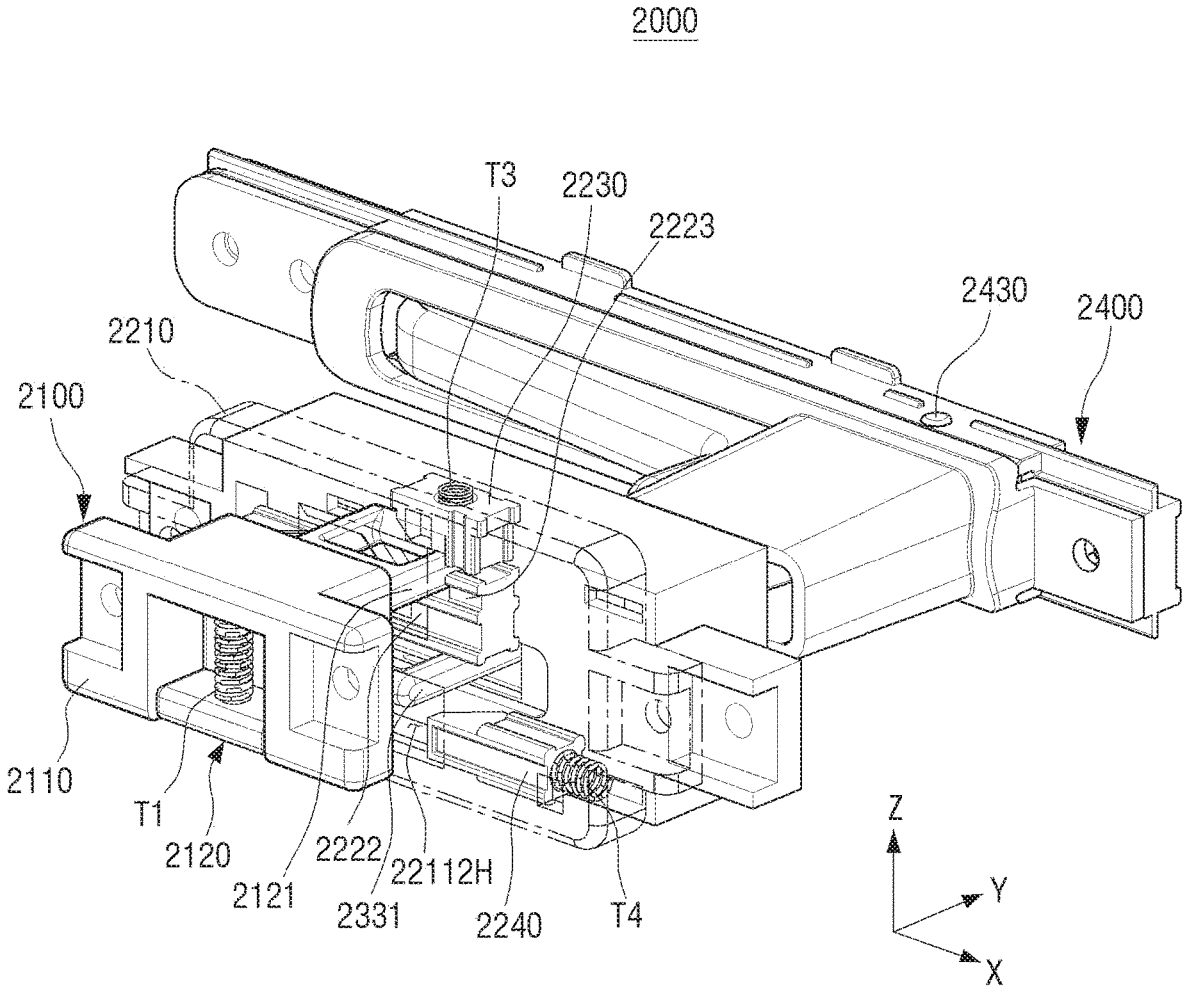

FIGS. 15B and 15C illustrate the locking device 2000 in a state in which the grip portion 2411 of the operating lever 2400 is pressed, which is viewed in different directions.

Referring to FIGS. 15A, 15B, and 15C, when the grip portion 2411 of the operating lever 2400 is pressed in a state in which the first and second doors 21 and 22 are closed, the lever body 2410 rotates and the pressing portion 2412 inserted into the second accommodation portion 2320S2 presses the second sliding member 2320 in the second horizontal direction X2.

As the second sliding member 2320 slides in the second horizontal direction X2, the second ring member 2330 coupled to the first accommodation portion 2320S1 of the second sliding member 2320 also moves in the second horizontal direction X2.

Also, as the second ring member 2330 moves in the second horizontal direction X2, the third engagement portion 2224 of the first sliding member 2220 is pressed by the second ring portion 2331, whereby the first sliding member 2220 also moves in the second horizontal direction X2.

As illustrated in FIG. 15C, when the first sliding member 2220 moves in the second horizontal direction X2 and is disposed at the second position, the second ring member 2330 may rotate in first rotation direction R1 in which the second ring member 2330 is separated from the second engagement protrusion 22112 without being interfered by the second stopper 2240.

Also, as the first sliding member 2220 moves in the second horizontal direction X2, the first engagement portion 2222 is disposed on a lower side of the first ring portion 2121 and the second engagement portion 2223 is disposed on a lower side of the first stopper 2230.

Accordingly, the first ring member 2120 is interfered with the first engagement portion 2222 disposed below the first ring portion 2121, and thus, rotation of the first ring member 2120 in the second rotation direction R2 in which the first ring member 2120 is separated from the first engagement protrusion 22111 is prevented.

As a result, when the grip portion 2411 is pressed in a state in which the first and second doors 21 and 22 are closed, the first ring member 2120 may be maintained in a state of being coupled with the first engagement protrusion 22111 by the first engagement portion 2222.

Further, since the first stopper 2230 is interfered with the second engagement portion 2223, downward movement by the third elastic member T3 may be blocked.

Figure 15D:
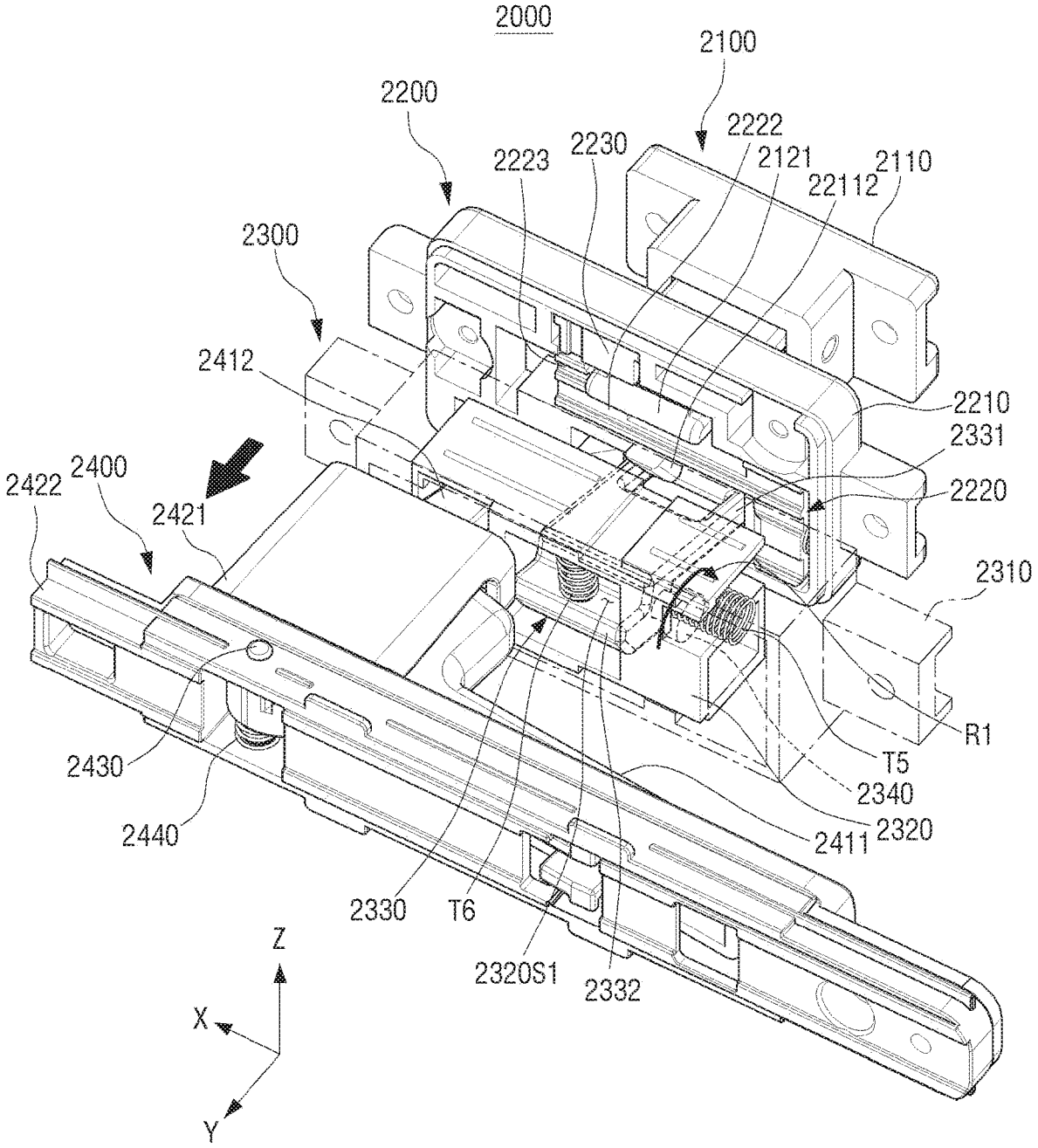

Thereafter, referring to FIG. 15D, when the door handle 221 starts to be pulled in a state in which the grip portion 2411 is pressed, the second door 22 is separated from the first door 21 and rotates about the second hinge shaft 222 and starts to be open.

When the door handle 221 is pulled in a state in which the grip portion 2411 is pressed, the second ring member 2330 is pressed by the second engagement protrusion 22112 to rotate in the first rotation direction R1.

As the second ring member 2330 rotates in the first rotation direction R1, the second ring hole 2331H of the second ring member 2330 and the second engagement protrusion 22112 are separated.

The second ring member 2330 may also be configured to rotate in the first rotation direction R1 to be coupled with the second engagement protrusion 22112 and rotate in the second rotation direction R2 to be separated from the second engagement protrusion 22112.

Figure 15E:
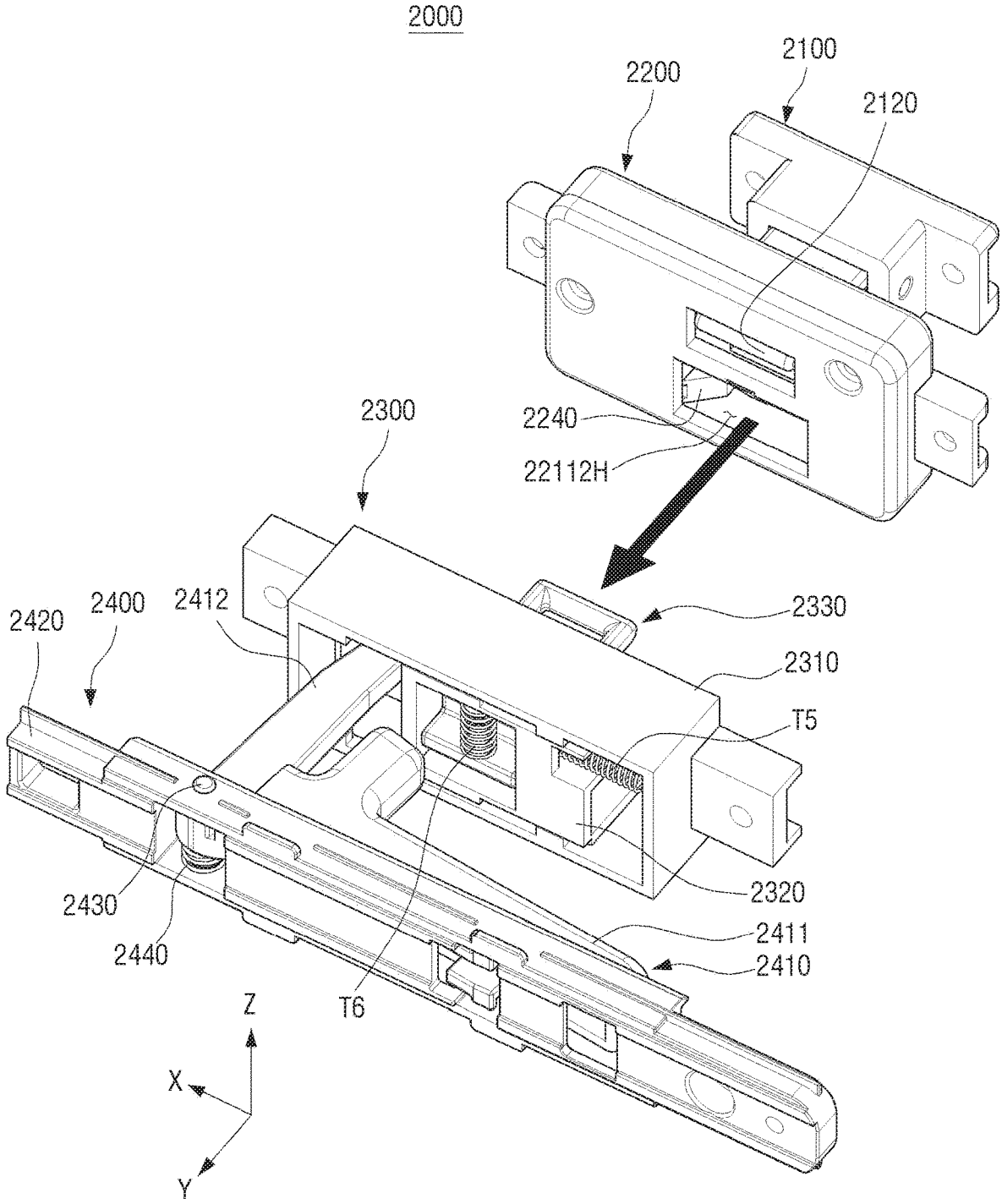

Thereafter, referring to FIG. 15E, when the door handle 221 is further pulled toward the front of the main body 10, the second ring member 2330 and the second engagement protrusion 22112 are separated and the second ring member 2330 rotates in the second rotation direction R2 by the elastic force from the fifth elastic member T5.

Accordingly, the second locking unit 2300 and the first locking unit 2200 are separated and the second door 22 is opened.

While the second door 22 is separated from the first door 21 and opened, the first ring member 2120 is interfered by the first engagement portion 2222 so rotation in the second rotation direction R2 in which the first ring member 2120 is separated from the first engagement protrusion 22111 is blocked, whereby the first door 21 may be fixed to the main body 10.

Therefore, when the door handle 221 is pulled toward the front of the main body 10 in a state in which the grip portion 2411 is pressed, the first door 21 may be kept closed and only the door 22 is open.

The locking device 2000 according to another embodiment of the disclosure described above may prevent the first door 21 and the second door 22 from opening dually by selectively fixing the first and second ring members 2120 and 2330 to the first and second engagement protrusions 22111 and 22112 through the first sliding member 2220 and the first and second stoppers 2230 and 2240.

Hereinafter, a locking device according to another embodiment of the disclosure will be described in detail with reference to FIGS. 16 to 19.

Figure 16:
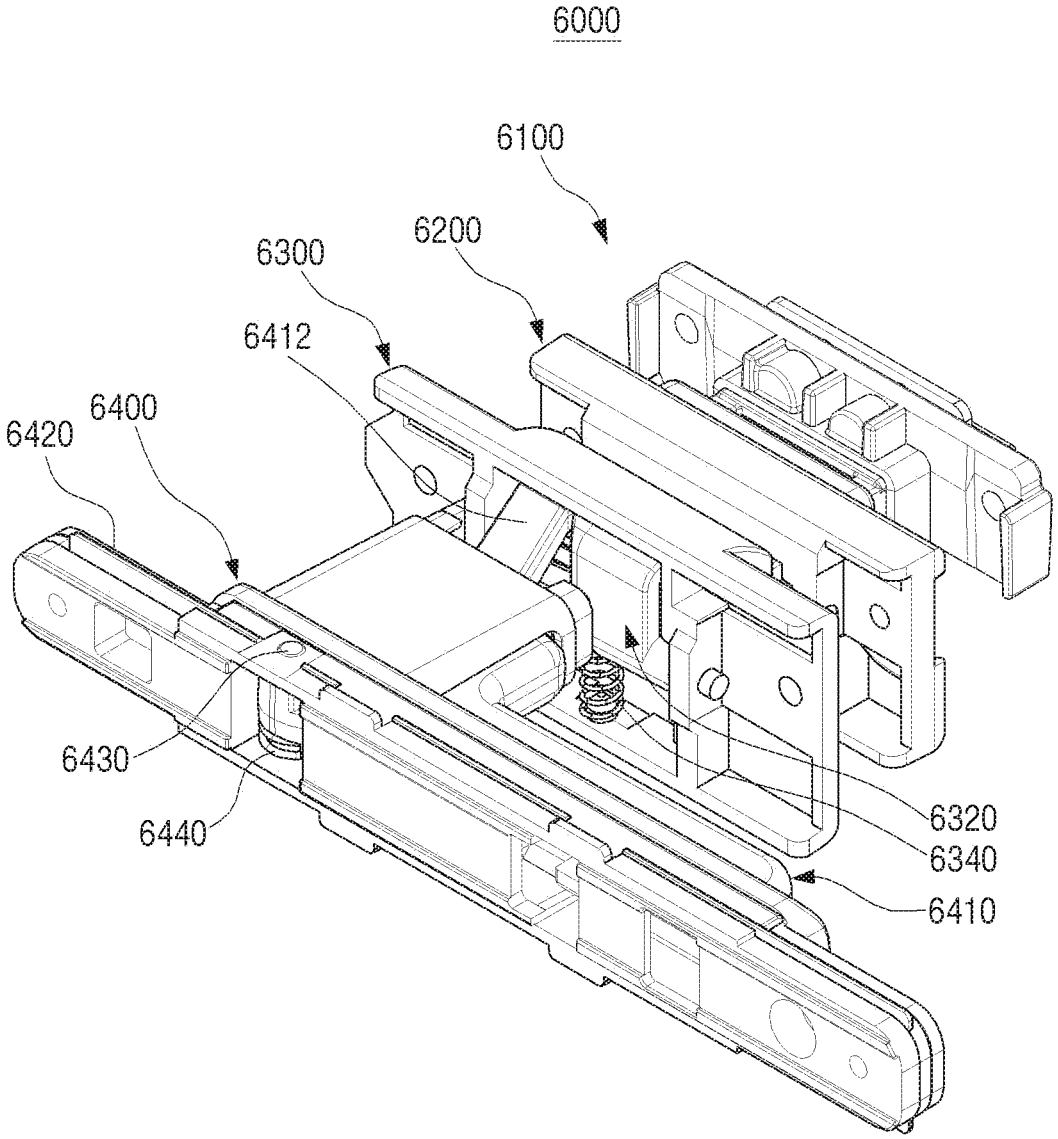
FIG. 16 is a perspective view of a locking device according to another embodiment of the disclosure.
Figure 17:
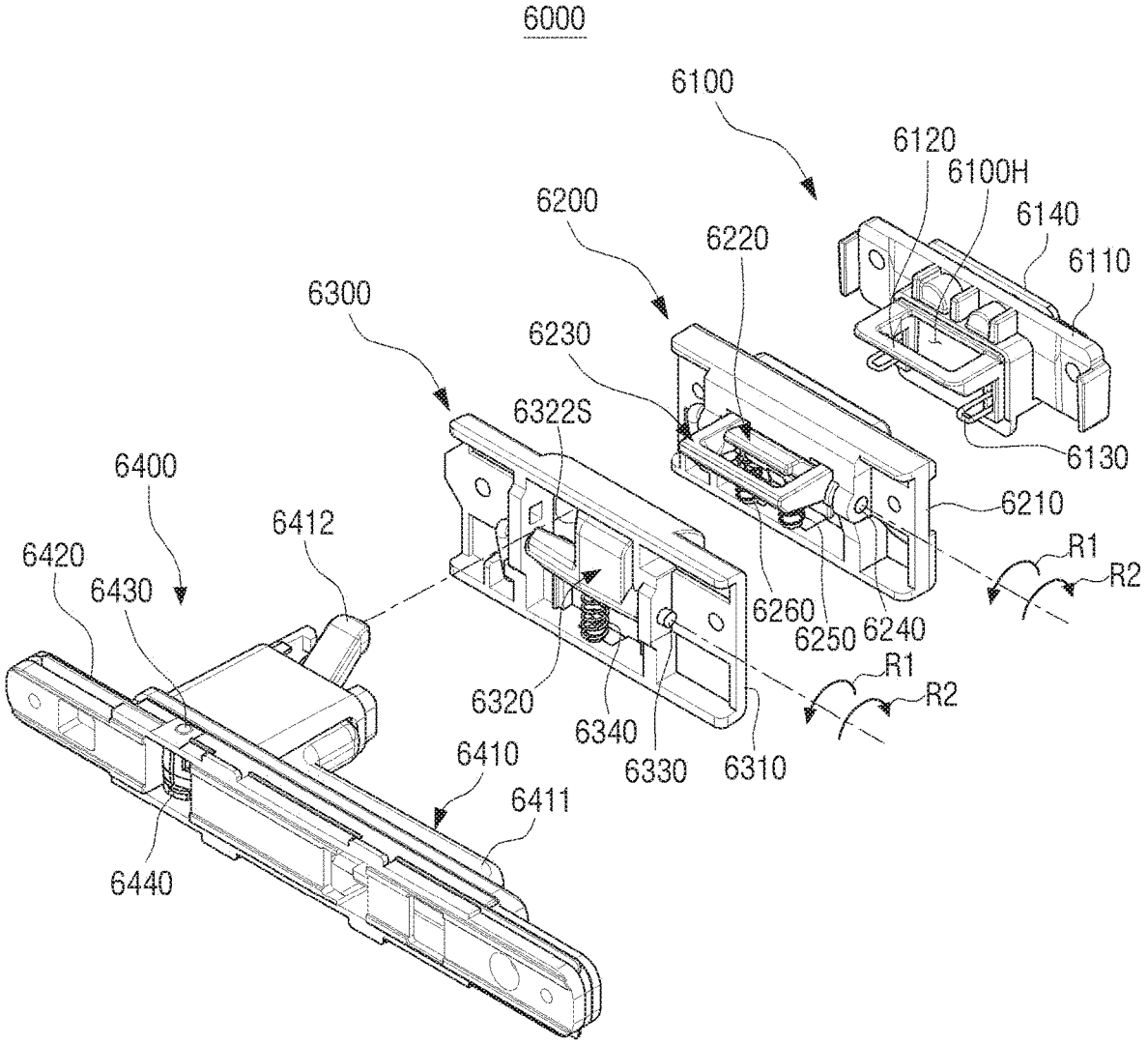
FIGS. 17 and 18 are exploded perspective views of the locking device illustrated in FIG. 16 according to various embodiments of the disclosure.
Figure 18:
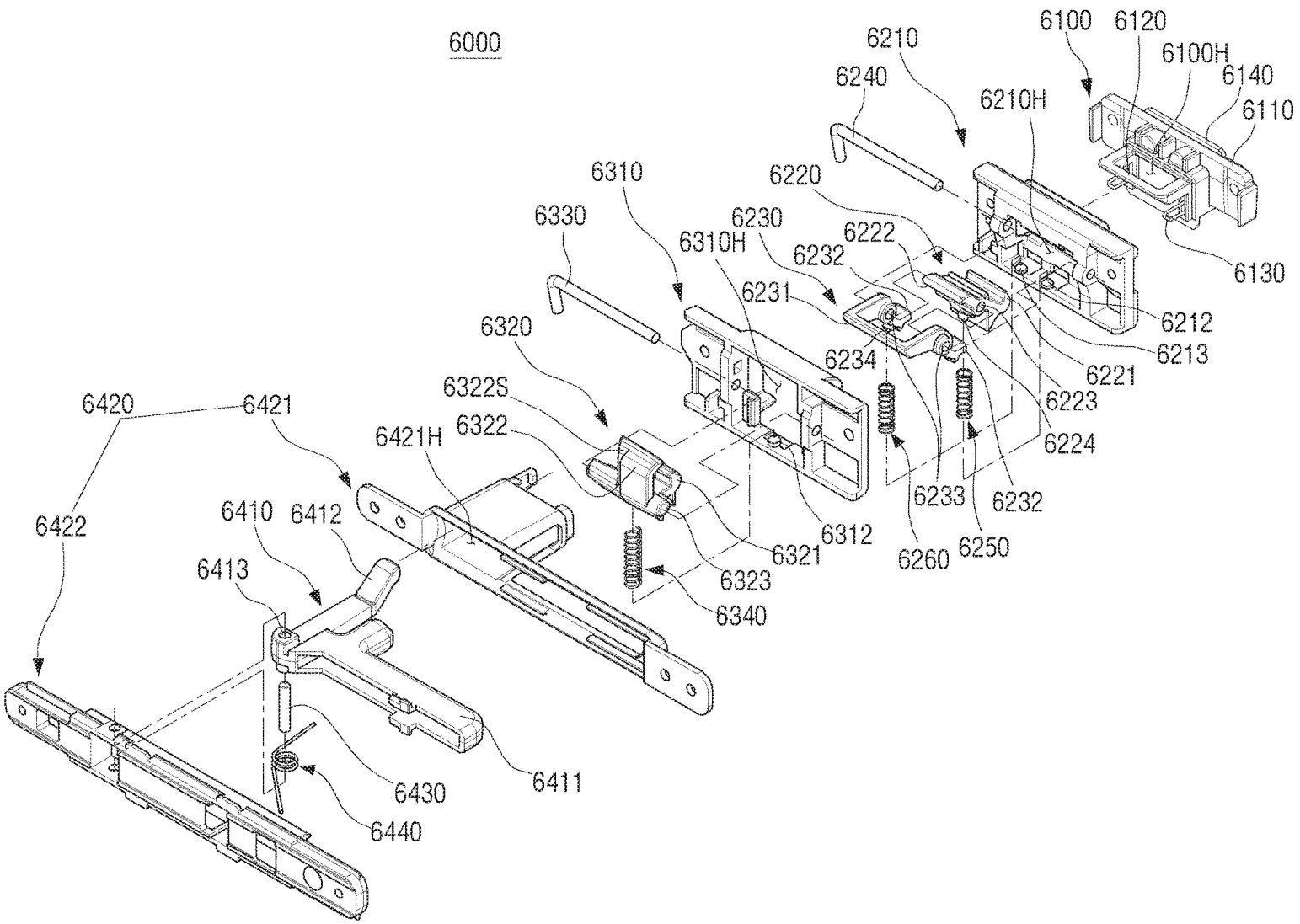
Figure 19:
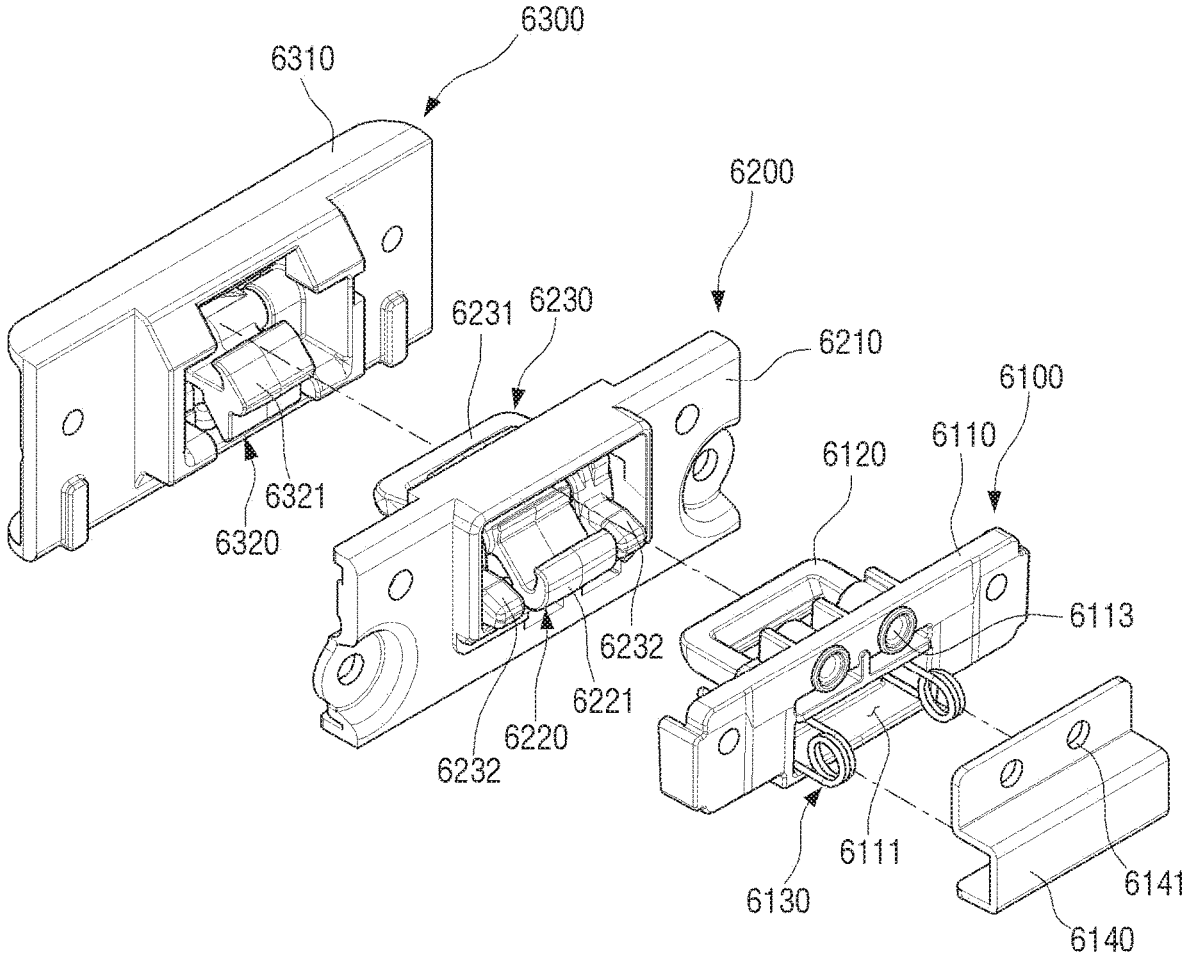
FIG. 19 is a perspective view of a main ring unit, a first locking unit, and a second locking unit of the locking device of FIG. 16, viewed in a different direction according to an embodiment of the disclosure.

FIG. 16 is a perspective view of a locking device 6000 according to another embodiment of the disclosure, and FIGS. 17 and 18 are exploded perspective views of the locking device 6000 illustrated in FIG. 16. FIG. 19 is an exploded perspective view of a main ring unit 6100, a first locking unit 6200, and a second locking unit 6300 of the locking device 6000 illustrated in FIG. 16, which is viewed in a different direction.

Referring to FIGS. 16, 17, 18 and 19, the locking device 6000 according to another embodiment of the disclosure includes the main ring unit 6100 installed in the main body 10 (See FIG. 3B), the first locking unit 6200 installed in the first door 21 (See FIG. 3B) and selectively coupled to the main ring unit 6100, the second locking unit 6300 installed in the second door 22 (See FIG. 3C) and selectively coupled to the first locking unit 6200, and an operating lever 6400 separating the second door 22 from the first door 21, when pressed.

The operating lever 6400 is installed in the door handle 221 (see FIG. 3C), and when pressed, the operating lever 6400 separates the first locking unit 6200 and the second locking unit 6300 to separate the first door 21 and the second door 22. That is, when the user presses the operating lever 6400, the second locking unit 6300 may be separated from the first locking unit 6200 to separate the second door 22 from the first door 21.

The main ring unit 6100 is installed to face the first door 21 on the front panel 11 (See FIG. 21) of the main body 10.

The main ring unit 6100 includes a body 6110 provided on the front panel 11, a main ring 6120 installed on the body 6110 and protruding forwards, and a pair of pressing members 6130 installed on a lower side of the main ring 6120.

A coupling hole 6100H may be formed between the body 6110 and the main ring 6120. To this end, the main ring 6120 may have a substantially U shape.

The pair of pressing members 6130 are provided on both sides of the main ring 6120 below the main ring 6120 to correspond to a pair of support protrusions 6232 of the first locking unit 6200 of the first door 21 (to be described later). Specifically, the pair of pressing members 6130 press the pair of support protrusions 6232 to block the pair of support protrusions 6232 from rotating in one direction.

Further, the pair of pressing members 6130 may move in a vertical direction with respect to the body 6110 and are provided to apply a constant force to the pair of support protrusions 6232. A front end of the pair of pressing members 6130, i.e., one end thereof facing the first door 21, has a sloped portion 6131*a* (See FIG. 20), and thus, when the first door 21 is closed, the pair of support protrusions 6232 of the first locking unit 6200 of the first door 21 may move along the sloped portion 6131*a* and are positioned below the pair of pressing members 6130. Thus, since the pair of pressing members 6130 may be movable vertically and apply a constant force, the pair of pressing members 6130 may absorb a position error of the pair of support protrusions 6232 of the first locking unit 6200 which occurs when the first door 21 is assembled to maintain a predetermined position. Also, a portion in contact with the pair of support protrusions 6232 of the pair of pressing members 6130 has predetermined rigidity to guide movement of the pair of support protrusions 6232.

The pair of pressing members 6130 may be formed as torsion springs.

Figure 20:
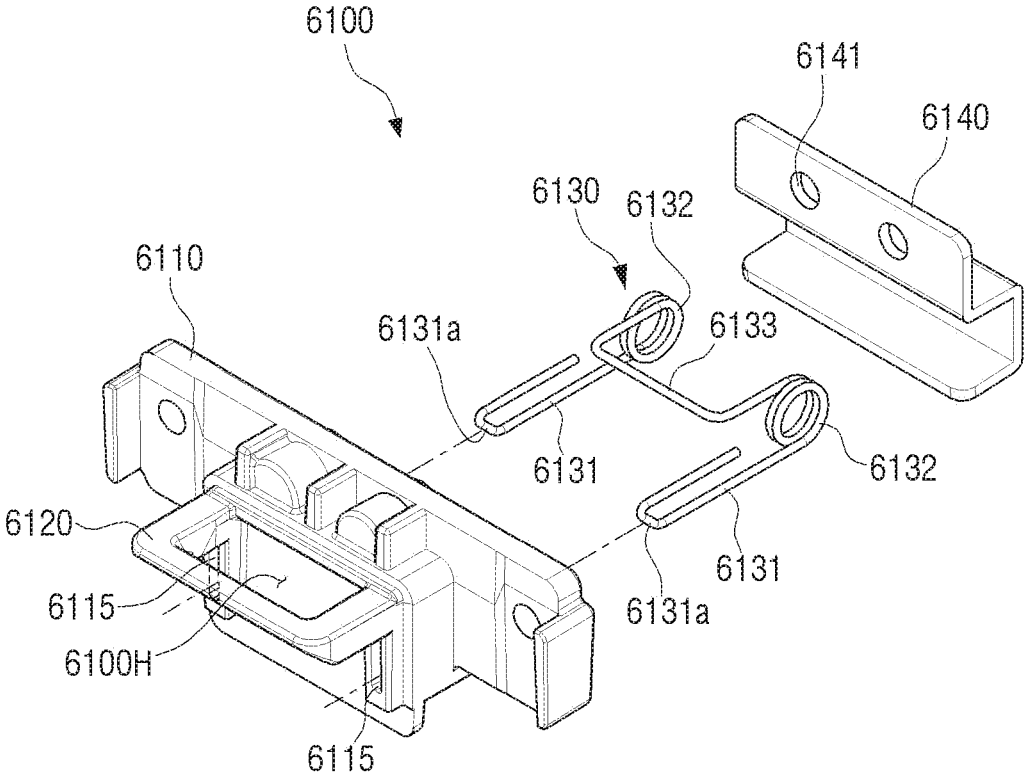
FIG. 20 is a perspective view illustrating a torsion spring of a main ring unit of the locking device of FIG. 16 according to an embodiment of the disclosure.

FIG. 20 is a perspective view illustrating a case where the pair of pressing members 6130 of the main ring unit 6100 of the locking device 6000 of FIG. 16 are realized as torsion springs.

Referring to FIG. 20, the pair of pressing members 6130 may protrude forwards from the body 6110 and include first and second pressing members 6131 in contact with the pair of support protrusions 6232 of the first locking unit 6200, first and second torsion spring portions 6132 connected to the first and second pressing members 6131 and a connecting portion 6133 connecting the other ends of the first and second torsion spring portions 6132.

A first pressing portion of the first and second pressing members 6131 extends from one end of a first torsion spring portion of the first and second torsion spring portions 6132 and the sloped portion 6131*a* is provided at a front end of the first pressing portion. A second pressing portion of the first and second pressing members 6131 is formed to be the same as the first pressing portion. That is, the second pressing portion extends from one end of the second torsion spring portion of the first and second torsion spring portions 6132, and the sloped portion 6131*a* is provided at a front end of the second pressing portion of the first and second pressing members. The sloped portion 6131*a* is sloped downwards from the front ends of the first and second pressing members 6131. Thus, when the pair of support protrusions 6232 of the first locking unit 6200 come into contact, the first and second pressing members 6131 of the pair of pressing members 6130 may move vertically with respect to the first and second torsion spring portions 6132 and apply a constant force to the pair of support protrusions 6232.

The first pressing portion and the second pressing portion of the first and second pressing members 6131 are formed in parallel and spaced apart from each other by a predetermined distance to correspond to the pair of support protrusions 6232 of the first locking unit 6200. The first torsion spring portion and the second torsion spring portion of the first and second torsion spring portions 6132 are also spaced apart from the first pressing portion and the second pressing portion of the first and second pressing members 6131 equally.

A pressing member accommodation portion 6111 in which the pair of pressing members 6130 may be installed is provided on a rear surface of the body 6110 and a pair of pressing member insertion recesses 6115 communicating with the pressing member accommodation portion 6111 are formed at both sides of the main ring 6120 on the front surface of the body 6110. Therefore, when the pair of pressing members 6130 are inserted into the pressing member accommodation portion 6111 of the body 6110, the first and second pressing members 6131 protrude from the front surface of the body 6110 through the pair of pressing member insertion recesses 6115 and the first and second torsion spring portions 6132 and the connecting portion 6133 are located in the pressing member accommodation portion 6111.

A protective cover 6140 protecting the pair of pressing members 6130 may be provided on the rear surface of the body 6110. The protective cover 6140 may be fixed to the body 6110 using a fastening element such as a bolt or a screw. In the case of the embodiment illustrated in FIG. 19, in order to fix the protective cover 6140 to the body 6110, two female threads 6113 are provided in the body 6110, and the protective cover 6140 has two through holes 6141.

The first locking unit 6200 includes a first holder 6210 installed on the first door 21, a first hook member 6220 rotatably installed in the first holder 6210, a first rotary shaft 6240 installed in the first holder 6210 and allowing the first hook member 6220 to be rotatably coupled thereto, and a first elastic member 6250 applying an elastic force to the first hook member 6220 to cause the first hook member 6220 to rotate in the first rotation direction R1 to be coupled to the main ring unit 6100.

The first elastic member 6250 may be a compression spring.

The first holder 6210 includes a first opening 6210H, and the first hook member 6220 is rotatably installed in the first opening 6210H.

The first rotary shaft 6240 is coupled to the first holder 6210 to penetrate through the first opening 6210H and inserted into the first hook member 6220 installed in the first opening 6210H in a horizontal direction. Accordingly, the first hook member 6220 may rotate at a predetermined angle in the first opening 6210H.

The first hook member 6220 includes a hook-shaped first hook portion 6221 formed at one end and coupled with the main ring 6120 of the main ring unit 6100 and a first to-be-pressed portion 6222 formed at the other end opposite to the first hook portion 6221, and a first through hole 6223 into which the first rotary shaft 6240 is inserted is formed between the first hook portion 6221 and the first to-be-pressed portion 6222.

In addition, a first coupling protrusion 6224, to which one end of the first elastic member 6250 is coupled, is formed on a lower side of the first hook portion 6221.

In addition, a second coupling protrusion 6212, to which the other end of the first elastic member 6250 is coupled, is formed on an inner side of the first holder 6210.

Accordingly, the first hook member 6220 may rotate in the first rotation direction R1 upon receiving an elastic force from the first elastic member 6250. Thus, when the first hook member 6220 rotates and the first hook portion 6221 is inserted into the coupling hole 6100H of the main ring unit 6100 and hooked to the main ring 6120, the first hook member 6220 and the main ring unit 6100 may be coupled.

The second locking unit 6300 includes a second holder 6310 installed in the second door 22, a second hook member 6320 rotatably installed in the second holder 6310, and a second elastic member 6340 applying an elastic force to the second hook member 6320 to cause the second hook member 6320 to rotate in the first rotation direction R1.

The second elastic member 6340 may be a compression spring.

The second holder 6310 includes a second opening 6310H and the second hook member 6320 is rotatably installed in the second opening 6310H.

The second rotary shaft 6330 is coupled to the second holder 6310 to penetrate through the second opening 6310H and inserted into the second hook member 6320 installed in the second opening 6310H in the horizontal direction. Accordingly, the second hook member 6320 may rotate at a predetermined angle in the second opening 6310H.

The second hook member 6320 includes a hook-shaped second hook portion 6321 formed at one end to press the first to-be-pressed portion 6222 of the first hook member 6220 and a second to-be-pressed portion 6322 formed at the other end opposite to the second hook portion 6321, and a second through hole 6323, into which the second rotary shaft 6330 is inserted, is formed between the second hook portion 6321 and the second to-be-pressed portion 6322.

In addition, a third coupling protrusion 6324 (See FIG. 21), to which one end of the second elastic member 6340 is coupled, is formed on a lower side of the second hook portion 6321.

In addition, a fourth coupling protrusion 6312, to which the other end of the second elastic member 6340 is coupled, is formed on an inner side of the second holder 6310.

Accordingly, the second hook member 6320 may rotate in the first rotation direction R1 upon receiving the elastic force from the second elastic member 6340 and elastically supports the first hook member 6220 to separate the first hook member 6220 from the main ring unit 6100 in a state in which the first and second doors 21 and 22 are closed.

To this end, the elastic force from the second elastic member 6340 is preferably greater than the elastic force from the first elastic member 6250.

More specifically, the second hook member 6320 may rotate in the first rotation direction R1 upon receiving the elastic force from the second elastic member 6340. Thus, the second hook portion 6321 of the second hook member 6320 presses the first to-be-pressed portion 6222 of the first hook member 6220 in the first rotation direction R1.

Thus, since the second hook portion 6321 of the second hook member 6320 presses the first hook member 6220 in a direction opposite to the elastic force from the first elastic member 6250, the first hook member 6220 does not rotate in the first rotation direction R1.

Since the first hook member 6220 is elastically supported by the second hook member 6320, the first hook member 6220 may be fixed in position in a state in which the first hook member 6220 rotates at a predetermined angle in the second rotation direction R2 opposite to the first rotation direction R1.

A separate stopper (not shown) interfered with the first hook member 6220 may be provided in the first holder 6210 to prevent the first hook member 6220 from rotating at a predetermined angle or greater in the second rotation direction R2 opposite to the first rotation direction R1 when the first hook member 6220 is pressed by the second hook portion 6321 of the second hook member 6320.

Here, elastically supporting the first hook member 6220 by the second hook member 6320 means that the second hook member 6320 supports the first hook member 6220 through an elastic force from the second elastic member 6340 so that the first hook member 6220, which is to rotate in the first rotation direction R1 by the first elastic member 6250, does not rotate in the first rotation direction R1 but maintained in position.

Also, for the second hook member 6320 rotated by the second elastic member 6320 in the first rotation direction R1 to elastically support the first hook member 6220, a separate stopper (not shown), which is interfered with the second hook member 6320, may be installed in the second holder 6310 to prevent the second hook member 6320 from rotating by a predetermined angle or greater in the first rotation direction R1.

The above-described dual opening preventing members include a rotary ring member 6230 rotatably provided at the first holder 6210 and a third elastic member 6260 applying an elastic force to the rotary ring member 6230 to allow the rotary ring member 6230 to rotate in the first rotation direction R1 to be coupled with the second hook member 6320.

The third elastic member 6260 may be a compression spring.

When the operating lever 6400 is pressed in a state in which the first door 21 is open, the dual opening preventing members maintain a state in which the second door 22 is coupled to the first door 21, thus preventing the second door 22 from being opened when the first door 21 is open.

The rotary ring member 6230 is installed in the first opening 6210H of the first holder 6210 and coupled to the first rotary shaft 6240, and thus, the rotary ring member 6230 may rotate coaxially with the first hook member 6220.

The rotary ring member 6230 includes a rotary ring portion 6231 formed at one end adjacent to the second hook portion 6321 of the second hook member 6320 and the pair of support protrusions 6232 formed at the other end opposite to the rotary ring portion 6231.

The pair of support protrusions 6232 protrude from both ends of the rotary ring portion 6231 and, and a pair of third through holes 6233, into which the first rotary shaft 6240 is inserted, is formed between the pair of support protrusions 6232 and the rotary ring portion 6231.

The first hook member 6220 may be disposed between the pair of support protrusions 6232.

In addition, the rotary ring member 6230 includes a fifth coupling protrusion 6234 formed on at least one of the pair of support protrusions 6232.

The fifth coupling protrusion 6234 may protrude from the lower end of at least one of the support protrusions 6232.

One end of the third elastic member 6260 is coupled to the fifth coupling protrusion 6234.

A sixth coupling protrusion 6213, to which the other end of the third elastic member 6260 is coupled, is formed on an inner side of the first opening 6210H of the first holder 6210.

Accordingly, the rotary ring member 6230 may rotate in the first rotation direction R1 upon receiving the elastic force from the third elastic member 6260, whereby the rotary ring portion 6231 is hooked by the second hook portion 6321 of the second hook member 6320 and the rotary ring member 6230 and the second hook member 6320 may be coupled.

In addition, in a state in which the first door 21 is closed, the pair of support protrusions 6232 of the rotary ring member 6230 are pressed by the pair of pressing members 6130 of the main ring unit 6100 so that the rotary ring member 6230 may not rotate in the first rotation direction R1.

The rotary ring member 6230 is elastically supported by the second hook member 6320 when the first door 21 is open and separated from the pair of pressing members 6130.

Here, elastically supporting the rotary ring member 6230 by the second hook member 6320 means that the second hook member 6320 supports the rotary ring member 6230 through an elastic force from the second elastic member 6340 so that the rotary ring member 6230, which is to rotate in the first rotation direction R1 by the third elastic member 6260, does not rotate in the first rotation direction R1 and maintained in position.

To this end, the elastic force from the second elastic member 6340 is preferably greater than the elastic force from the third elastic member 6260.

The elastic force from the second elastic member 6340 may be set to be greater than the sum of the elastic force from the first elastic member 6250 and the elastic force from the third elastic member 6260 so that the second hook member 6320 elastically supports both the first hook member 6220 and the rotary ring member 6230.

The operating lever 6400 is installed in the door handle 221 and is operable by pressure to separate the second door 22 from the first door 21.

When pressed by the operating lever 6400, the second hook member 6320 may rotate in the second rotation direction R2 in which the second hook member 6320 is separated from the rotary ring member 6230.

The operating lever 6400 includes a lever body 6410, a lever case 6420 in which the lever body 6410 is rotatably installed, a lever shaft 6430 inserted into the lever body 6410, and a lever elastic member 6440 applying an elastic force to the lever body 6410.

The lever body 6410 includes a grip portion 6411 the user may grip and a pressing portion 6412 extending from one end of the grip portion 6411.

The pressing portion 6412 protrudes toward the second hook member 6320 and is in contact with the second to-be-pressed portion 6322 of the second hook member 6320.

A lever shaft hole 6413 through which the lever shaft 6430 is inserted is formed between the grip portion 6411 and the pressing portion 6412.

The lever shaft hole 6413 penetrates through the lever body 6410 in a vertical direction. When the lever shaft 6430 is inserted into the lever shaft hole 6413, the lever body 6410 may rotate about the lever shaft 6430 horizontally on a horizontal plane.

Thus, when the grip portion 6411 is pressed by the user, the lever body 6410 rotates about the lever shaft 6430 and the pressing portion 6412 presses the second to-be-pressed portion 6322 of the second hook member 6320.

The lever case 6420 includes a first case 6421 and a second case 6422 coupled to a lower surface of the first case 6421.

The first case 6421 includes a through portion 6421H in which the pressing portion 6412 of the lever body 6410 is accommodated, and the lever shaft 6430 is coupled to the second case 6422.

The lever elastic member 6440 applies an elastic force to the lever body 6410 so that the lever body 6410 may rotate in a direction opposite to the direction in which the second to-be-pressed portion 6322 is pressed.

The lever elastic member 6440 may be a torsion spring.

Thus, the user may rotate the lever body 6410 such that the pressing portion 6412 presses the second hook member 6320 by pressing the grip portion 6411 with a force greater than the elastic force from the lever elastic member 6440.

The second to-be-pressed portion 6322 of the second hook member 6320 pressed by the pressing portion 6412 of the lever body 6410 includes a sliding surface 6322S in contact with the pressing portion 6412.

When the lever body 6410 rotates as the grip portion 6411 is pressed, the sliding surface 6322S is pressed by the pressing portion 6412 and the second hook member 6320 rotates in the second rotation direction R2.

When the grip portion 6411 of the operating lever 6400 is pressed in a state in which the first and second doors 21 and 22 are closed, the second hook member 6320 rotates in the second rotation direction R2 and may be separated from the rotary ring member 6230.

However, the structure in which the second hook member 6320 rotates in the second rotation direction R2 through an operation of the operating lever 6400 may be modified into various structures in addition to the above-described structure.

As illustrated in FIG. 1, the operating lever 6400 may be installed in the door handle 221.

In this case, the user may open the second door 22 by pulling the door handle 221 in a state in which the user presses the grip portion 6411 of the operating lever 6400.

In another example, although not shown, the operating lever 6400 may be installed in one side of the door handle 221 facing the front surface of the second door 22 to face the front surface of the second door 22.

In this case, the user may pull the second door 22 in an opening direction using the door handle, simultaneously when the user presses the grip portion 6411 of the operating lever 6400.

In another example, although not shown, the operating lever 6400 may be installed in the control panel 30, or the like, rather than being installed in the door handle 221. In this case, the user may open the second door 22 by pulling the door handle 221 in a state of pressing the grip portion 6411 of the operating lever 6400.

Figure 21:
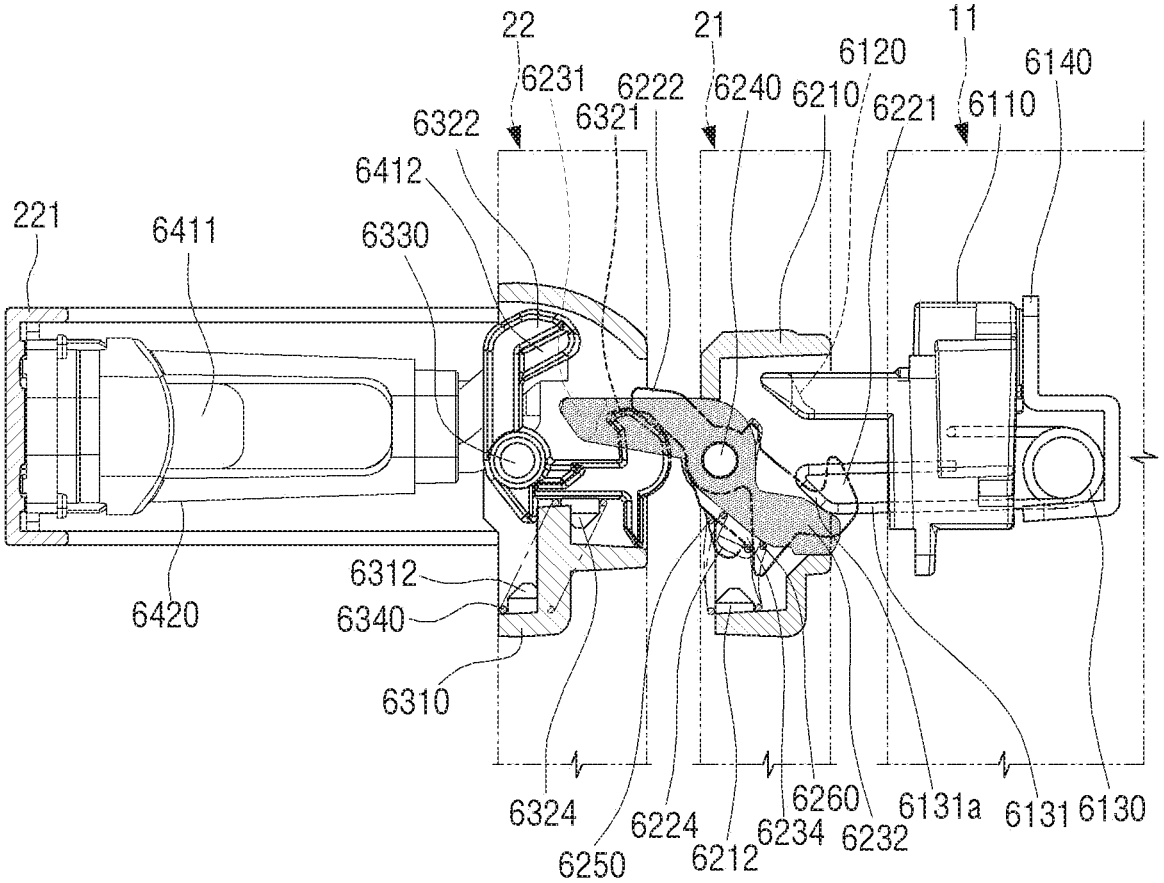
FIG. 21 is a view illustrating a locking device in a state in which first and second doors are closed according to an embodiment of the disclosure.

FIG. 21 is a view illustrating the locking device 6000 in a state in which the first and second doors 21 and 22 are closed.

Referring to FIG. 21, in a state in which the first and second doors 21 and 22 are closed, the rotary ring member 6230 is maintained in position as the pair of support protrusions 6232 are pressed by the pair of pressing members 6130 of the main ring unit 6100.

The second hook member 6320 presses the first to-be-pressed portion 6222 of the first locking unit 6200 through the second hook portion 6321 so that the first hook member 6220 is not coupled to the main ring 6120 of the main ring unit 6100, thereby elastically supporting the first hook member 6220.

Also, the second hook portion 6321 of the second hook member 6320 maintains a state of being coupled to the rotary ring portion 6231 of the rotary ring member 6230.

Accordingly, in a state in which the first and second doors 21 and 22 are closed, the rotary ring member 6230 installed in the first door 21 is coupled with the second hook member 6320 installed in the second door 22, whereby rotation of the second door 22 with respect to the first door 21 is prevented and the first door 21 may rotate from the main body 10.

Figure 22A:
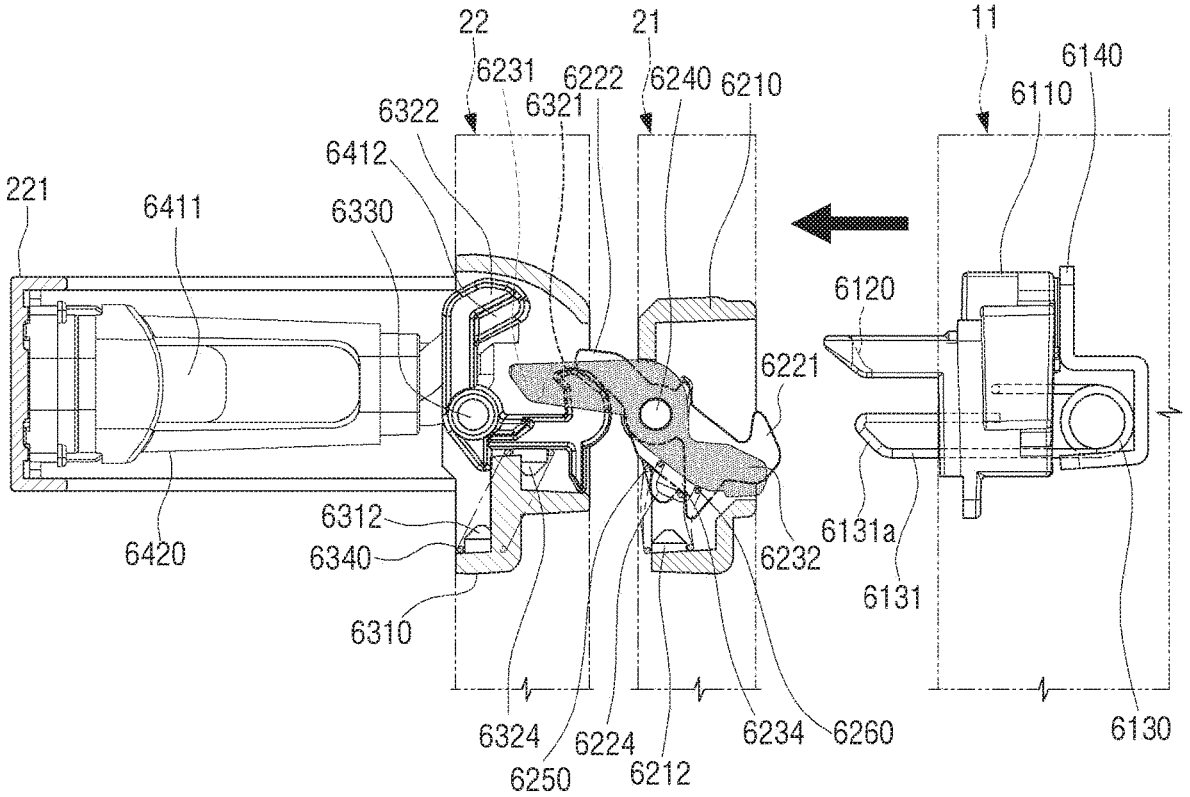
FIG. 22A is a view illustrating a locking device in a state in which a first door is open according to an embodiment of the disclosure.

FIG. 22A is a view illustrating the locking device 6000 in a state in which the first door 21 is open.

As described above, in a state in which the first and second doors 21 and 22 are closed, the first hook member 6220 is not coupled with the main ring unit 6100 and the second hook member 6320 and the rotary ring member 6230 are coupled.

Thus, when the user pulls the door handle 221, in a state in which the second door 22 is closed, the first door 21 rotates about the first hinge shaft 211 and is opened.

Referring to FIG. 22A, when the first door 21 is open, the pair of support protrusions 6232 of the rotary ring member 6230 are separated from the pair of pressing members 6130 of the main ring unit 6100. Accordingly, the rotary ring member 6230 is elastically supported by the second elastic member 6340 in a state of being coupled with the second hook member 6320.

Figure 22B:
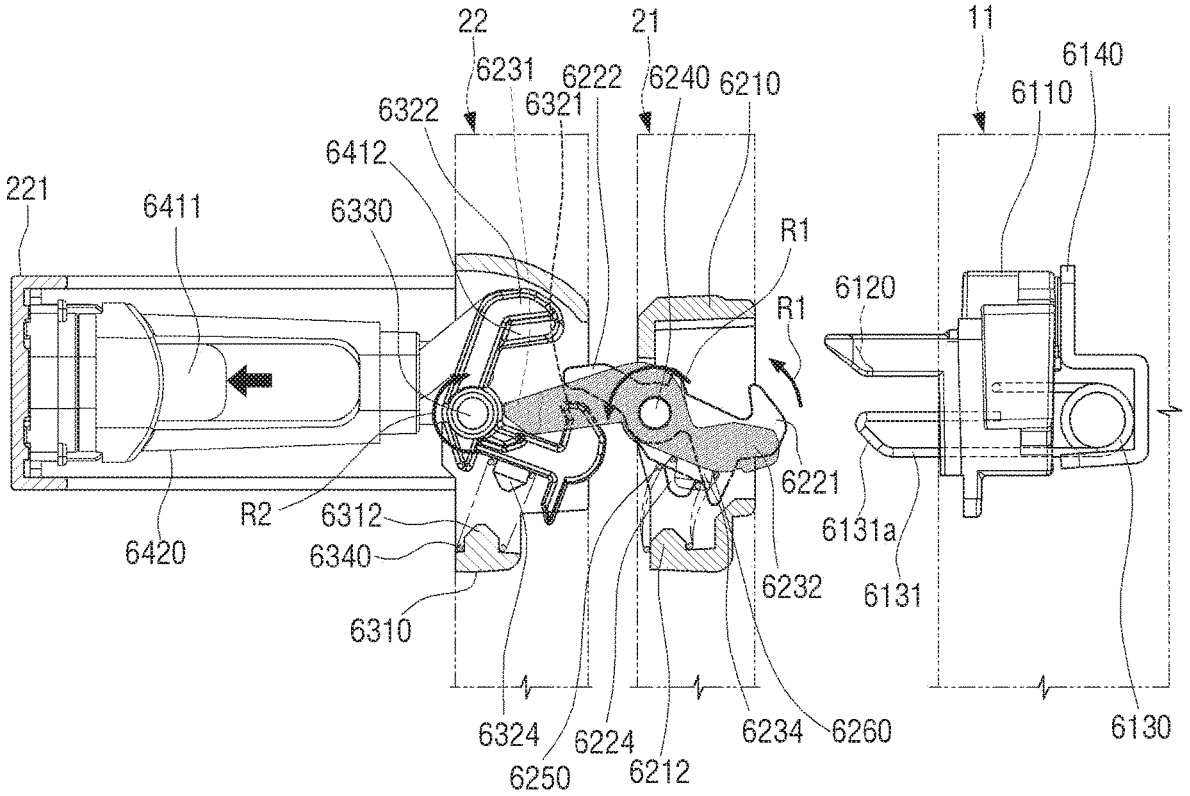
FIG. 22B is a view illustrating an operation of a locking device when an operating lever is pressed in a state in which a first door is open according to an embodiment of the disclosure.

FIG. 22B is a view illustrating an operation of the locking device 6000 when the operating lever 6400 is pressed in a state in which the first door 21 is open.

Referring to FIG. 22B, when the grip portion 6411 of the operating lever 6400 is pressed in a state in which the first door 21 is open, the lever body 6410 rotates and the pressing portion 6412 presses the second to-be-pressed portion 6322 of the second hook member 6320.

When the sliding surface 6322S of the second to-be-pressed portion 6322 of the second hook member 6320 is pressed by the pressing portion 6412 of the lever body 6410, the second hook member 6320 rotates in the second rotating direction R2.

As described above, in a state in which the first door 21 is open and the rotary ring member 6230 is coupled with the second hook member 6320, the rotary ring member 630 is elastically supported by the second elastic member 6340. Thus, when the second hook member 6320 rotates in the second rotation direction R2, the rotary ring member 6230 coupled with the second hook member 6320 rotates in the first rotation direction R1 by the third elastic member 6260.

Accordingly, the rotary ring member 6230 installed in the first door 21 and the second hook member 6320 installed in the second door 22 may be maintained in the coupled state.

Therefore, although the operating lever 6400 is pressed in a state in which the first door 21 is open, the second door 22 may be prevented from being opened, thus preventing the first and second doors 21 and 22 from being opened dually.

Figure 23A:
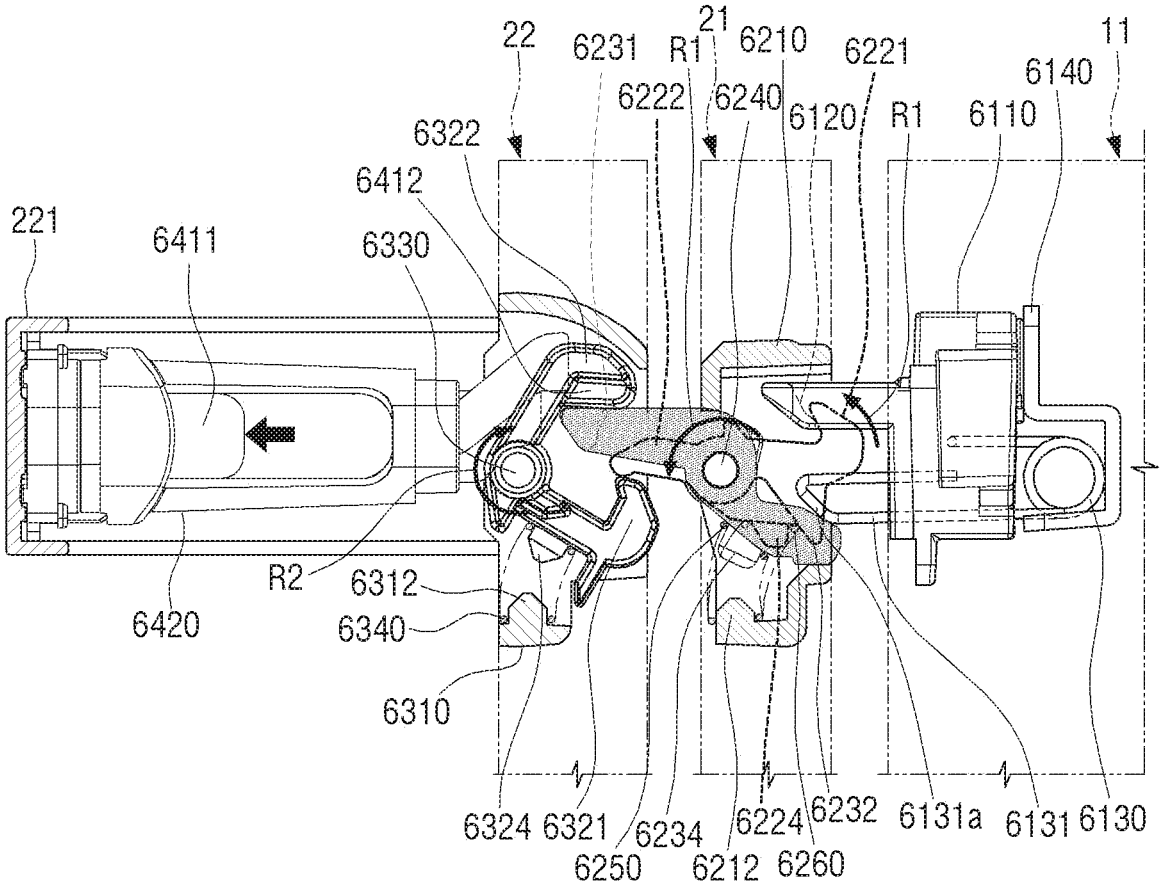
FIGS. 23A and 23B are views illustrating an operation of a locking device in the process of opening a second door according to various embodiment of the disclosure.
Figure 23B:
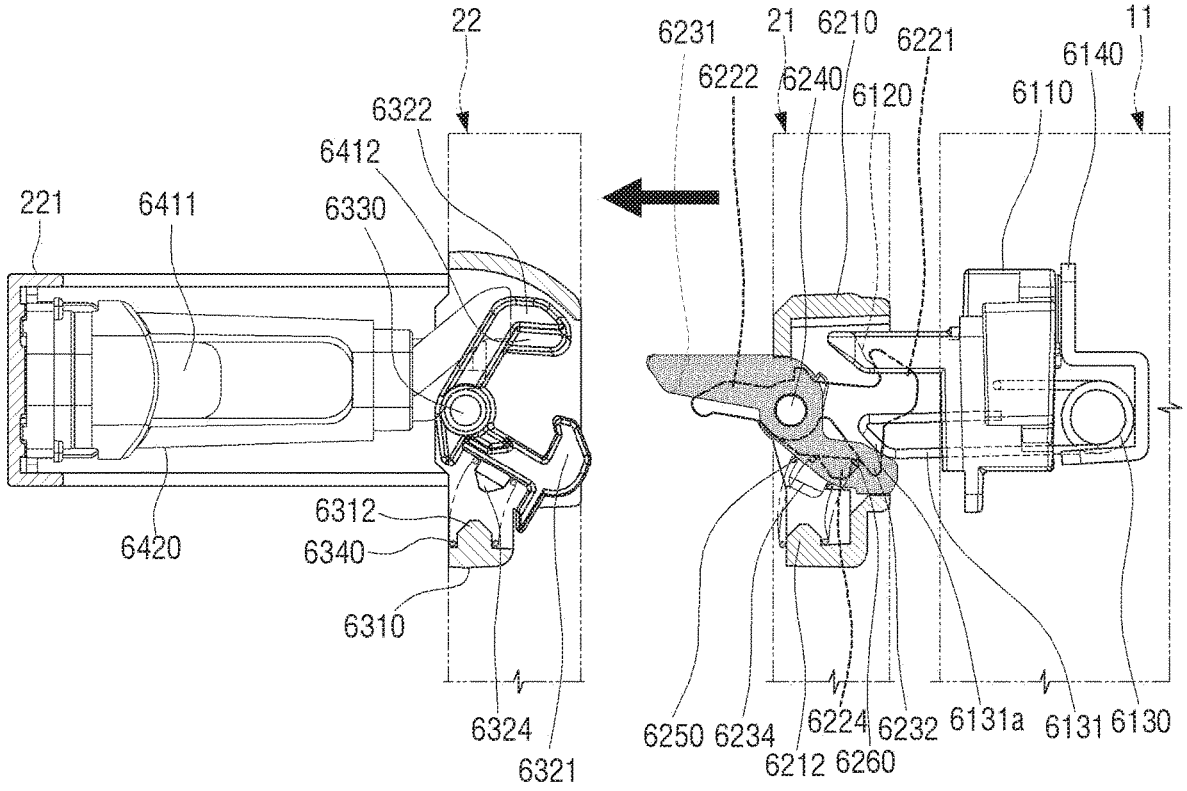

FIGS. 23A and 23B are views illustrating an operation of the locking device 6000 when the second door 22 is opened.

Referring to FIG. 23A, when the grip portion 6411 of the operating lever 6400 is pressed in a state in which both the first and second doors 21 and 22 are closed, the lever body 6410 rotates and the pressing portion 6412 presses the second to-be-pressed portion 6322 of the second hook member 6320.

As the sliding surface 6322S of the second to-be-pressed portion 6322 is pressed by the pressing portion 6412 of the lever body 6410, the second hook member 6320 rotates in the second rotation direction R2.

In a state in which the first door 21 is closed, the rotary ring member 6230 is maintained in position as the pair of support protrusions 6232 are pressed by the pair of pressing members 6130 of the main ring unit 6100.

Therefore, when the second hook member 6320 rotates in the second rotation direction R2, the second hook member 6320 may be separated from the rotary ring member 6230.

Also, as the second hook member 6320 rotates in the second rotation direction R2, the first hook member 6220, which is elastically supported by the second hook member 6320, rotates by the first elastic member 6250 in the first rotation direction R1.

When the first hook member 6220 rotates in the first rotation direction R1, the first hook portion 6221 of the first hook member 6220 is hooked by the main ring 6120 of the main ring unit 6100, and thus, the first hook member 6220 is coupled with the main ring unit 6100.

Thereafter, referring to FIG. 23B, when the door handle 221 is pulled in a state in which the grip portion 6411 of the operating lever 6400 is pressed, the second door 22 is separated from the first door 21 and rotate about the second hinge shaft 222 to be opened.

In addition, since the first door 21 is fixed to the main body 10 as the first hook member 6220 is coupled to the main ring unit 6100, the first door 21 is prevented from being opened when the second door 22 is opened.

The operating lever 6400 may selectively separate the second hook member 6320 from the rotary ring member 6230 according to the degree to which the grip portion 6411 is pressed.

For example, the second hook member 6320 may be set to maintain a state of being coupled with the rotary ring member 6230 although the second hook member 6320 rotates in the second rotation direction R, in case where the grip portion 6411 is pressed by 0 mm to 2.5 mm with respect to a distance over which the front end of the grip portion 6411 moves toward the lever case 6420 by pressing. In this state, when the door handle 221 is pulled, the first door 21 is opened.

Also, when the grip portion 6411 is pressed by 2.5 mm to 4.0 mm, the second hook member 6320 and the rotary ring member 6230 maintain the coupled state and the first hook member 6220 is coupled to the main ring unit 6100, whereby the first and second doors 21 and 22 may be maintained in the closed state. In this state, the first door 21 is fixed to the main body 10 and the second door 22 may be fixed to the first door 21, whereby the first and second doors 21 and 22 are not opened although the door handle 221 is pulled.

Also, it may be set such that when the grip portion 6411 is pressed by 4.0 mm to 8.0 mm, the second hook member 6320 is separated from the rotary ring member 6230 to open the second door 22.

When the pair of pressing members 6130 of the main ring unit 6100 in contact with the pair of support protrusions 6232 of the rotary ring member 6230 of the first locking unit 6200 are formed to apply a constant force, while moving vertically with respect to the body 6110, as in the disclosure, although an assembly error occurs in the first locking unit 6200 installed in the first door 21 and the main ring unit 6100 installed in the main body 10, the rotary ring member 6230 of the first locking unit 6200 may maintain a predetermined position by the pair of pressing members 6130 of the main ring unit 6100. Accordingly, the first door 21 and the second door 22 may be smoothly open and closed.

In the above, the case where the pair of pressing members 6130 of the main ring unit 6100 are realized as torsion springs is described, but the pair of pressing members 6130 are not limited thereto. The pair of pressing members 6130 may have various structures as long as they can move vertically with respect to the body 6110 and apply a constant force to the rotary ring member 6230 to maintain the rotary ring member 6230 at a predetermined position.

Figure 24:
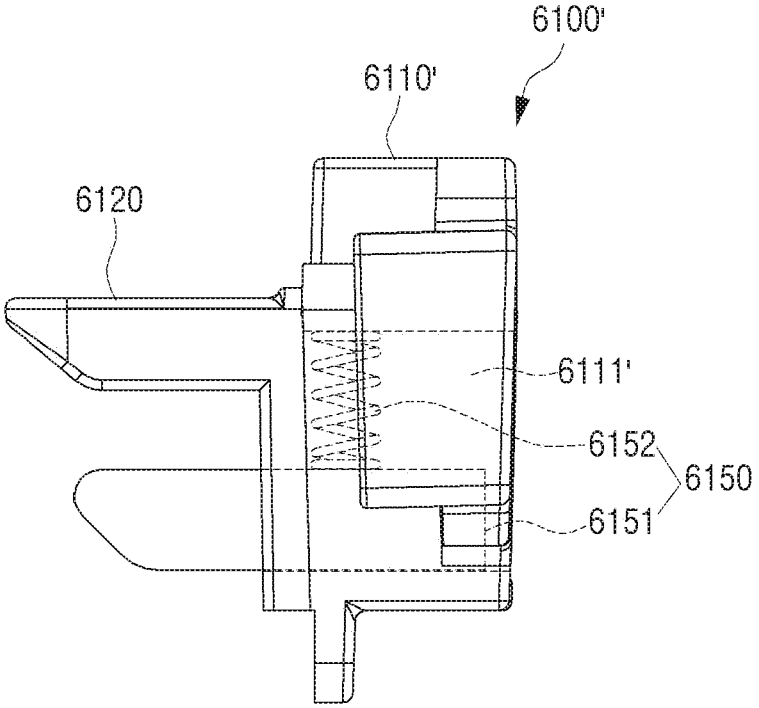
FIG. 24 is a conceptual view illustrating another example of a main ring unit used in the locking device of FIG. 16 according to an embodiment of the disclosure.

An example of a main ring unit having a pair of pressing members having a different structure is illustrated in FIG. 24.

Referring to FIG. 24, a main ring unit 6100' includes a body 6110' installed on the front panel 11 of the main body 10, a main ring 6120' installed on the body 6110' and protruding forwards, and a pair of pressing members 6150 installed below the main ring 6120. For reference, in FIG. 24, only one of the pair of pressing members 6150 is illustrated.

The body 6110' and the main ring 6120 may be formed to be the same as or similar to those of the above-described embodiment, and thus, a detailed description thereof will be omitted.

The pair of pressing members 6150 are formed to correspond to the pair of support protrusions 6232 of the first locking unit 6200 of the first door 21 described above. Specifically, the pair of pressing members 6150 press the pair of support protrusions 6232 of the rotary ring member 6230 to block the pair of support protrusions 6232 from rotating in one direction.

Specifically, the pair of pressing members 6150 may include a pressing portion 6151 and an elastic member 6152.

The pressing portion 6151 is provided to be movable up and down along a pressing portion guide groove 6111' formed in the body 6110, and is formed as a rigid portion which is not deformed even when in contact with the pair of support protrusions 6232 and applies a constant force. A front end of the pressing portion, i.e., one end thereof facing the first door 21, has a sloped portion 6151*a* and a bottom surface of the pressing portion 6151 is planar.

The elastic member 6152 is provided above the pressing portion in the pressing portion guide groove 6111' and elastically supports the pressing portion 6151 in a downward direction. Accordingly, the pressing portion 6151 is elastically supported by the elastic member 6152 and may move up and down with respect to the body 6110', and may apply a constant force to the pair of support protrusions 6232. The elastic member 6152 may be formed as a compression spring.

Thus, when the first door 21 is closed, the pair of support protrusions 6232 of the first locking unit 6200 of the first door 21 move along the sloped surface 6151*a* of the pressing portion 6151 of the pair of pressing members 6150 of the main ring unit 6100 and is positioned below the pressing portion 6151.

Figure 25:
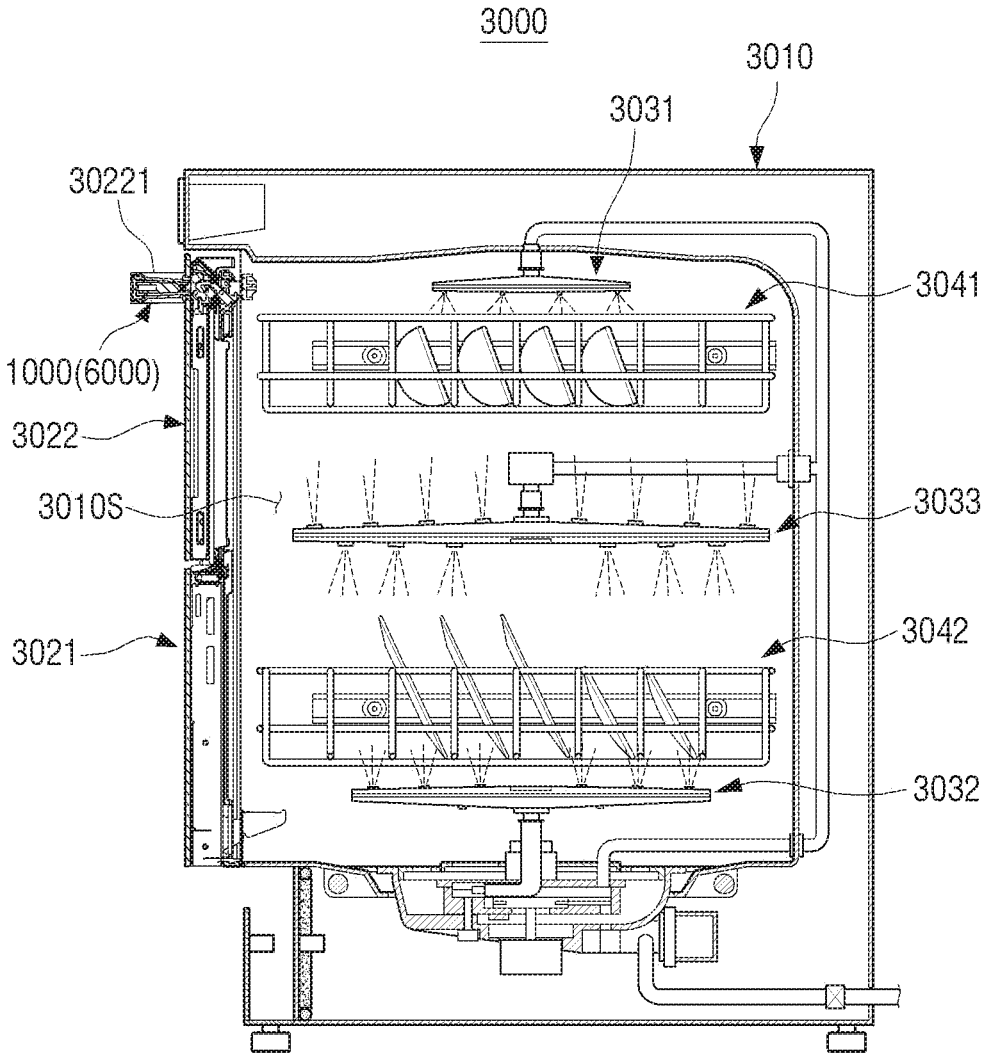
FIG. 25 is a cross-sectional view illustrating a dishwasher to which a locking device according to an embodiment of the disclosure.

FIG. 25 is a cross-sectional view illustrating a dishwasher 3000 to which the locking device 1000 or 6000 according to an embodiment of the disclosure is applied.

Referring to FIG. 25, the locking device 1000 or 6000 according to an embodiment of the disclosure may be applied to the dishwasher 3000 having first and second doors 3021 and 3022 as double doors.

The dishwasher 3000 includes a main body 3010 forming an appearance and first and second doors 3021 and 3022 coupled to the main body 3010.

A washing chamber 3010S is provided in the main body 3010. The washing chamber 3010S is a space in which dishes are washed.

A plurality of baskets for accommodating dishes are disposed in the washing chamber 3010S.

The plurality of baskets may include a first basket 3041 and a second basket 3042.

The first basket 3041 is disposed on an upper side of the second basket 3042 inside the washing chamber 3010S.

A first spray nozzle 3031 is disposed above the first basket 3041 and a second spray nozzle 3032 is disposed below the second basket 3042. A third spray nozzle 3033 may be disposed between the first and second baskets 3041 and 3042.

The first spray nozzle 3031 may spray high pressure washing water from an upper side of the first basket 3041 toward the first basket 3041 to wash the dishes accommodated in the first basket 3041, and the second spray nozzle 3032 may spray high pressure washing water from a lower side of the first basket 3041 toward the first basket 3041 to wash the dishes accommodated in the second basket 3042. In addition, the third spray nozzle 3033 may spray washing water toward a lower portion of the first basket 3041 and an upper portion of the second basket 3042.

Most of the structure of the dishwasher 3000 illustrated in FIG. 25 is the same as or similar to that of the related art structure, and thus, a description of the repeated structure will be omitted.

As illustrated in FIG. 25, with respect to the third spray nozzle 3033 disposed at the center of the washing chamber 3010S, the first basket 3041 is disposed above the third spray nozzle 3033 and the second basket 3042 is disposed below the third spray nozzle 3033.

The open front surface of the washing chamber 3010S may be opened and closed by a first door 3021 rotatably connected to the main body 3010.

The first door 3021 has a size corresponding to a shape of the front surface of the washing chamber 3010S to open and close the entire washing chamber 3010S and has an opening connected to the washing chamber 3010S.

The second door 3022 is rotatably coupled to the first door 3021 to open and close the opening of the first door 3021 and a door handle 30221 is coupled to an upper side.

When the first door 3021 is open, the entire area of the washing chamber 3010S may be open and the dishes may be inserted into the first and second baskets 3041 and 3042 or may be drawn out therefrom.

If the amount of the dishes to be washed is small, a portion of the washing chamber 3010S may be opened by opening only the second door 3022, whereby the dishes may be placed in the first basket 3041 and only the first and third spray nozzles 3031 and 3033 may be operated to wash the dishes efficiently.

The first and second doors 3021 and 3022 are similar in structure to the first and second doors 21 and 22 of the oven 1 illustrated in FIGS. 3A to 3C, and thus, a description of the repeated configuration will be omitted.

The dishwasher 3000 includes the locking device 1000 or 6000 for selectively fixing the first and second doors 3021 and 3022 so that the first and second doors 3021 and 3022 selectively rotate.

The locking device 1000 or 6000 may include the main ring unit 1100 or 6100 installed in the main body 3010, the first locking unit 1200 or 6200 installed in the first door 3021 and selectively coupled to the main ring unit 1100 or 6100, the second locking unit 1300 or 6300 installed in the second door 3022 and selectively coupled to the first locking unit 1200 or 6200, and the operating lever 1400 or 6400 installed in the door handle 30221 and separating the second door 3022 from the first door 3021 by pressure.

Through the locking device 1000 or 6000, the first door 3021 and the second door 3022 may be selectively opened.

Also, the second door 3022 is prevented from being opened dually in a state in which the first door 3021 is open and the first door 3021 is prevented from being opened in a state in which the second door 3022 is open through the locking device 1000 or 6000.

A specific structure in which dual opening of the first and second doors 3021 and 3022 is prevented through the locking device 1000 or 6000 is similar to the operational process of the locking device 1000 or 6000 described above with reference to FIGS. 3A to 9B and FIGS. 16 to 23B.

In addition, the locking device 1000 or 6000 applied to the dishwasher 3000 may be replaced by the locking device 2000 according to another embodiment of the disclosure illustrated in FIG. 10.

Figure 26:
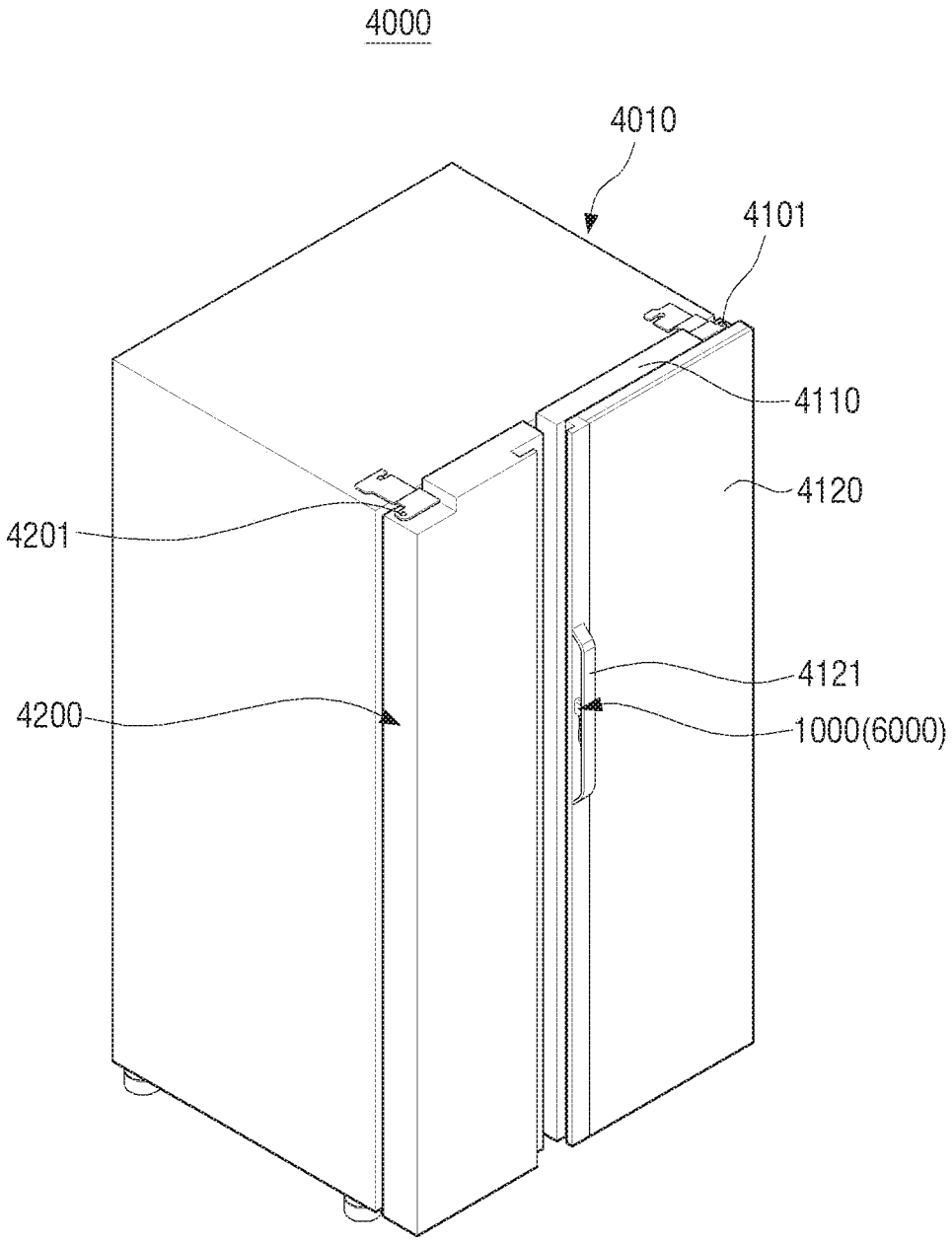
FIG. 26 is a perspective view of a refrigerator to which a locking device according to an embodiment of the disclosure.
Figure 27:
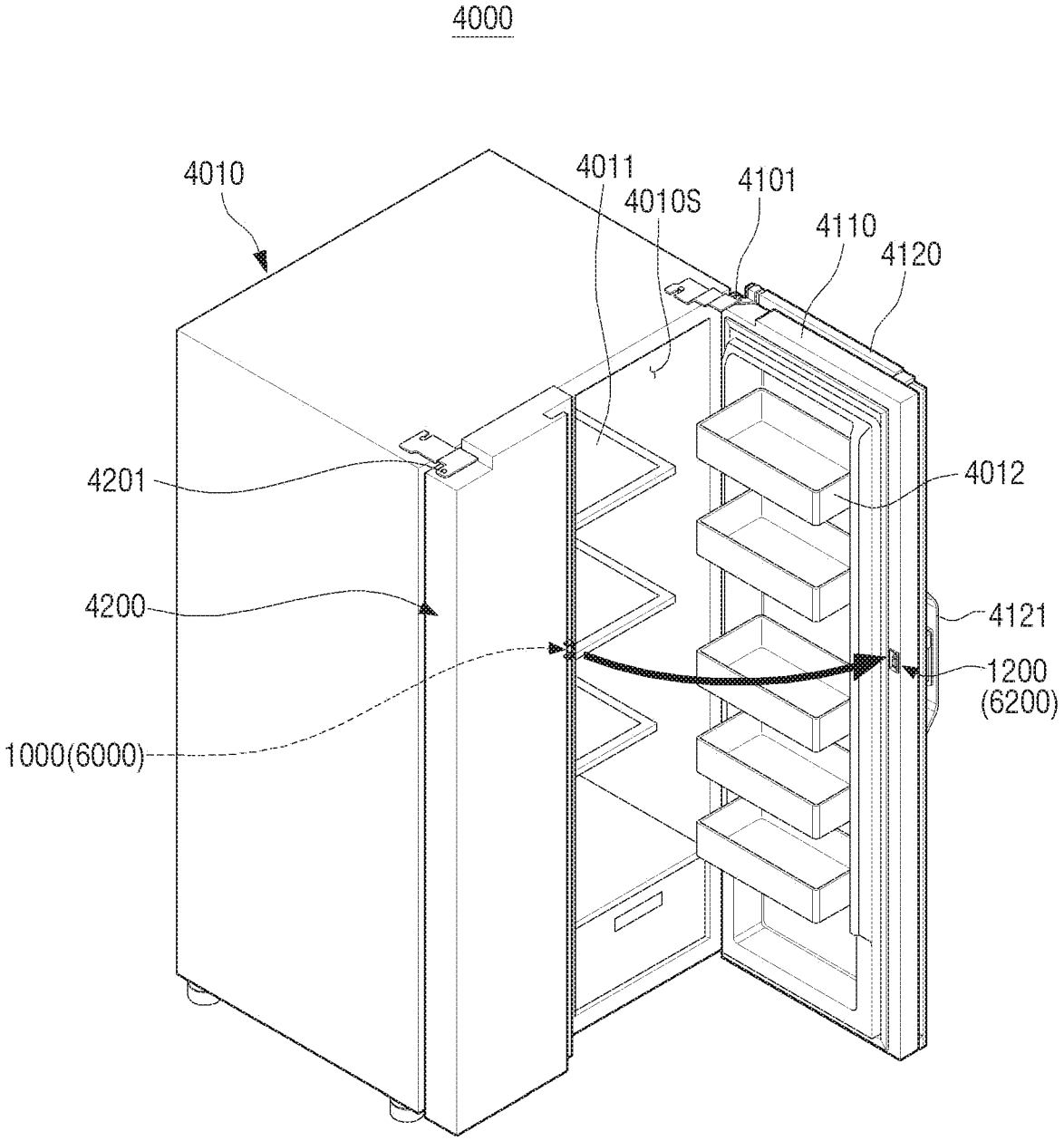
FIG. 27 is a perspective view illustrating a state in which a first door of the refrigerator illustrated in FIG. 26 is open according to an embodiment of the disclosure.
Figure 28:
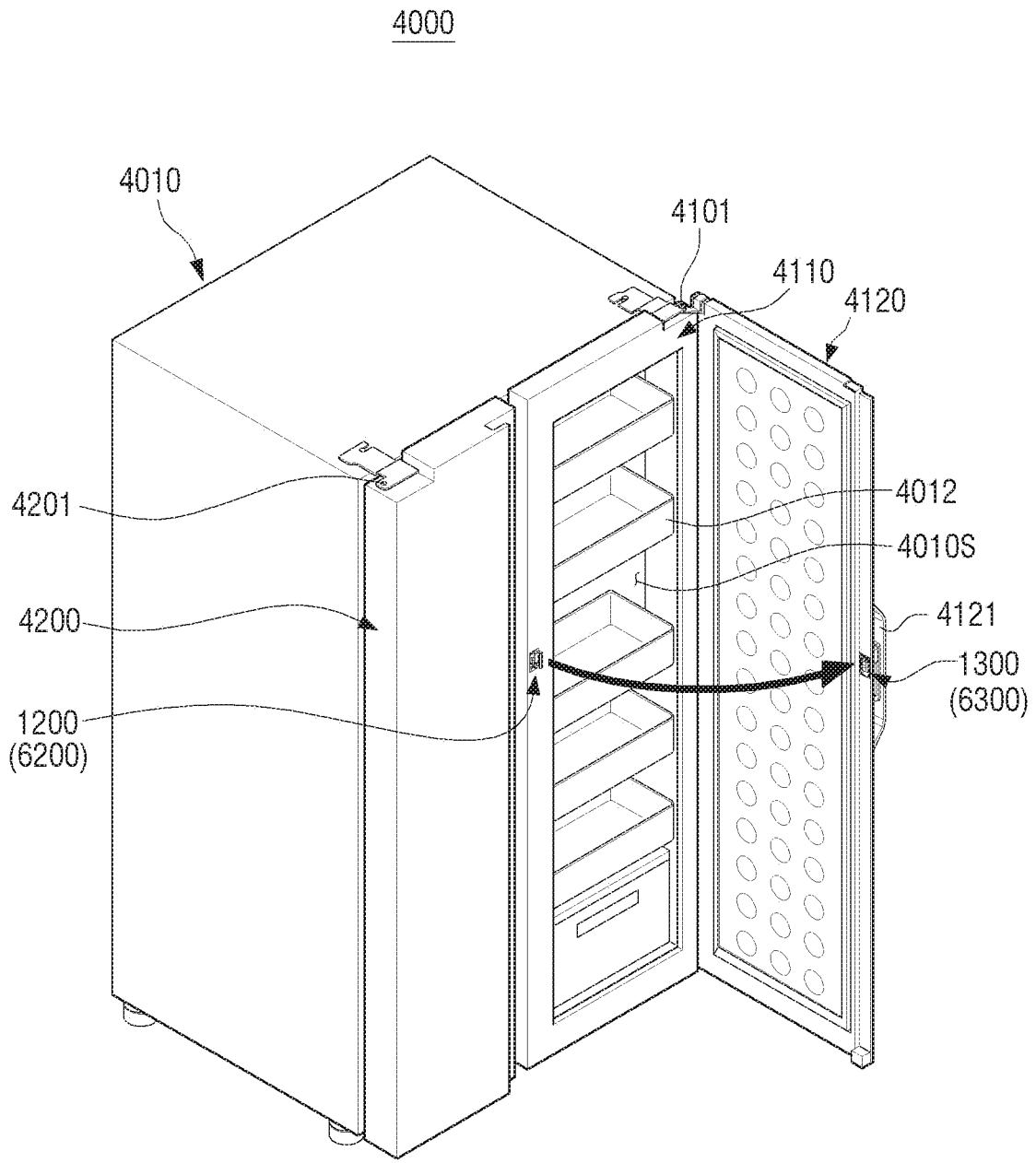
FIG. 28 is a perspective view illustrating a state in which a second door of the refrigerator illustrated in FIG. 26 is open according to an embodiment of the disclosure.

FIG. 26 is a perspective view of a refrigerator 4000 to which a locking device according to an embodiment of the disclosure is applied, FIG. 27 is a perspective view illustrating a state in which a first door 4110 of the refrigerator 4000 illustrated in FIG. 26 is open, and FIG. 28 is a perspective view illustrating a state in which a second door 4120 of the refrigerator 4000 illustrated in FIG. 26 is open.

The locking device 1000 or 6000 according to an embodiment of the disclosure may be applied to the refrigerator 4000 having first and second doors 4110 and 4120 as double doors.

Referring to FIGS. 26, 27, and 28, the refrigerator 4000 has a storage chamber 4010S provided inside a main body 4010 forming an appearance and may store food in the storage chamber 4010S, which may be a low temperature storage chamber.

In the main body 4010, a plurality of storage chambers may be provided, and the plurality of storage chambers may be respectively opened and closed by doors.

As illustrated in FIG. 26, the refrigerator 4000 includes first and second doors 4110 and 4120 rotatably coupled to a first hinge shaft 4101 provided at one side of the main body 4010 and a third door 4200 rotatably coupled to a second hinge shaft 4201 provided at the other side of the main body 4010.

As described above, the main body 4010 may include a plurality of storage chambers, and the plurality of storage chambers may be divided into a refrigerating chamber and a freezing chamber.

The plurality of storage chambers may be opened and closed by the first and second doors 4110 and 4120 and the third door 4200, respectively.

In FIGS. 27 and 28, for the purposes of description, it is illustrated that the storage chamber 4010S is opened by the first and second doors 4110 and 4120.

A plurality of shelves 4011 on which food may be placed are arranged inside the storage chamber 4010S.

The open front surface of the storage chamber 4010S may be opened and closed by the first door 4110 rotatably connected to the main body 4010.

The first door 4110 may include an opening connected to the storage chamber 4010S and a plurality of auxiliary shelves 4012 may be disposed inside the opening of the first door 4110.

The second door 4120 is rotatably coupled to the first door 4110 to open and close the opening of the first door 4110 and a door handle 4121 is coupled to one side thereof.

The first and second doors 4110 and 4120 may be coupled to the first hinge shaft 4101 to rotate.

By selectively opening the first and second doors 4110 and 4120, the user may take out food stored in at least one of the plurality of shelves 4011 or selectively easily take out food stored in at least one of the plurality of auxiliary shelves 4012.

Thus, cold air of the refrigerator 4000 may be prevented from flowing out unnecessarily.

The refrigerator 4000 includes the locking device 1000 or 6000 for selectively fixing the first and second doors 4110 and 4120 so that the first and second doors 4110 and 4120 selectively rotate.

The locking device 1000 or 6000 may include the main ring unit 1100 or 6100 installed in the main body 4010, the first locking unit 1200 or 6200 installed in the first door 4110 and selectively coupled to the main ring unit 1100 or 6100, the second locking unit 1300 or 6300 installed in the second door 4120 and selectively coupled to the first locking unit 1200 or 6200, and the operating lever 1400 or 6400 installed in the door handle 4121 and separating the second door 4120 from the first door 4110 by pressure.

The first door 4110 and the second door 4120 may be selectively opened through the locking device 1000 or 6000.

Also, the second door 4120 is prevented from being opened dually in a state in which the first door 4110 is open and the first door 4110 is prevented from being opened in a state in which the second door 4120 is open through the locking device 1000 or 6000.

A specific structure in which dual opening of the first and second doors 4110 and 4120 is prevented through the locking device 1000 or 6000 is similar to the operational process of the locking device 1000 or 6000 described above with reference to FIGS. 3A, 3B, 3C, 4-7, 8A, 8B, 9A, 9B, 16-21, 22A, 22B, 23A, and 23B.

In addition, the locking device 1000 or 6000 applied to the refrigerator 4000 may be replaced by the locking device 2000 according to another embodiment of the disclosure illustrated in FIG. 10.

Also, the third door 4200 may also be configured as double doors and may be configured to have a structure similar to those of the first and second doors 4110 and 4120 selectively opened and closed through the locking device 1000 or 6000.

Figure 29:
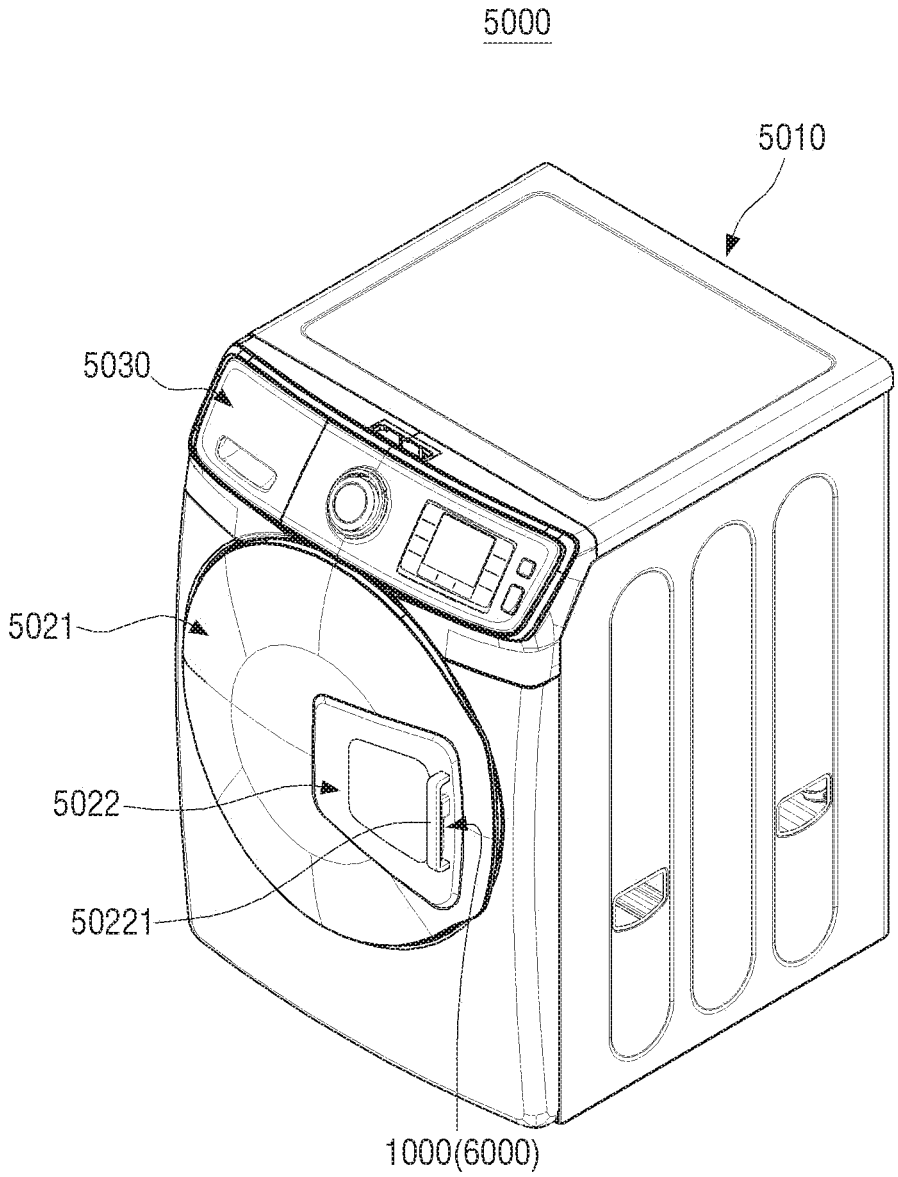
FIG. 29 is a perspective view of a washing machine to which a locking device according to an embodiment of the disclosure.
Figure 30:
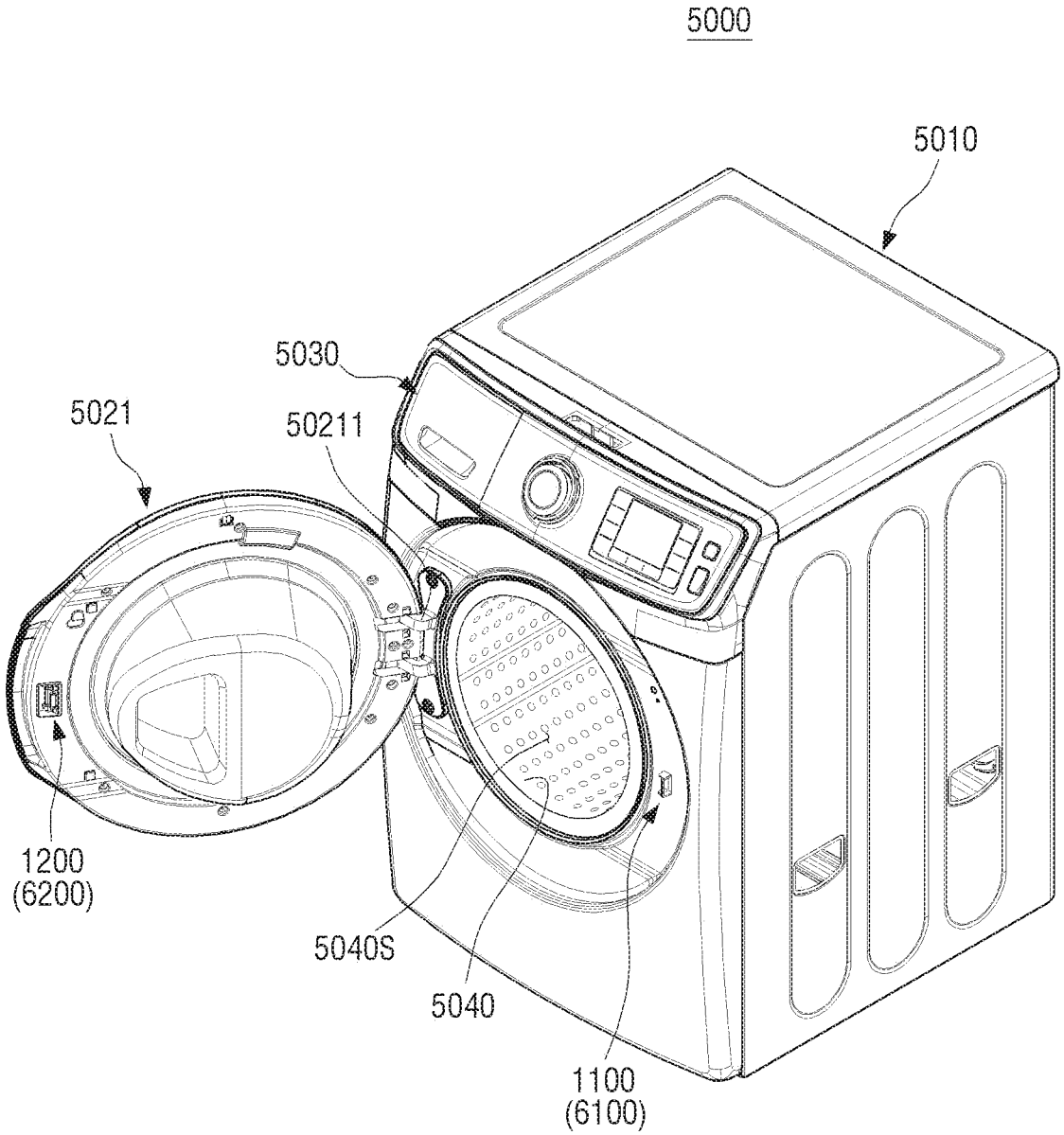
FIG. 30 is a perspective view illustrating a state in which a first door of the washing machine illustrated in FIG. 29 is open according to an embodiment of the disclosure.
Figure 31:
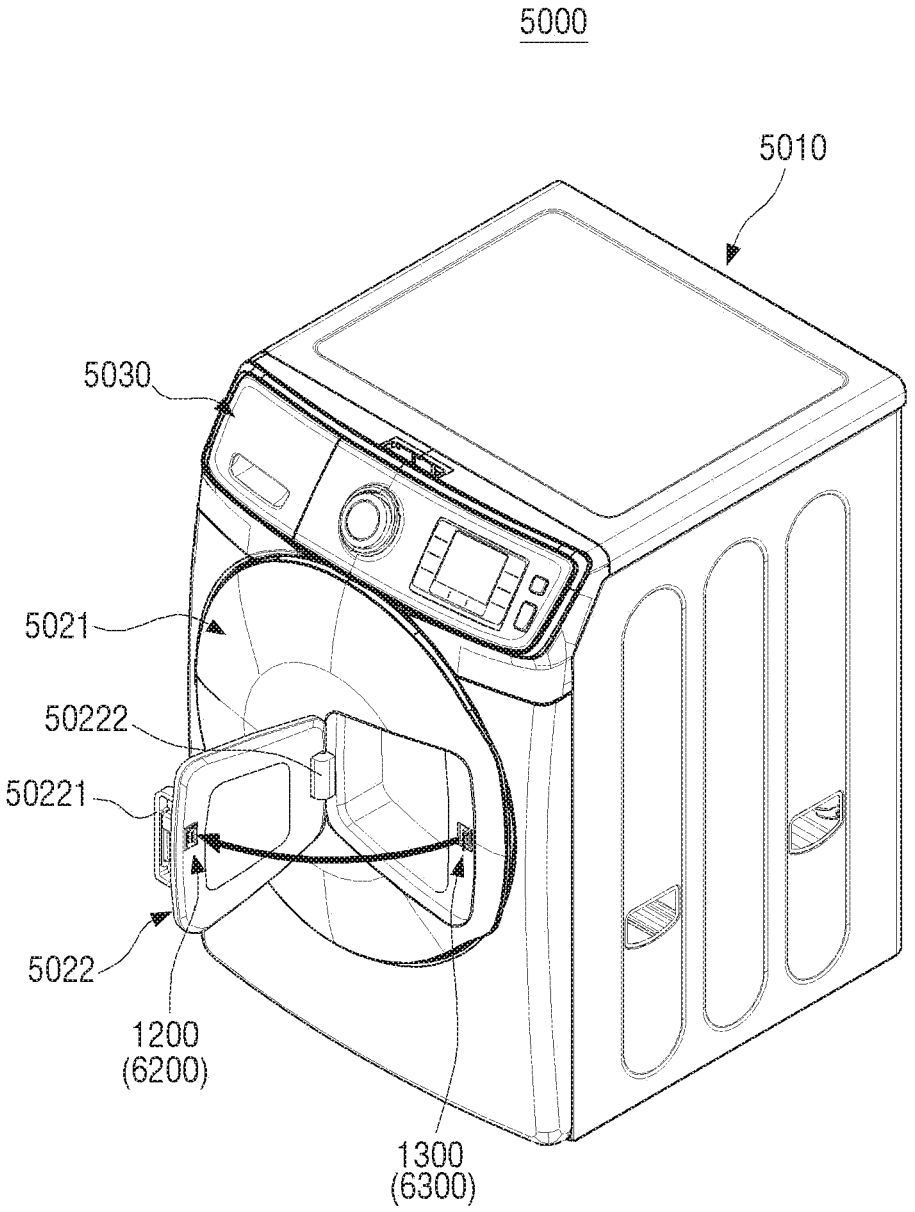
FIG. 31 is a perspective view illustrating a state in which a second door of the washing machine illustrated in FIG. 29 is open according to an embodiment of the disclosure.

FIG. 29 is a perspective view of a washing machine 5000 to which the locking device 1000 or 6000 according to an embodiment of the disclosure is applied, FIG. 30 is a perspective view illustrating a state in which a first door 5021 of the washing machine 5000 illustrated in FIG. 29 is open, and FIG. 31 is a perspective view illustrating a state in which a second door 5022 of the washing machine 5000 illustrated in FIG. 29 is open.

Referring to FIGS. 29, 30, and 31, the locking device 1000 or 6000 according to an embodiment of the disclosure may be applied to the washing machine 5000 having first and second doors 5021 and 5022 as double doors.

The washing machine 5000 includes a main body 5010 forming an appearance, a water tank (not shown) provided inside the main body 5010, and a washing tub 5040 rotatably disposed inside the water tank.

In addition, a control panel 5030 is disposed in an upper portion of the main body 5010.

The washing machine 5000 may wash the laundry contained in a washing chamber 5040S inside the washing tub 5040 by friction with washing water by rotating the washing tub 5040.

The washing chamber 5040S may be opened forwards through an opening formed at a front surface of the main body 5010 and the open front surface of the washing chamber 5040S may be opened and closed by a first door 5021 rotatably connected to the main body 5010.

The first door 5021 has a shape and size corresponding to a shape of the front surface of the washing chamber 5040S to open and close the entire washing chamber 5040S and has an opening connected to the washing chamber 5040S.

The opening of the first door 5021 is configured to be smaller than the front surface of the washing chamber 5040S into which the laundry is introduced.

As the first door 5021 is rotatably coupled to a first hinge shaft 50211 coupled to the main body 5010, the entirety of the washing chamber 5040S may be opened and closed.

Also, the second door 5022 may be rotatably coupled to the first door 5021 to open and close the opening of the first door 5021 and rotate about a second hinge shaft 50222.

Accordingly, the user may open the first door 5011 to open the entire washing chamber 5040S and put the laundry into the washing chamber 5040S or take out the washing-finished laundry.

In addition, while the washing machine 5000 performs washing, the laundry may be additionally introduced to the washing chamber 5040S by opening the second door 5022.

A door handle 50221 is coupled to one side of the second door 5022.

The washing machine 5000 further includes the locking device 1000 or 6000 for selectively fixing the first and second doors 5021 and 5022 so that the first and second doors 5021 and 5022 may be selectively rotated.

The locking device 1000 or 6000 may include the main ring unit 1100 or 6100 installed in the main body 5010, the first locking unit 1200 or 6200 installed in the first door 5021 and selectively coupled to the main ring unit 1100 or 6100, the second locking unit 1300 or 6300 installed in the second door 5022 and selectively coupled to the first locking unit 1200 or 6200, and the operating lever 1400 or 6400 coupled to the door handle 50221 and separating the second door 5022 from the first door 5021 by pressure.

Through the locking device 1000 or 6000, the first door 5021 and the second door 5022 may be selectively opened.

Also, the second door 5022 is prevented from being opened dually in a state in which the first door 5021 is open and the first door 5021 is prevented from being opened in a state in which the second door 5022 is open through the locking device 1000 or 6000.

A specific structure in which dual opening of the first and second doors 5021 and 5022 is prevented through the locking device 1000 or 6000 is similar to the operational process of the locking device 1000 or 6000 described above with reference to FIGS. 3A to 9B and FIGS. 16 to 23B.

In addition, the locking device 1000 or 6000 applied to the washing machine 5000 may be replaced by the locking device 2000 according to another embodiment of the disclosure illustrated in FIG. 10.

As described above, the locking device 1000, 2000, or 6000 according to the embodiment of the disclosure described above may be applied to various home appliances such as the oven 1, the dishwasher 3000, the refrigerator 4000, and the washing machine 5000, each having double doors and prevent the double doors from being opened dually.

The cooking chamber 101 of the oven 1, the washing chamber 3010S of the dishwasher 3000, the storage chamber 4010S of the refrigerator 4000, and the washing chamber 5040S of the washing machine 5000 described above may generally be referred to as an accommodation space of the home appliances to which the locking device 1000, 2000, or 6000 of the disclosure may be applied, and the structure of the oven 1, the dishwasher 3000, the refrigerator 4000, and the washing machine 5000 in which the first and second doors rotate through the hinge shaft may be variously modified.

The locking device 1000 or 6000 according to an embodiment of the disclosure having the structure of applying an elastic force to rotate the first hook member 1220 or 6220, the second hook member 1320 or 6320, and the rotary ring member 1230 or 6230 in a specific direction through the first to third elastic members 1250, 1340, and 1260 or 6250, 6340, and 6260 and pressing the second hook member 1320 or 6320 in a direction opposite to the elastic force of the elastic member through the operating lever 1400 or 6400 has been described as an example, but the plurality of elastic members may be replaced by a solenoid, a motor, or the like, which are operated by the operating lever 1400 or 6400 to rotate the first hook member 1220 or 6220, the second hook member 1320 or 6320, and the rotary ring member 1230 or 6230.

In addition, a plurality of elastic members T1 to T6 of the locking device 2000 according to another embodiment of the disclosure may also be replaced with a solenoid, a motor, or the like.

Various embodiments of the disclosure have been individually described but the embodiments may not necessarily be implemented alone and components and operations of the respective embodiments may be combined with at least any other embodiment so as to be implemented.

While the disclosure has been shown described with reference to various embodiments, thereof, it will be understood by those skilled in the art that various changes in form and details may be made therein without departing from the spirit and scope of the disclosure as defined by the appended claims and their equivalents.

What is claimed is:

1. A home appliance comprising:

a main body having an accommodation space opened to one side;

a first door rotatably coupled to the main body to open and close the accommodation space and having an opening connected to the accommodation space;

a second door rotatably coupled to the first door to open and close the opening; and a locking device configured to:

fix or separate the first door to or from the main body, or fix or separate the second door to or from the first door to allow the first door and the second door to be selectively rotated, wherein the locking device comprises:

a main ring unit provided in the main body, an operating lever configured to separate the second door from the first door by pressure, and a dual opening preventing member configured to maintain a fixed state of the second door with respect to the first door when the operating lever is pressed in a state in which the first door is open by interfering with an operation of the operating lever.

2. The home appliance of claim 1, wherein the locking device further comprises:

a first locking unit provided in the first door and selectively coupled to the main ring unit; and a second locking unit provided in the second door and selectively coupled to the first locking unit, and wherein the operating lever is installed in the second door and is configured to press the second locking unit to separate the second locking unit from the first locking unit.

3. The home appliance of claim 2, wherein the main ring unit comprises:

a body provided in the main body;

a main ring selectively coupled with the first locking unit; and a pair of pressing members installed below the main ring and installed to be movable up and down with respect to the main body.

4. The home appliance of claim 3, wherein the pair of pressing members are configured as torsion springs, and wherein a first end of each of the torsion springs is fixed to the body and a second end of each of the torsion springs in contact with the first locking unit has a sloped portion.

5. The home appliance of claim 4, wherein the first locking unit comprises a first holder installed in the first door and having first and second coupling holes formed on an inner side and first and second engagement protrusions respectively disposed in the first and second coupling holes, wherein the main ring unit comprises:

the body installed in the main body; and a first ring member rotatably installed in the body and rotating in the first rotation direction to be coupled with the first engagement protrusion and rotating in the second rotation direction to be separated from the first engagement protrusion, wherein the second locking unit comprises:

a second holder installed in the second door; and a second ring member rotatably installed in the second holder and rotating in a third rotation direction to be coupled with the second engagement protrusion and rotating in a fourth rotation direction to be separated from the second engagement protrusion, and wherein the dual opening preventing member interferes with the second ring member to block rotation of the second ring member in the fourth rotation direction in a state in which the first and second doors are closed.

6. The home appliance of claim 5, wherein, when the dual opening preventing member is pressed by the operating lever in a state in which the first and second doors are closed, the dual opening preventing member is released from interference with the second ring member and interferes with the first ring member to block rotation of the first ring member in the second rotation direction.

7. The home appliance of claim 5, wherein, when the first door is opened, the dual opening preventing member interferes with an operation of the operating lever.

8. The home appliance of claim 2, wherein the first locking unit comprises:

a first holder installed in the first door;

a first hook member rotatably installed in the first holder; and a first elastic member configured to apply an elastic force to the first hook member to cause the first hook member to rotate in a first rotation direction to be coupled with the main ring unit, wherein the second locking unit comprises:

a second holder installed in the second door;

a second hook member rotatably installed in the second holder; and a second elastic member configured to apply an elastic force to the second hook member to cause the second hook member to rotate in the first rotation direction, and wherein the second hook member elastically supports the first hook member to be separated from the main ring unit in a state in which the first and second doors are closed.

9. The home appliance of claim 8, wherein the dual opening preventing member comprises:

a rotary ring member rotatably installed in the first holder; and a third elastic member configured to apply an elastic force to the rotary ring member to cause the rotary ring member to rotate in the first rotation direction to be coupled with the second hook member.

10. The home appliance of claim 9, wherein, when the first and second doors are closed, the rotary ring member is pressed by the main ring unit in a state in which the rotary ring member is coupled with the second hook member, and wherein, when the first door is opened, the rotary ring member is separated from the main ring unit and elastically supported by the second hook member.

11. The home appliance of claim 10, wherein the second hook member is pressed by the operating lever to rotate in a second rotation direction to be separated from the rotary ring member.

12. The home appliance of claim 11, wherein, when the operating lever is pressed in a state in which the first and second doors are closed, the second hook member rotates in the second rotation direction to be separated from the rotary ring member and the first hook member rotates in the first rotation direction to be coupled with the main ring unit.

13. The home appliance of claim 12, wherein, when the operating lever is pressed in a state in which the first door is open and the second door is closed, the rotary ring member rotates in the first rotation direction in a state in which the rotary ring member is coupled with the second hook member which rotates in the second rotation direction.

14. The home appliance of claim 13, wherein the elastic force of the second elastic member is greater than a sum of the elastic force of the first elastic member and the elastic force of the third elastic member.

15. The home appliance of claim 11, wherein the operating lever comprises:

a lever body having a grip portion and a pressing portion extending from one end of the grip portion; and a lever case in which the lever body is rotatably installed, and wherein, when the grip portion is pressed, the lever body rotates to allow the pressing portion to press the second hook member.

16. The home appliance of claim 15, further comprising:

a door handle installed in the second door, wherein the operating lever is installed in the door handle.

* * * * *